US008353131B2

(12) United States Patent
Freet

(10) Patent No.: US 8,353,131 B2
(45) Date of Patent: Jan. 15, 2013

(54) LOQ-KIT BUILDING COMPONENT SYSTEM

(76) Inventor: Patrick A. Freet, Minneapolis, MN (US)

( * ) Notice: Subject to any disclaimer, the term of this patent is extended or adjusted under 35 U.S.C. 154(b) by 344 days.

(21) Appl. No.: 11/652,312

(22) Filed: Jan. 11, 2007

(65) Prior Publication Data

US 2007/0213960 A1 Sep. 13, 2007

Related U.S. Application Data

(60) Provisional application No. 60/758,746, filed on Jan. 12, 2006.

(51) Int. Cl.
*E04H 1/00* (2006.01)

(52) U.S. Cl. ..... 52/79.9; 52/645; 52/648.1; 446/108; 446/118; 446/120; 446/124; 446/478

(58) Field of Classification Search ..... 52/79.1, 52/79.2, 79.9, 234, 233, 645, 656, 648.1, 52/650.1, 650.2; 446/85, 108–116, 118, 446/120–122, 124, 125, 476, 478
See application file for complete search history.

(56) References Cited

U.S. PATENT DOCUMENTS 1,362,764 A * 12/1920 Warner et al. ..... 52/272
1,593,297 A * 7/1926 Gilmer ..... 52/386
1,995,477 A * 3/1935 Kotrbaty ..... 52/580

(Continued)

FOREIGN PATENT DOCUMENTS

WO WO03003793 * 12/2003

OTHER PUBLICATIONS

Modular Co-Ordination in Building First Report, OEEC, Project N 174, Published by the European Productivity Agency of the Organisation for European Economic Co-Operation 2, Rue Andre-Pascal, Paris—16, 78 pages.

(Continued)

*Primary Examiner* — William Gilbert
*Assistant Examiner* — James Ference
(74) *Attorney, Agent, or Firm* — Kinney & Lange, P.A.

(57) ABSTRACT

Loq·kit is a mass-produced system of interchangeable building components for assembling single or multi-family houses. The building components are of three varieties: structural frame, in-fill, or snap-cladding components. Except for bolted structural frame connections, all connections between parts are snap-lock, and may be released. With snap-lock interfaces and a modular dimensional relationship between components, they can be reconfigured in near endless variety. The components all share a common dimensionality that is derived from a regulating grid. The grid utilizes an alternating sequence of two modules—a module A, and a smaller module B. The A,B,A,B rhythm of gridlines is used to regulate component connection locations in three dimensions. The alternating-sequence grid works by establishing a standard connection width, module B, for making connections between components. Each possible connection width is spaced from another by a common module A. This A,B,A,B grid sequence is used to determine connection locations along the length, width, and height of a building. Because the grid establishes a standard connection size and spacing, modular system dimensions result as a function of connection width and spacing. These modular system dimensions inform the size of structural frame members, and dictate directly the length and width, or length and height, of in-fill and snap-cladding components. The modular sizes and snap-lock interfaces result in a system of components that can be interchanged with each other, reconfigured, and reused.

13 Claims, 40 Drawing Sheets

U.S. PATENT DOCUMENTS 2,070,937 A * 2/1937 Vallet ..... 52/263
2,140,772 A * 12/1938 Slayter et al. ..... 52/580
2,317,634 A * 4/1943 Olsen ..... 52/242
2,355,192 A 8/1944 Wachsmann et al.
2,499,498 A * 3/1950 Hammond, Jr. ..... 52/67
2,534,852 A * 12/1950 Butts ..... 52/646
2,691,291 A * 10/1954 Henderson ..... 52/79.9
3,132,443 A * 5/1964 Kuhn ..... 446/112
3,331,170 A * 7/1967 Lowe et al. ..... 52/79.11
3,507,080 A * 4/1970 Van Hezik ..... 52/79.12
3,525,186 A * 8/1970 Lombardo ..... 52/125.6
3,563,580 A * 2/1971 Black ..... 403/172
3,638,380 A * 2/1972 Perri ..... 52/79.12
3,678,638 A * 7/1972 Mougin ..... 52/79.11
3,690,077 A * 9/1972 Dalgliesh et al. ..... 52/79.8
3,703,058 A * 11/1972 Klett et al. ..... 52/79.13
3,712,007 A * 1/1973 Kump ..... 52/79.12
3,719,012 A * 3/1973 Laurent ..... 52/73
3,721,056 A * 3/1973 Toan ..... 52/236.6
3,744,193 A * 7/1973 Lau ..... 52/30
3,745,736 A * 7/1973 Fischer et al. ..... 52/511
3,746,379 A * 7/1973 Sauer ..... 403/2
3,748,794 A * 7/1973 Lorenzi et al. ..... 52/79.13
3,750,366 A * 8/1973 Rich et al. ..... 52/79.11
3,751,864 A * 8/1973 Berger et al. ..... 52/79.11
3,805,461 A * 4/1974 Jagoda ..... 52/79.11
3,816,931 A * 6/1974 LaMar ..... 33/563
3,863,418 A * 2/1975 Faucheux ..... 52/745.04
3,897,662 A * 8/1975 Fencl ..... 52/79.2
3,902,291 A * 9/1975 Zucht ..... 52/284
3,946,529 A * 3/1976 Chevaux ..... 150/105
3,950,916 A * 4/1976 Kasprzak ..... 52/750
3,982,366 A * 9/1976 Haapala ..... 52/220.2
4,035,973 A * 7/1977 Sutelan ..... 52/263
4,054,014 A * 10/1977 van der Lely ..... 52/745.03
4,069,627 A * 1/1978 Pegg ..... 52/93.1
4,221,099 A * 9/1980 Caserta ..... 52/745.03
4,227,358 A * 10/1980 Gat ..... 52/655.1
4,272,930 A * 6/1981 Foster ..... 52/79.1
4,525,975 A * 7/1985 McWethy ..... 52/745.03
4,569,165 A * 2/1986 Baker et al. ..... 52/81.3
4,602,464 A * 7/1986 Medel ..... 52/236.4
4,640,572 A * 2/1987 Conlon ..... 439/892
4,644,728 A * 2/1987 Stauss et al. ..... 52/710
4,672,732 A * 6/1987 Ramspacher et al. ..... 29/429
4,759,158 A * 7/1988 Aubry ..... 52/79.2
4,766,708 A * 8/1988 Sing ..... 52/167.8
4,925,330 A * 5/1990 Cornish ..... 403/171
4,930,270 A * 6/1990 Bevacqua ..... 52/126.1
4,966,487 A * 10/1990 Sinkoff ..... 403/24
4,992,069 A * 2/1991 Bolli et al. ..... 446/128
5,024,036 A * 6/1991 Johnson ..... 52/600
5,060,426 A * 10/1991 Jantzen ..... 52/86
5,174,081 A * 12/1992 Reichartz ..... 52/263
5,182,886 A * 2/1993 Bateman et al. ..... 52/125.6
5,247,773 A * 9/1993 Weir ..... 52/592.3
5,285,612 A * 2/1994 Johnson ..... 52/655.1
5,333,426 A * 8/1994 Varoglu ..... 52/236.7
5,351,453 A * 10/1994 Leslie ..... 52/270
5,627,763 A * 5/1997 Carlson ..... 703/1
5,644,878 A * 7/1997 Wehrmann ..... 52/287.1
5,647,181 A * 7/1997 Hunts ..... 52/282.1
5,765,333 A * 6/1998 Cunningham ..... 52/481.1
5,809,704 A * 9/1998 Stewart et al. ..... 52/169.4
5,848,513 A * 12/1998 Leslie et al. ..... 52/843
5,876,261 A * 3/1999 Bach et al. ..... 446/105
6,035,594 A * 3/2000 Leslie ..... 52/264
6,129,605 A * 10/2000 Cyrus et al. ..... 446/118
6,235,367 B1 * 5/2001 Holmes et al. ..... 428/45
6,314,702 B1 * 11/2001 Huang ..... 52/656.1
6,591,558 B1 * 7/2003 De Zen ..... 52/91.3
6,616,499 B1 * 9/2003 Sorensen ..... 446/85
6,655,095 B1 * 12/2003 Pingel ..... 52/79.1
6,718,711 B1 * 4/2004 Gilman ..... 52/299
6,758,014 B2 * 7/2004 Chen ..... 52/63
6,766,282 B1 * 7/2004 Schettine ..... 703/1
6,802,158 B1 * 10/2004 Greene ..... 52/79.5
6,889,475 B2 * 5/2005 De Zen ..... 52/91.3
6,959,514 B1 * 11/2005 Pingel ..... 52/79.1
6,959,515 B1 * 11/2005 Beighton ..... 52/79.9
7,036,276 B1 * 5/2006 Apel ..... 52/79.1
7,043,884 B2 * 5/2006 Moreno ..... 52/235
7,062,886 B2 * 6/2006 Auriemma ..... 52/506.07
7,063,481 B2 * 6/2006 Trull ..... 403/170
7,146,770 B2 * 12/2006 Simmons ..... 52/236.6
7,178,297 B2 * 2/2007 Seavy ..... 52/271
7,229,334 B2 * 6/2007 Ishikawa ..... 446/91
7,444,270 B2 * 10/2008 Schettine ..... 703/1
7,513,081 B2 * 4/2009 Armstrong ..... 52/79.1
7,581,363 B2 * 9/2009 Mawby et al. ..... 52/236.5
2002/0095888 A1 * 7/2002 Winskye ..... 52/234
2002/0194795 A1 * 12/2002 Spite ..... 52/79.1
2003/0101680 A1 * 6/2003 Lee ..... 52/745.2
2003/0150179 A1 * 8/2003 Moreno ..... 52/235
2004/0074158 A1 * 4/2004 De Zen ..... 52/79.9

OTHER PUBLICATIONS

Modular Co-Ordination Second Report of EPA Project 174, OEEC, Published in Jul. 1961, Orgainsation for European Economic Co-Operation European Productivity Agency, 51 pages.

"Modular Co-Ordination", National Research Council—Division of Research, Ottowa, Canada, Feb. 15, 1950 (8 pages).

C. Liccese-Torres et al., "The Illustrious Lustron—A guide for the Disassembly and Preservation of America's Modern Metal Marvel", 2007 (38 pages).

* cited by examiner

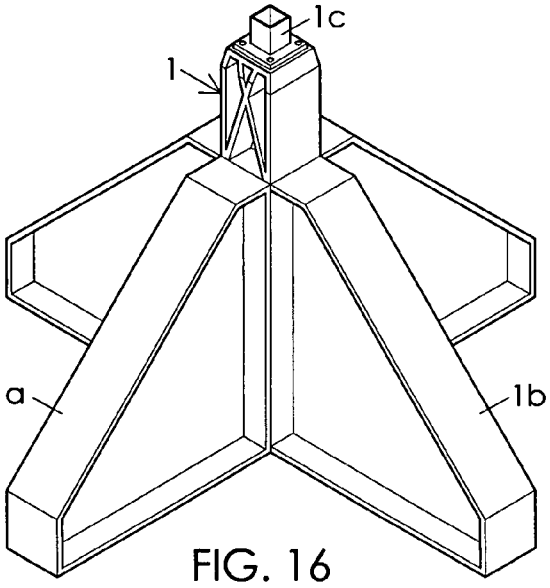
FIG. 16
FIG. 17
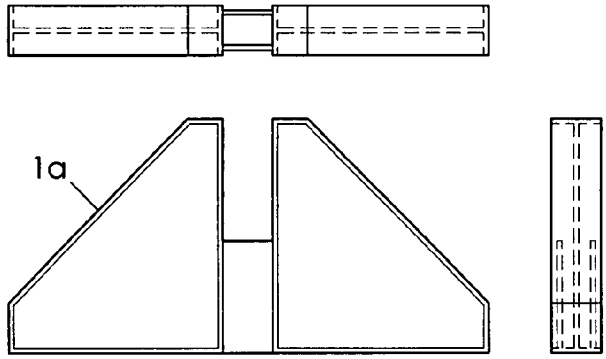
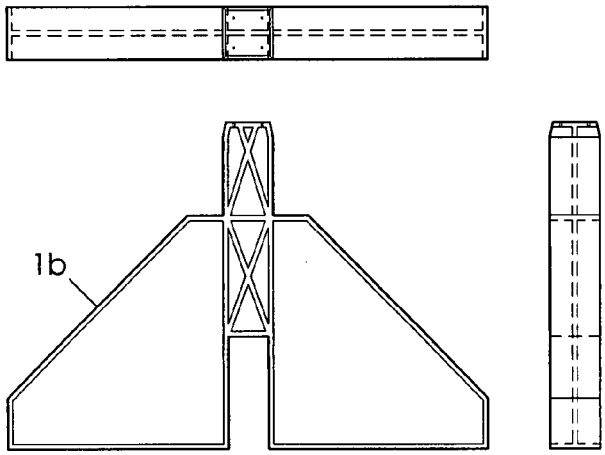
FIG. 18

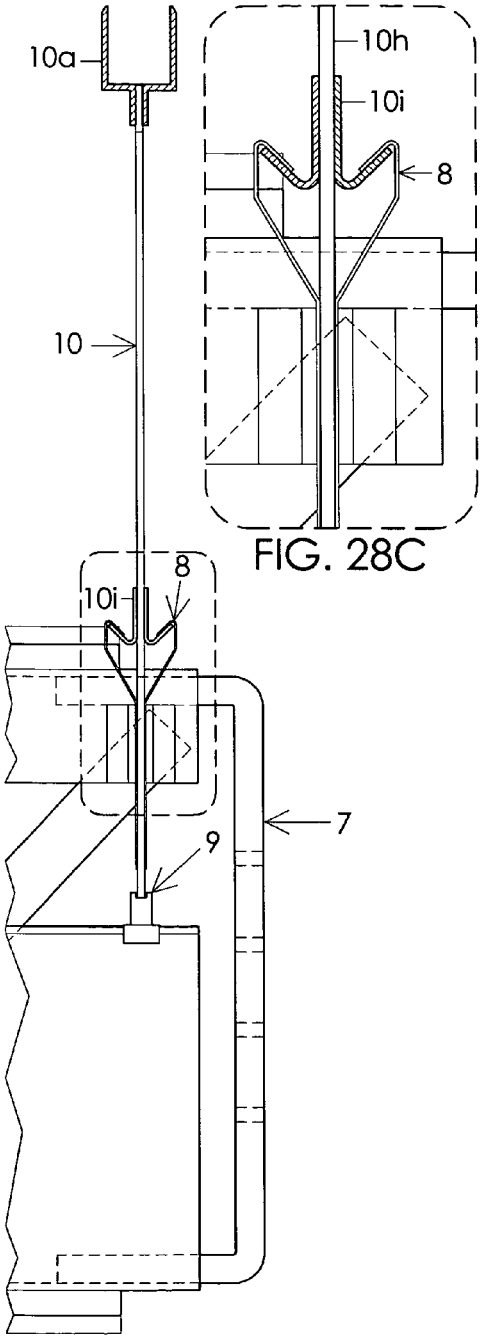
FIG. 28C
FIG. 28A
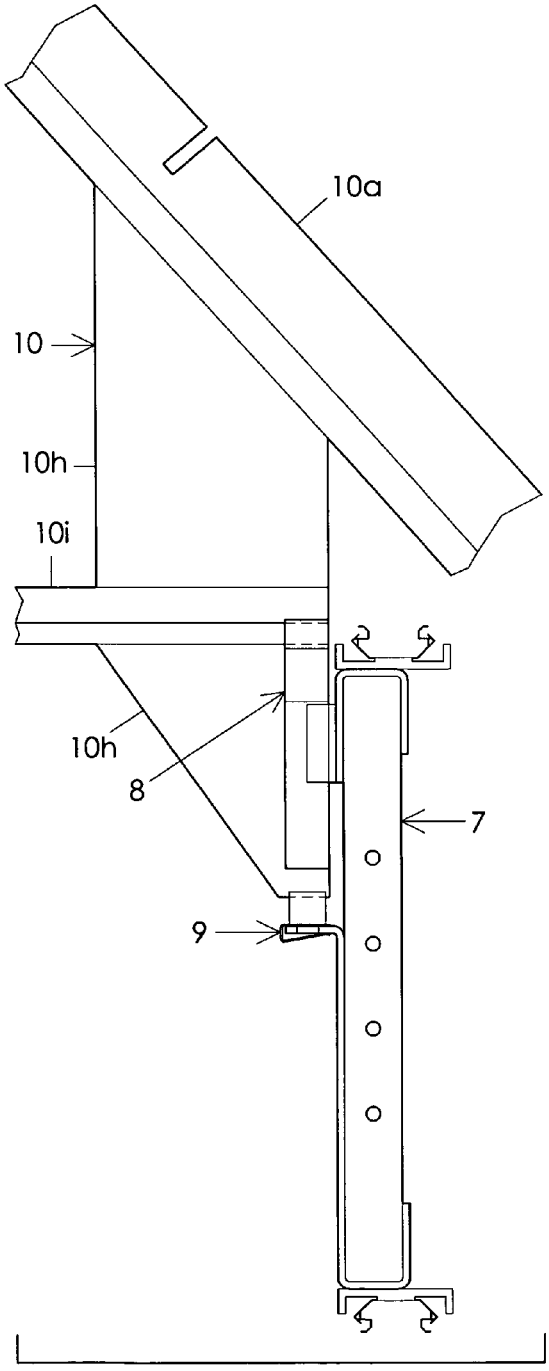
FIG. 28B

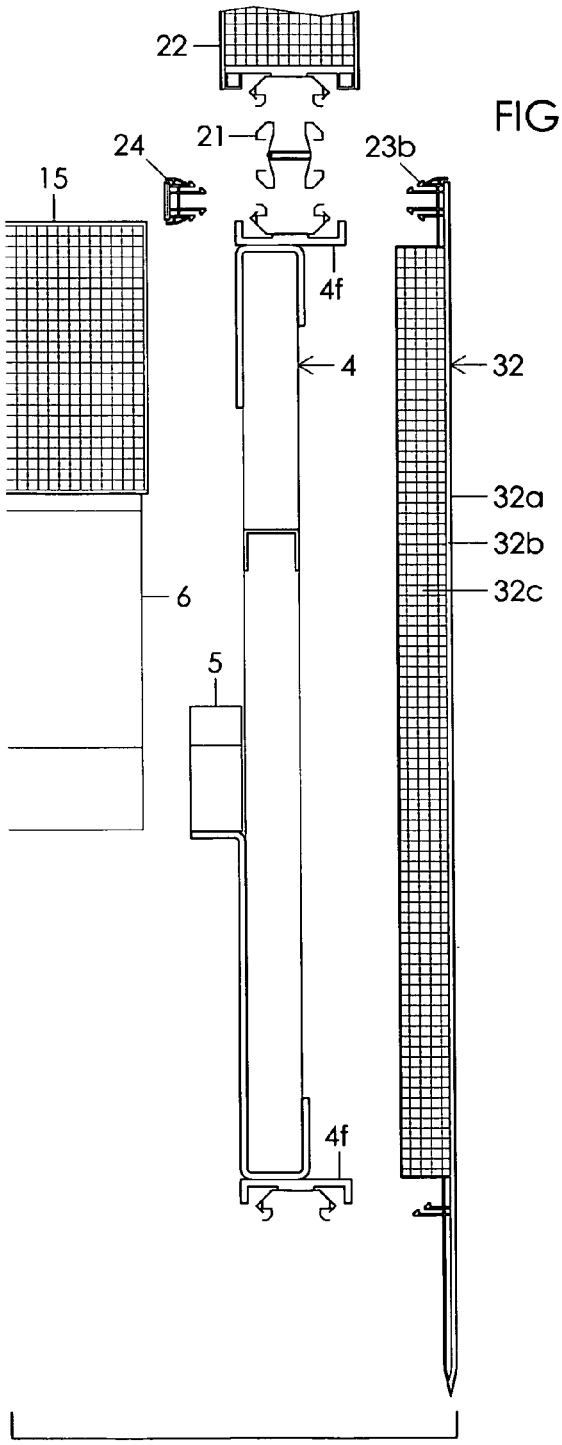
FIG. 46A
FIG. 46B
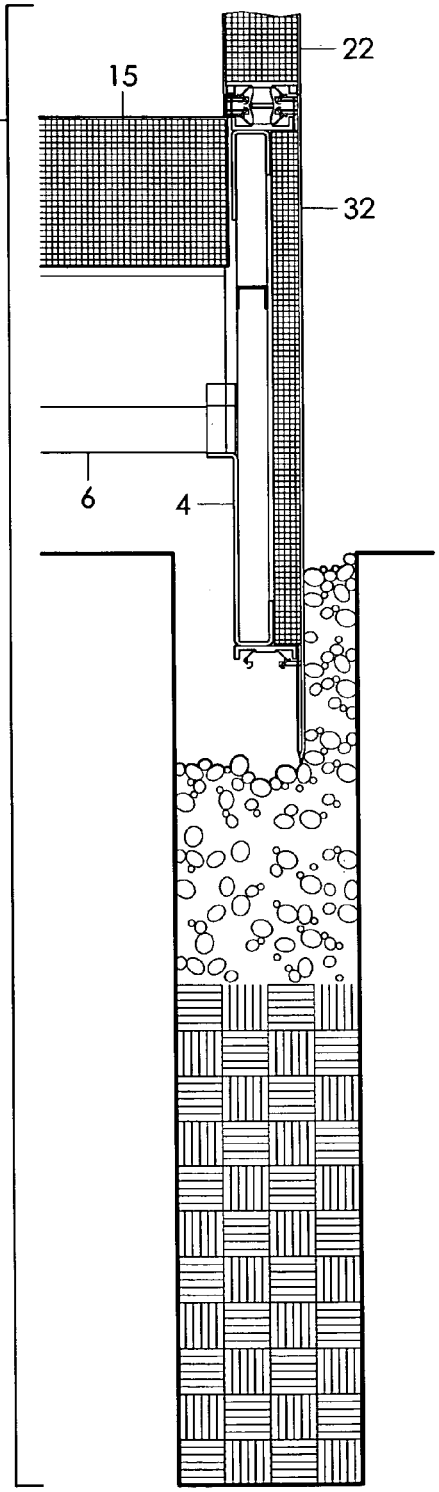

FIG. 49B
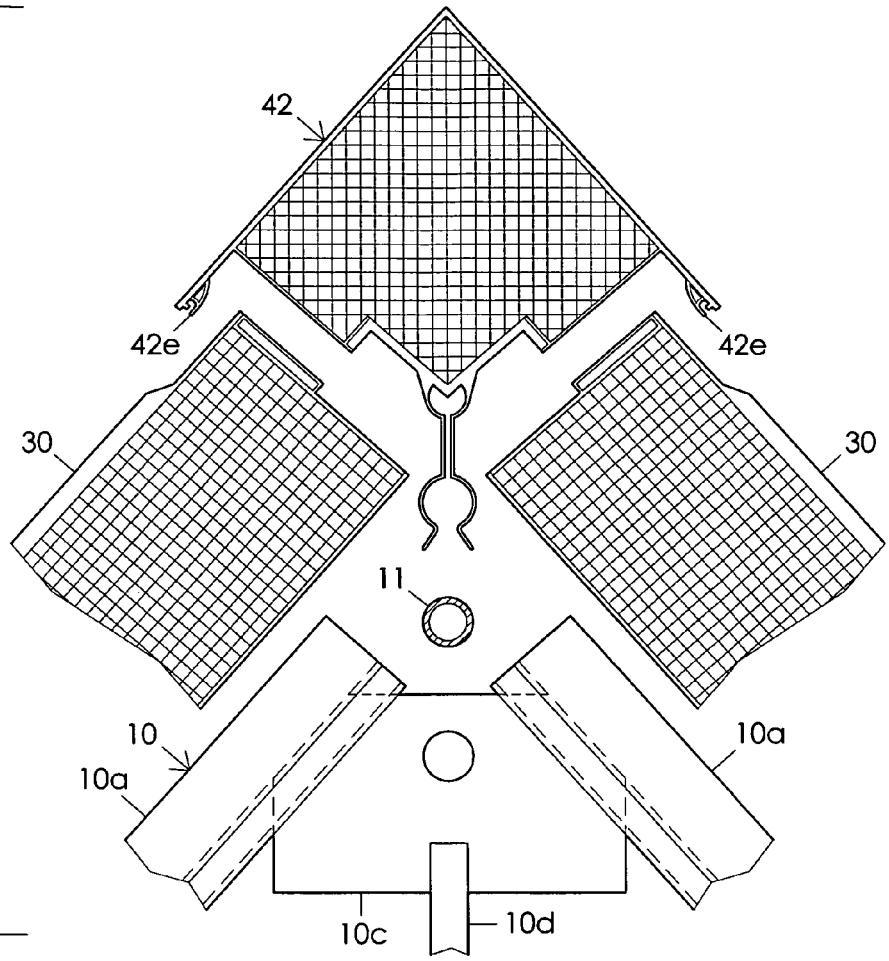
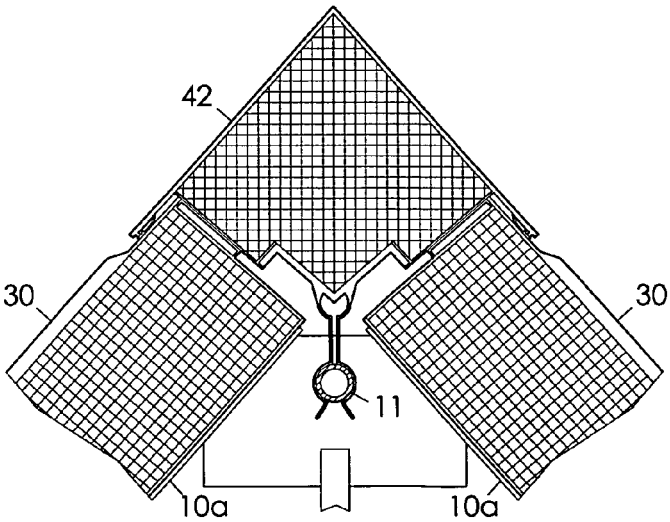
FIG. 49C

LOQ-KIT BUILDING COMPONENT SYSTEM

CROSS REFERENCE TO RELATED APPLICATIONS

This application claims the benefit of Provisional Patent Application U.S. 60/758,746 filed Jan. 12, 2006.

FIELD OF INVENTION

This invention is an industrialized housing strategy for single family, and multi-family housing applications. The invention comprises both a method (or process) for regulating building components, as well as the unique characteristics of the components themselves.

SUMMARY OF INVENTION

This invention introduces a system of mass-produced and interrelated building components that permit the assembly of an unprecedented number of final configurations. This specification describes a new, interchangeable building component system for single and multi-family housing applications. The mass-produced component system introduces a viable strategy for constructing affordable, durable, and beautiful homes—each unique in appearance and layout. The Loq·kit component system utilizes a novel methodology for regulating component dimensions and instructing their assembly and position within the whole. The system introduces new technology and materials. It does not employ wood, nails, or screws—it is dramatically new.

What is Loq·kit?

Loq·kit is both the brand name of the new components, and the name of the company that owns the intellectual property. The word Loq·kit herein, represents both the brand and company.

BACKGROUND OF INVENTION

Mass-Produced Housing—A Paradox?

The concept of industrializing the home construction industry is not new. The efficiencies inherent with mass-production offer enormous promise for reducing housing costs—and have been implemented by home manufacturers in many ways since the early 1900s. The great architect and founder of the Bauhaus, Walter Gropius, called for the industrialization of housing as far back as 1910. Notably, this was before Henry Ford's perfection of the assembly line in 1913. While throughout the early part of the $20^{th}$ century, many leading architects and businessmen attempted to bring high-quality, modem, and affordable dwellings to the masses through innovation in a new industrial age—most had little-to-no effect on accepted home building methodology or practice. A few history-making examples are Walter Gropius and Adolf Meyers' Building Blocks standardized housing system of 1923, R. Buckminster Fuller's Dymaxion House of 1927, Konrad Wachsmann and Walter Gropius' Prefabricated Building system for General Panel Corporation, 1942, and the Lustron Corporation's 2,498 porcelain enameled steel houses dating from 1948 to 1950.

Each of the above examples brought ingenuity and technology appropriate to mass-production at some level, yet each failed to take a lasting hold on the housing industry.

In recent years, the term mass-customization has entered the lexicon of architects concerned with industrializing (more-or-less) housing. Today, state-of-the-art industrialized housing strategies are wood-frame-based operations. These are modular, factory-assembled houses that rely on a factory controlled environment and other factory efficiencies to provide cost savings.

Industrialization has yet been achieved—however, variation in design, as a favorable quality of any dwelling has been recognized throughout the industry. Sameness in appearance or layout is not valued by consumers when housing is concerned. Because a house is an expression of the homeowner's individuality, uniqueness in design is favored over sameness—and so introduces a paradox for mass-produced housing: mass-production favors sameness in design, while home buyers desire uniqueness. To this date, a housing strategy that combines the cost-saving efficiencies of mass-production with the flexibility in design demanded by consumers has yet been realized. The Loq·kit component system aims to be the first—thereby, being the first truly viable strategy for mass-producing homes.

To this end, the Loq·kit component system will offer many advantages and features that are currently unavailable within the housing industry. Of these advantages, affordability is the system's foremost goal. In order to achieve this goal, the Loq·kit building components will be reviving an abandoned methodology once at use within the home building industry. This lost paradigm is that of assembly. At this point, it is important to make this distinction: this invention is not a "pre-fab" or prefabricated housing solution, nor is it a "modular" housing solution. Each of which are wood-based technologies rooted in construction—yet are popular "affordable" home-building technologies employed today.

To illustrate the concept of assembly, the Lustron Corporation and its brief history is introduced in the following paragraph. The company's methodology for producing house components can effectively illustrate the paradigm of Assembly and help exemplify Loq·kit technology.

The Lustron Corporation was founded in 1946, and implemented our nation's most successful attempt at bringing the housing strategy of assembly to the mass-market before closing its doors in 1950. In a few short years the company produced and assembled 2,498 steel-framed houses. Following World War II, the Lustron Corporation sought to tackle the nation's housing shortage problem by mass-producing houses. Similar to the manner in which automobiles or airplanes where built in factories during the war, Lustron produced building components that could be assembled easily into several home models. Just as in other industries of mass-production, the building components were produced in the final form needed for the correct assembly of the product. Components needed no further modification after production. In this way, building components would be mass-produced, and houses were erected quickly and efficiently, whether on-site or in a factory. This one-time production of components characterizes the paradigm of assembly that underlies the development of Loq·kit's component system.

In contrast, the current home building industry remains rooted in the paradigm of construction. Historically, houses have been built by craftspeople. Their process is one of modifying building materials in raw form in order to fit into a desired assembly. This work is performed by a skilled laborer (carpenter) and is time consuming, if not expensive. The process of modifying, or customizing, a building material that has already been produced is a second fabrication of the component. Wood-based home construction technologies are rampant with this double fabrication. A doubling up of component fabrication occurs each time a wood stud or sheet of plywood (already produced in a final form) is modified from its original dimensions. Current cost-saving home building strategies such as "pre-fab" or "modular" housing utilize this technology—although performed in a factory. Consequently, construction technologies forfeit the efficiencies of true mass-production.

Construction however, is an art able to produce uniqueness in design, while assembly tends to produce sameness (the Lustron Corporation offered only three distinct mass-produced home models). As stated earlier, our homes are an expression of our own individuality as well as our shelter, and uniqueness in design is valued greatly by homeowners. This may be the single greatest reason that a successful assembly-based strategy has not made significant impact on the home building industry to date.

Loq·kit's building component system in contrast, capitalizes on the efficiencies and cost-savings of assembly (through mass-component-production) and also allows uniqueness in design, as components can be arranged into many configurations. The Loq·kit building components will introduce a mass-produced system of house parts that may be assembled into a vastly unprecedented number of desired interior layouts and exterior designs—with each design being a unique arrangement of parts selected by the homeowner. Furthermore, Loq·kit's house components will be easily installed, and interchangeable between houses. They will allow arrangement into a near infinite number of final configurations and can be reused again and again. They will incorporate new technology, such as solar power generation, and can be shipped to a world market. Loq·kit's component system is unlike any home building technology currently in use—and is vastly different from technologies of the past.

So What?—The Power of the Prototype

A successful industrialized housing strategy would have enormous potential for influencing change within the housing industry. Such a strategy would introduce a workable prototype—a building methodology suitable for evolution through years of refinement. The Loq·kit Component System was developed according to the belief that a successful industrialized housing strategy (the prototype) is not the creation of a single building, but the creation of a system for producing housing individuality at an affordable price. It is anticipated, that a system such as this, would fill a need in the housing market where there is currently not a product offered. High-quality, unique, and affordable houses—that incorporate new technology (and are a product of new technology as well)—could flourish, giving new meaning to the low end of the housing market. With a successful industrialized housing strategy representing a large portion of new single-family housing starts nationwide, or worldwide, it would take on the power to dictate standardization of product to manufacturers who wish to compete in the new arena. This is the prototype's hidden power. Private industry invests very little effort in realizing creative and affordable home options for consumers because the marketplace is largely unestablished. By opening up the market with a successful industrialized housing prototype, it would be revealed to private industry that money could be made through participation. Unrelated product manufacturers would find incentive for standardization according to the dictates of the new industry. A successful prototype for housing could unify currently unrelated interests within the industry toward a common goal and achieve housing affordability and flexibility, and make a profit as well.

INTRODUCTION TO INVENTION

Overview

Briefly, a Loq·kit house is assembled by erecting a sequence-defined metal frame into which a variety of sequence-defined in-fill panels are placed—and over which all exposed structure and connections are concealed with various sequence-defined plastic coverings. These three steps in the assembly of a Loq·kit house characterize each of three unique sub-systems. The three sub-systems make up a typical Loq·kit house and together, along with their method of standardization, describe the extent of invention.

Three Sub-Systems

The three sub-systems mentioned previously are:

sequence-defined structure—The Loq·kit component system utilizes post-and-beam building technology. With this type of assembly, posts (columns) support beams, which in turn support walls, floors, and roof structure. In that sense it is not new. Yet, the Loq·kit post-and-beam structure is an alternating-sequence defined, metal frame system. It is the manner in which the frame interacts with, and is defined by the alternating sequence of a 3D grid, that produces a standardized building structure well-suited for mass-production—while allowing for unprecedented mass-customization. The Loq·kit modular grid regulates component dimensions and connection locations by incorporating an alternating sequence (A,B,A,B rhythm). The alternating sequence dictates connection size and possible locations in three dimensions. It is that feature of this invention that accounts for unprecedented flexibility in house design and layout. It will be presented in detail further on in this specification.

sequence-defined in-fill—The in-fill components of a Loq·kit house create the building enclosure and provide protection from the elements. Loq·kit in-fill components are "panels" and serve any of the following functions: roof, wall, floor, stair, door, or window. Each of these "panels" is regulated dimensionally by the Loq·kit conceptual grid's alternating sequence. A common dimensionality is shared with building structure, enabling in-fill components to be placed in a near-limitless variety of arrangements. In-fill components in general, may be easily detached from their assembly and placed into new or different configurations—as in-fill components are fabricated with snap-lock interfaces.

sequence-defined snap cladding—These building components conceal and weather-proof exposed structure and the joints between in-fill components. Generally, they are plastic extrusions, each with a unique profile for its application. The plastic extrusions snap into place over metal structural components or in-fill joints via. snap-lock interfaces, completing the weather-proof assembly.

New Concepts

This application introduces new concepts to the housing industry. These concepts will be identifiable in the text by italicized words. The following concepts are presented here as a brief introduction to Loq·kit's new technology. These concepts will be described in further detail in this specification:

assembly—The process of joining building components without altering their physical structure. Because external fasteners such as nails, screws, and glue often damage building components during their installation, idealized assembly components are manufactured with their connection hardware integrated with their physical structure. The design of the components is highly technical, so that their assembly can be performed by persons of modest skill.

construction—The process of modifying building components as they are joined together during the erection of a building. Less efficient than assembly, this process commonly utilizes double fabrication, external fasteners, and ambiguous connection conditions. Construction components are produced in a raw or unrefined state, and their connection must be performed by persons with a high level of technical skill.

double fabrication—The act of modifying a construction material to create a desired fit with other components in a building. Because construction materials are initially fabricated by their manufacturer, any further modification on site, or in a controlled factory environment, constitutes a second, custom fabrication of the material. Simply cutting a wall stud to a desired length other than its manufactured length is a second, or double fabrication of the material. Double fabrication demands additional installation time, produces waste, and requires skilled labor.

multifunctional form—The shape of a building component having physical characteristics that allow a range of assembly variations, without modification of its original form. Multifunctional form produces variety in final configuration, while limiting component quantity. It is a strategy for achieving more options with fewer parts.

alternating sequence or alternating modular sequence—An A,B,A,B rhythm applied to a regulating grid used for design and planning purposes. The alternating sequence establishes a common component connection width, B, and possible distances between connections, A, 2A+B, 3A+2B, etc. The alternating sequence regulates the separation of B modules by a common module A, and when applied to three-dimensions, functions to establish a lattice, or framework, of possible connection locations in space.

sequence-defined structure—The load-bearing components of a building structure, having physical sizes that are a function of the alternating sequence's A,B,A,B rhythm.

structural-integrated header—A feature of a load-bearing structural frame member that spans between columns and over a window, or series of windows, immediately below. The structural frame member, and incorporated structural-integrated header, supports floor loads between columns while also supporting the weight of the exterior wall above the windows. Due to the integrated header, a near limitless variety in number and configuration of windows may be placed within a facade, without regard for the structural needs imposed by the openings.

sequence-defined in-fill—The non-load-bearing components of a building system that are placed within the openings between structural frame members. These components have physical sizes that are a function of the alternating sequence's A,B,A,B rhythm.

free-facade zone—The sequence-defined in-fill areas of a building's facade. A free-facade zone is located along the length of an exterior wall between two columns, and between a lower and upper frame member.

6-way connector—A device used for making snap-lock connections between building components. The 6-way connector enables various in-fill components to be joined within an assembly by applying pressure to the component in one of six directions: up, down, left, right, front, or back. The connector also enables components to be disassembled.

extruded panel end or top/bottom extrusion—The receiving mechanism integrated within the physical shape of a component that enables its connection within an assembly via a 6-way connector. The extrusion functions as a channel into which a 6-way connector is pressed.

snap-clad structure or snap cladding or sequence-defined snap cladding—The protective coverings that are snapped into place over load-bearing structure (in-fill is snapped into place between structure). These components have physical sizes that are a function of the alternating sequence's A,B,A,B rhythm.

snap-lock interfaces—Commonly called snap-together, or friction-fit, this type of component connection is produced when applied pressure activates a predetermined, static relationship between pliable components. Because the components deform temporarily before regaining their original shape, the installation process does not scar or alter them. Various techniques can be employed to extract, or disassemble them. The physical shape of the building component is the mechanism that provides the gripping force that locks the component into an assembly.

valance panel—A protective covering placed over horizontal structural frame members.

frost edge—A projecting blade incorporated into the bottom of a valance panel. A frost edge protects a structural frame from damaging uplift ground forces, keeps unwanted pests from nesting under the building while mitigating component damage from cold climate frost-heaving.

trench footing—A device used to spread building loads to bearing soils, while providing protection against cold-climate frost damage. A frost footing requires limited site excavation and provides a stable base onto which structure may be placed during a building's assembly.

joist clip—A mechanism located on a structural frame's bearing flange that receives the bearing ends of a floor joist into a snap-lock connection with building structure. It enables a floor joist to be installed quickly and without tools, into a secure—yet reversible—connection with a building's structure.

truss guide or clip—A mechanism located on a structural frame's bearing flange that receives the bearing end of a roof truss into a snap-lock connection with building structure. It enables a roof truss to be installed quickly and without tools, into a secure—yet reversible—connection with a building's structure.

truss seat—A mechanism placed between the bearing point of a roof truss end and a bearing flange on which it sits. A truss seat functions to make a snug and secure fit between roof truss and structure by filling the gap between them. Its placement between components tightens the connection, while its removal loosens a connection—enabling roof trusses to be easily removed from a building assembly.

Variation

FIG. 1 illustrates the variation in final configuration (multiple embodiments) achievable with the component system. The drawing will serve as a brief orientation to the component system and its possible arrangements.

FIG. 1 shows four houses able to be constructed with the component system. Each house is presented in one of four horizontal rows on the page. To the left in each row is the main level floor plan for each two-level house. The main level plans are followed in the same horizontal row by a front and side elevation respectively. The four houses are each assembled from Loq·kit's standardized mass-produced building components, and yet are unique in interior layout and exterior design. The building components used in the assembly of the houses are standardized, or regulated, by an alternating modular sequence. The alternating-sequence controls component dimensions and connection locations, and is represented by tick marks along two sides of the individual drawings in FIG. 1. The alternating-sequence enables the building components to be assembled in a near limitless variety of final configurations. It is anticipated that the standardized building components will be made widely available to consumers, allowing homeowners to purchase a unique and beautiful home at a price much lower than allowed by conventional home-building technologies.

Enabling Mass-Customization—Affordable, Interchangeable, Reusable Parts

Because the houses illustrated in FIG. 1 share many of the same standardized parts, building components are interchangeable between houses. This is made possible by snap-lock connections between parts. With localized pressure placed on components, the parts can be easily assembled and taken apart. This connection methodology allows building component reuse—therefore, contrasting sharply with conventional home construction technologies.

Loq·kit's modular components are interchangeable and can be assembled into a variety of housing applications without modification. Typically component modification, or "second fabrication" takes place on many construction sites as materials shipped to the site in raw form are altered by skilled laborers in order to fit into a custom condition necessitated by individual home designs. For example, a typical 4'×8' sheet of plywood is produced in a factory, shipped to a job site and modified by carpenters (double-fabrication), where a portion is installed—while another portion is relegated to waste.

Additionally, with conventional systems, houses are assembled from a largely unrelated array of materials. Extraneous fasteners such as nails, screws, and glue, are used to connect the building components, and in many cases scar or alter the components during assembly. The connection methods are time-consuming and do not incorporate a methodology for easy separation of the components. The result is a construction process from which homes are created, yet materials are not economically viable for reuse. In many cases it is less expensive to purchase materials from a lumber yard than to retrieve those same materials from a vacant building. When the reuse of building components is not economically sustainable it rarely happens within the industry. Valuable resources are then lost in land-fills across the country.

Loq·kit's building components, however, have been designed to interface with each other in a predetermined way that eliminates external fasteners and ambiguous connection conditions. As mentioned previously, Loq·kit components are regulated dimensionally and are assembled according to predetermined connection conditions. Therefore, each component is manufactured at the factory with the necessary interface condition required for its on-site installation. The Loq·kit steel frame is assembled with a series of bolted connections. Otherwise all other interface conditions and locations (in-fill and snap cladding) are known at the time of component selection, as each component's connection method is integrated into its design. Thus, highly-skilled laborers are not needed to assemble the components because connection ambiguity and complexity has been removed by the simplified interfaces of the components. Accordingly, additional fasteners such as nails, screws, and glue are unnecessary within the system. In order to reduce connection complexity, and therefore reduce assembly time, a very simple connection methodology is integrated into each of the Loq·kit in-fill and snap cladding components—that connection strategy is the utilization of snap-lock component connections.

Loq·kit building components, excluding the steel frame, snap together. A snap-together building component connection methodology benefits an affordable housing strategy in several key ways. A snap-together connection reduces assembly time by providing a shop-ready condition. The snap components need no modification at the building site, and can be assembled rapidly by workers. Labor costs are reduced by assembly efficiency and reduced on-site connection complexity. Furthermore, because the final connection between components has been predetermined, one correct interface is possible and interface mistakes can be reduced. This allows for increased quality control, as all connections meet a preset standard.

The true merit of a snap-together component strategy, as it is applied to the overall goal of providing affordable and highly personalized homes, involves component interchangeability and reuse. When a component is snapped into place, it is possible to reverse the assembly process—and components can be unsnapped. The removal of a component from a building assembly without damage to either the component or building system, offers a flexibility and economy that has yet to be introduced within the building industry. Quality, used interchangeable building components that can be easily installed by a homeowner (rather than hiring a laborer), provide an important avenue for cost-savings when increased affordability is a primary concern.

Because Loq·kit components can be separated easily and without damage, the house parts, although used, remain valuable as home-building materials. The used components are then available for relocation on the same house, or a neighbor's home. Additionally, because the house parts are modular (a word that will be qualified later in this specification) and easy to assemble and release, homeowners can personalize their spaces. This may be the seasonal replacement of south-facing summer-time opaque wall panels with winter-time window panels (in the Northern Hemisphere), as a passive solar heating strategy—or a more long-term adjustment to one's home, such as a home office addition for a self-employed family member. Whatever the use may be, Loq·kit's interchangeable components will present homeowners with an option for realizing additional savings through the purchase of used house parts.

Lastly, to protect the security of each home, the snap-lock assembly process allows for the removal of building components only from the inside of the home.

A Final Configuration and its Parts

FIGS. 3 and 4 (with FIGS. 2A and 2B to show cross-section cut orientation) provide a first impression of the component system and its interaction when applied to a specific final configuration. The drawings serve mainly to characterize Loq·kit's vast departure from conventional construction techniques—both at use now, and in the past. The house illustrated in the bottom row of FIG. 1 is shown in section in FIG. 3. For reference, the house plan and elevation drawings from FIG. 1 appear above FIG. 3, at the top of the page as FIG. 2A. A box drawn around the front elevation provides an indication of the direction through which the section-cut illustrated in FIG. 3 is made. The building section identifies the individual components that will be described in detail further on in this application. FIG. 4 illustrates another cross-section of the same house. The box enclosing the side elevation drawing in FIG. 2B serves to highlight the orientation of the section-cut. The components that will be described in detail in this application are also identified in FIG. 4. Together, FIGS. 3 and 4 provide an early glance at the component system—as applied to one of many preferred embodiments.

Loq·kit Goals

The Loq·kit building components have been developed in response to a series of goals. In order to aid the understanding of key concepts and the design resolutions that follow, the goals are provided as follows:

To provide a more affordable construction methodology than any which is currently available.

Create a widely available, limited component catalog from which a limitless number of unique configurations may be achieved. The components will allow and facilitate the ability to personalize one's own space, and achieve a unique final configuration in the assembly of one's home.

Utilize mass production and industry-based technologies rather than the crafts-based technologies that are currently in use within the house building industry.

Allow for beauty in the assembly of the new homes.

Ensure that building components are interchangeable and easily assembled.

Allow for the reuse of all components without damage to the component during assembly or separation.

Ensure that the new homes are safe and durable structures.

Modular Construction and the State of the Art

The Loq·kit Building Component System is a modular construction technology. In order to establish a benchmark for further description of Loq·kit's modular technology, it is important to separate this new approach from conventional meaning within the building industry. Currently, "modular home" is the term used to describe a structure that is factory-built in "modules" which are transported to the site and installed. The modules are independently constructed units that are assembled to make a whole. The number, size and shape of the modules varies depending on the individual design of the home. This is the prevailing type of technology that is characterized by the word modular in today's construction industry. FIG. 5 illustrates typical, or conventional, modular technology. The drawing shows a bedroom module A that is constructed in a factory environment with other house modules—a closet module I, a main living area module H, etc. The modules are individually constructed and shipped to a site to a wait assembly. This type of modular construction tends to be a wood-based construction technology very similar to that used for erecting site-built houses. It benefits mainly from the cost-savings afforded by a controlled factory work environment. This wood-based modular construction does not engage the large economies of scale associated with industrial manufacturing practices and mass-production. Therefore, it is a weak avenue for pursuing a truly affordable housing prototype.

Loq·kit's modular technology however, is one that is based not on independent modules, or pods, but is derived from standardized units of measurement. In this way, the word modular connotes the use of moduli, or units of measure, in regulating an architectural composition. This type of technology has been employed throughout history and can be represented by building plans that are either laid out over a graph, or grid, or utilize repetitive units of measurement in the placement of a building's structure. FIG. 6 is an example of this second type of modular technology. Completed in 1950 by Frank Lloyd Wright, the drawing demonstrates the way in which structural efficiencies are obtained early-on in the building's design through the use of regular structural bays. When seeking fabrication and assembly efficiency during the construction process, a graph, or grid-like structural layout is a common and obvious means to an end for those in the design professions. Throughout the specification that follows, the word modular or conventional modular construction will be used to describe this second type of modular system—the use of repetitive units of measurement. The Loq·kit component system is such a modular technology. Yet, it is unique in the calculated use of regular system dimensions. The drawings and descriptions that follow will demonstrate Loq·kit's departure from the obvious in the use of a graph, or grid, as an ordering system. The end result will be the qualification of three unique characteristics of the Loq·kit grid that produce unprecedented component flexibility—leading to the realization of a system of mass-produced house parts from which many final configurations can be assembled from a limited array of components.

DRAWING FIGURES

In the drawings, closely related figures have the same number but different alphabetic suffixes.

FIG. 1 Is a diagram showing four possible final configurations, or embodiments, in plan and elevation view. Each building appears in a horizontal series of three drawings on the page—a floor plan followed by two exterior elevations. Each drawing is illustrated with the alternating sequence represented by tick marks at the drawing's side. The embodiment used to illustrate typical component connections in this specification appears in the bottom row on the page, with a box drawn around it.

FIG. 2A Is a diagram showing the embodiment used for example throughout the pages of this specification. It is the final configuration presented in the bottom row of FIG. 1, and is presented here as FIG. 2A to show the orientation of the building cross-section appealing in FIG. 3. The box drawn around the center illustration shows the cross-section orientation that appears in FIG. 3.

FIG. 2B Is the diagram presented in FIG. 2A which shows the example embodiment used to illustrate component interaction in this specification. The diagram appears with a box drawn around the elevation view to the right. This elevation view presents the reference direction through which the cross-section appearing in FIG. 4 is made.

FIG. 3 Shows a cross-section of the embodiment used for example in this specification. It is a cross-section of a completed component assembly, and is illustrated with the tick marks that represent the alternating sequence. The tick marks appear alongside the cross-section for reference.

FIG. 4 Shows another cross-section of the embodiment used for example in this specification. It is a cross-section of a completed component assembly, and is illustrated with tick marks that represent the alternating sequence. The tick marks appear alongside the cross-section for reference.

Figure 10A:
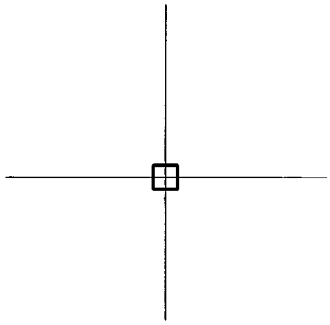
FIG. 10A PRIOR ART

FIG. 10A Plan-view diagram showing conventional column-on-gridline placement for laying out building columns (prior art).

Figure 10B:
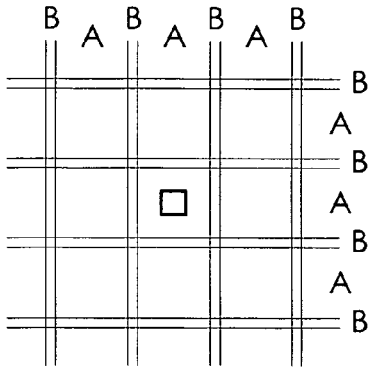

FIG. 10B Plan-view diagram showing Loq·kit column at mid-gridline placement.

Figure 11:
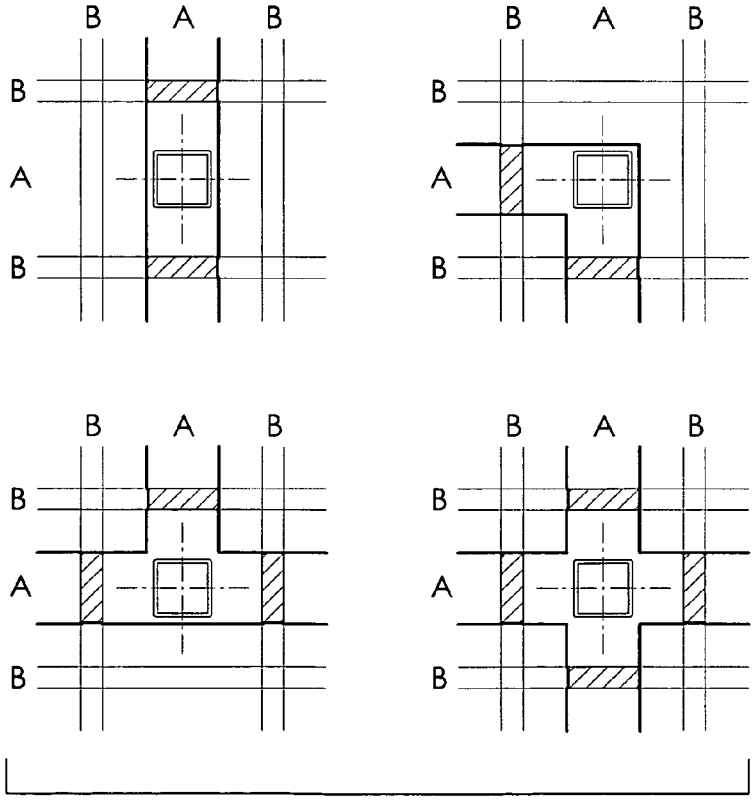

FIG. 11 Plan-view diagram showing four typical Loq·kit column-to-wall panel connection variations.

Figure 12A:
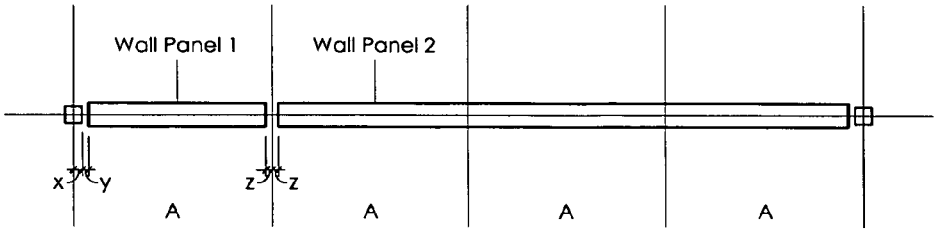
FIG. 12A PRIOR ART

FIG. 12A Plan-view diagram showing two column-to-wall panel connections and a wall panel-to-wall panel connection, and the impact of these connections on adjacent components when a conventional grid and conventional column-on-grid-line column placement is used (prior art).

Figure 12B:
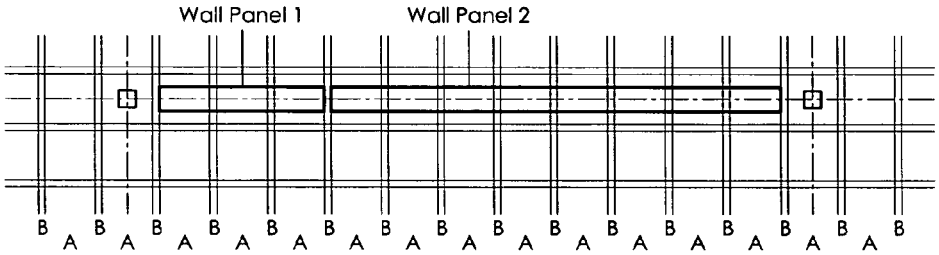

FIG. 12B Plan-view diagram showing two column-to-wall panel connections and a wall panel-to-wall panel connection, and the impact of these connections on adjacent components when the Loq·kit grid and Loq·kit mid-gridline column placement is used.

Figure 13A:
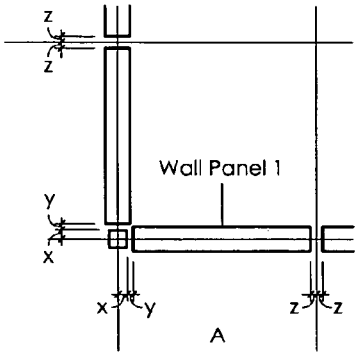
FIG. 13A PRIOR ART

FIG. 13A Plan-view diagram illustrating the conventional grid and conventional column-on-gridline placement, and their impact on component dimensions at corner column-to-wall panel connections (prior art).

Figure 13B:
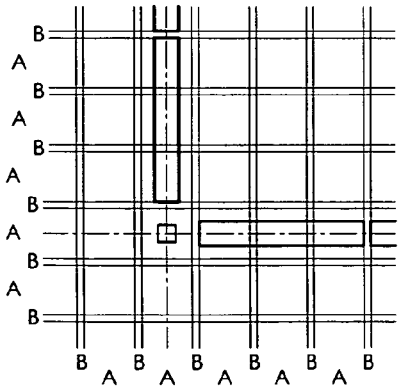

FIG. 13B Plan-view diagram illustrating the Loq·kit grid and Loq·kit mid-gridline column placement, and their impact on component dimensions at corner column-to-wall panel connections.

Figure 14:
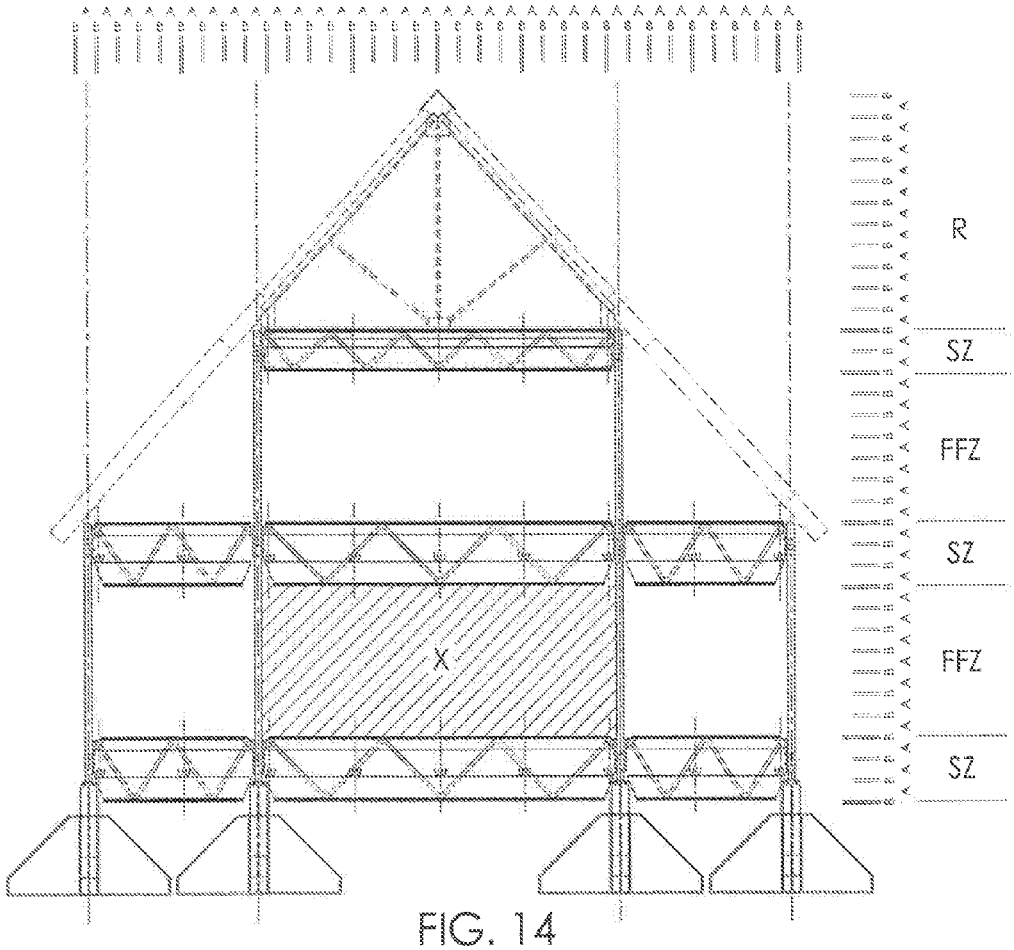

FIG. 14 Elevation drawing of example embodiment showing Loq·kit structural components with the alternating sequence placed alongside in two dimensions. The drawing shows the way the Loq·kit structural frame is divided functionally into zones whose dimensions have been determined as a function of the alternating sequence.

Figure 15:
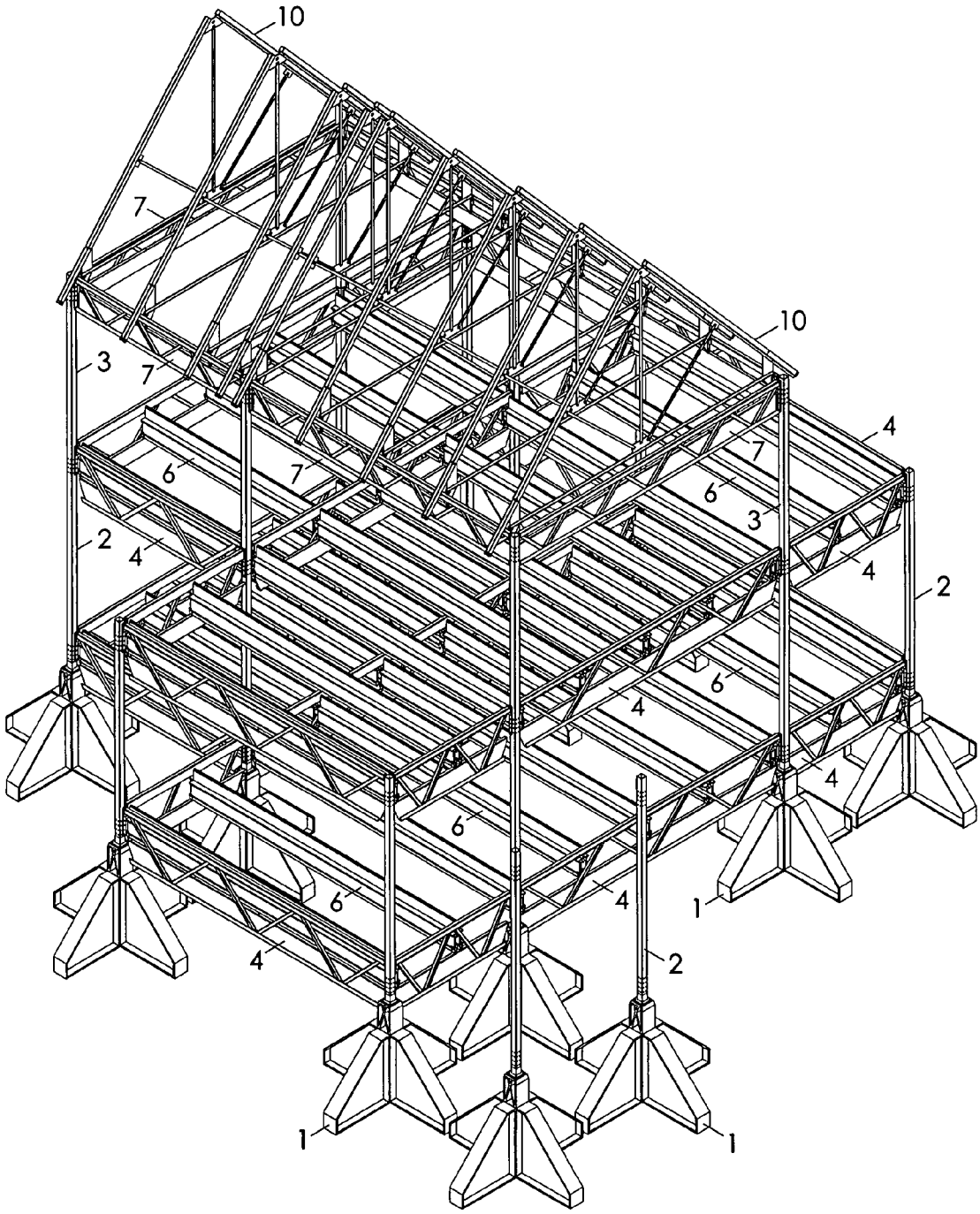

FIG. 15 Three-dimensional drawing of a Loq·kit structural frame assembled in the configuration illustrated in FIG. 14—the example embodiment.

FIG. 16 Three-dimensional drawing of a Loq·kit Trench footing assembly.

FIG. 17 Shows a Loq·kit Trench footing base in the three typical views of orthographic projection.

FIG. 18 Shows a Loq·kit Trench footing saddle in the three typical views of orthographic projection.

Figure 19:
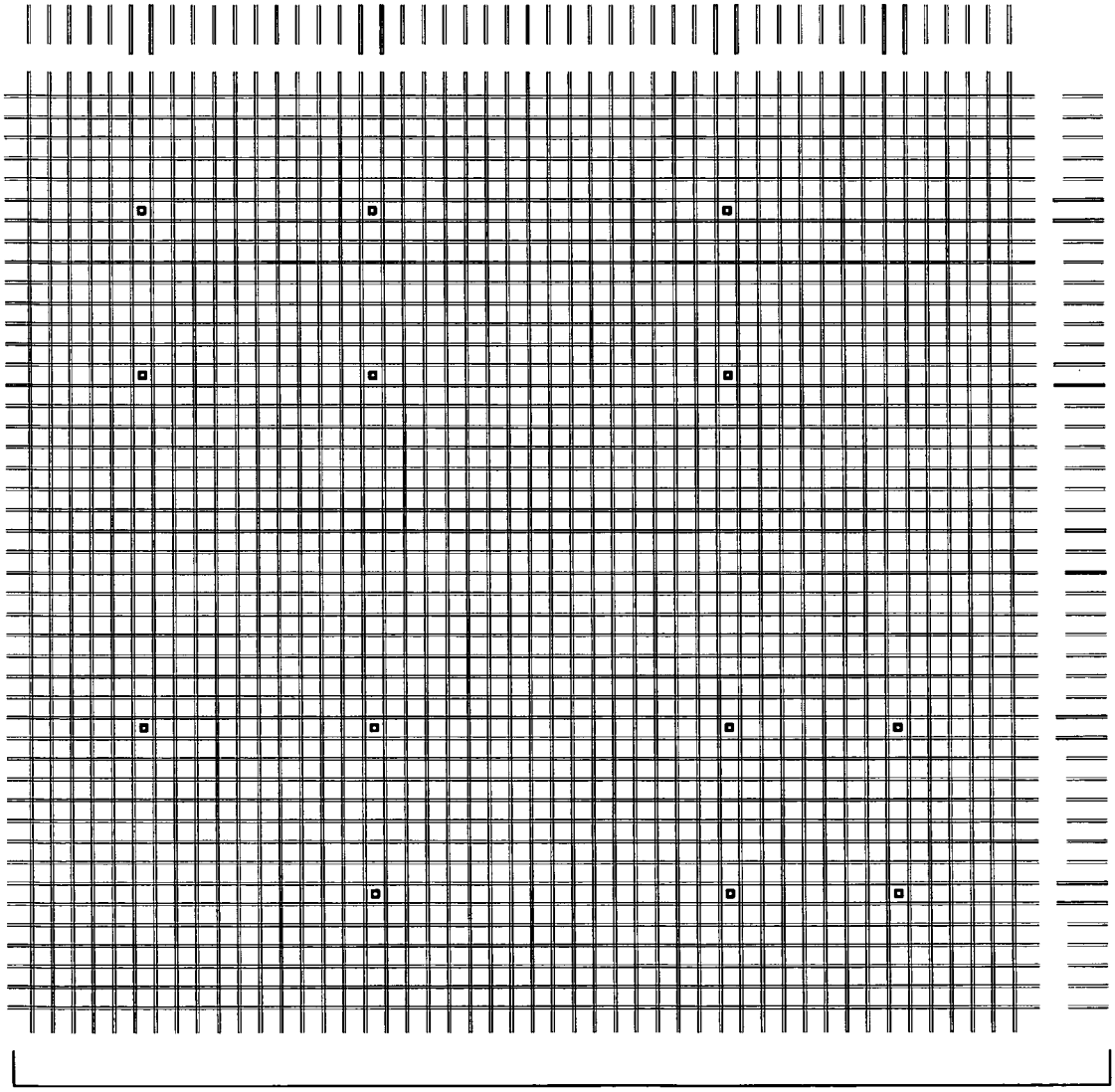

FIG. 19 Plan-view diagram showing the Loq·kit grid and the example embodiment's mid-gridline column layout.

Figure 20:
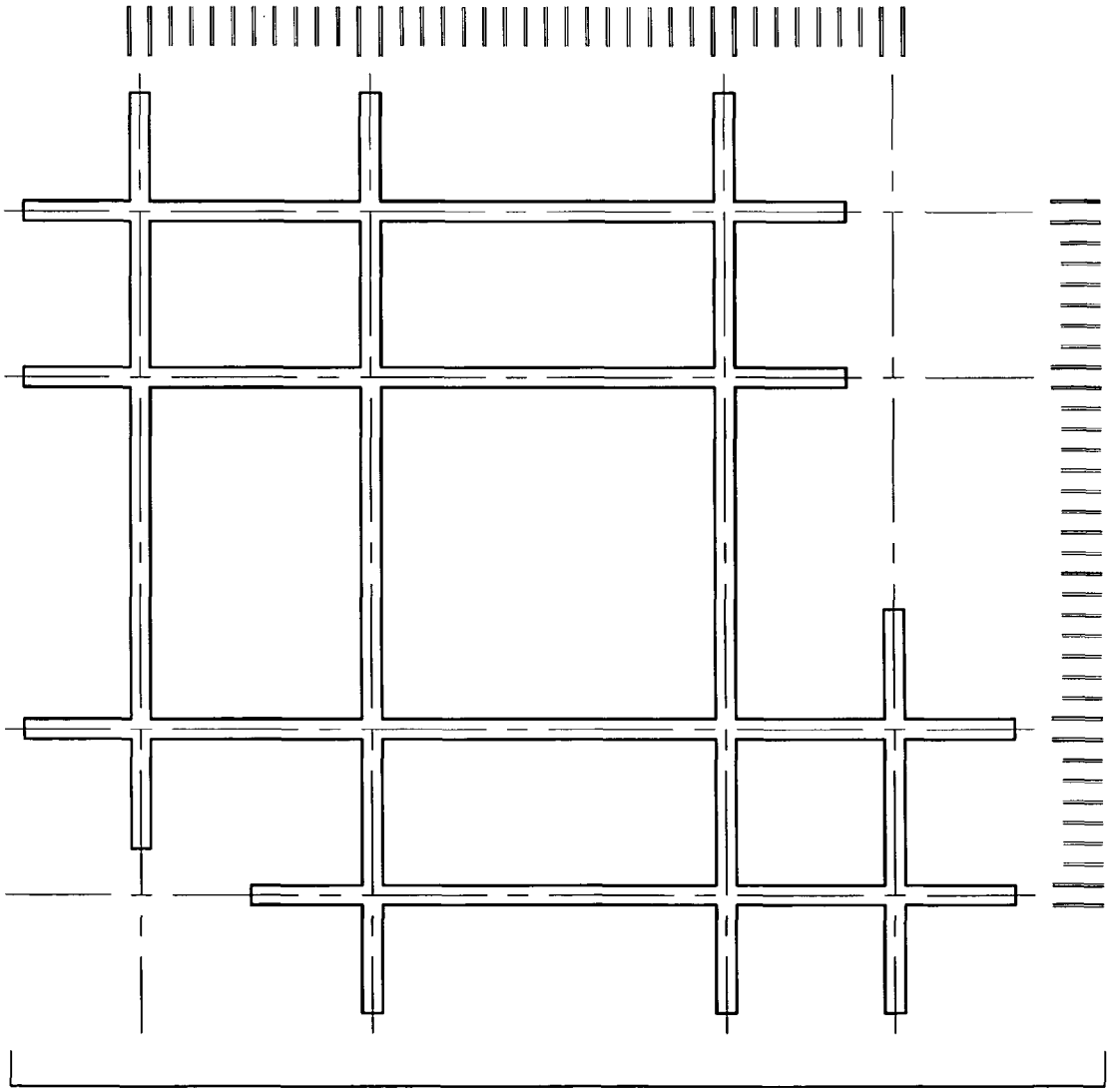

FIG. 20 Plan-view diagram showing site excavation (trench) layout for the example embodiment.

Figure 21:
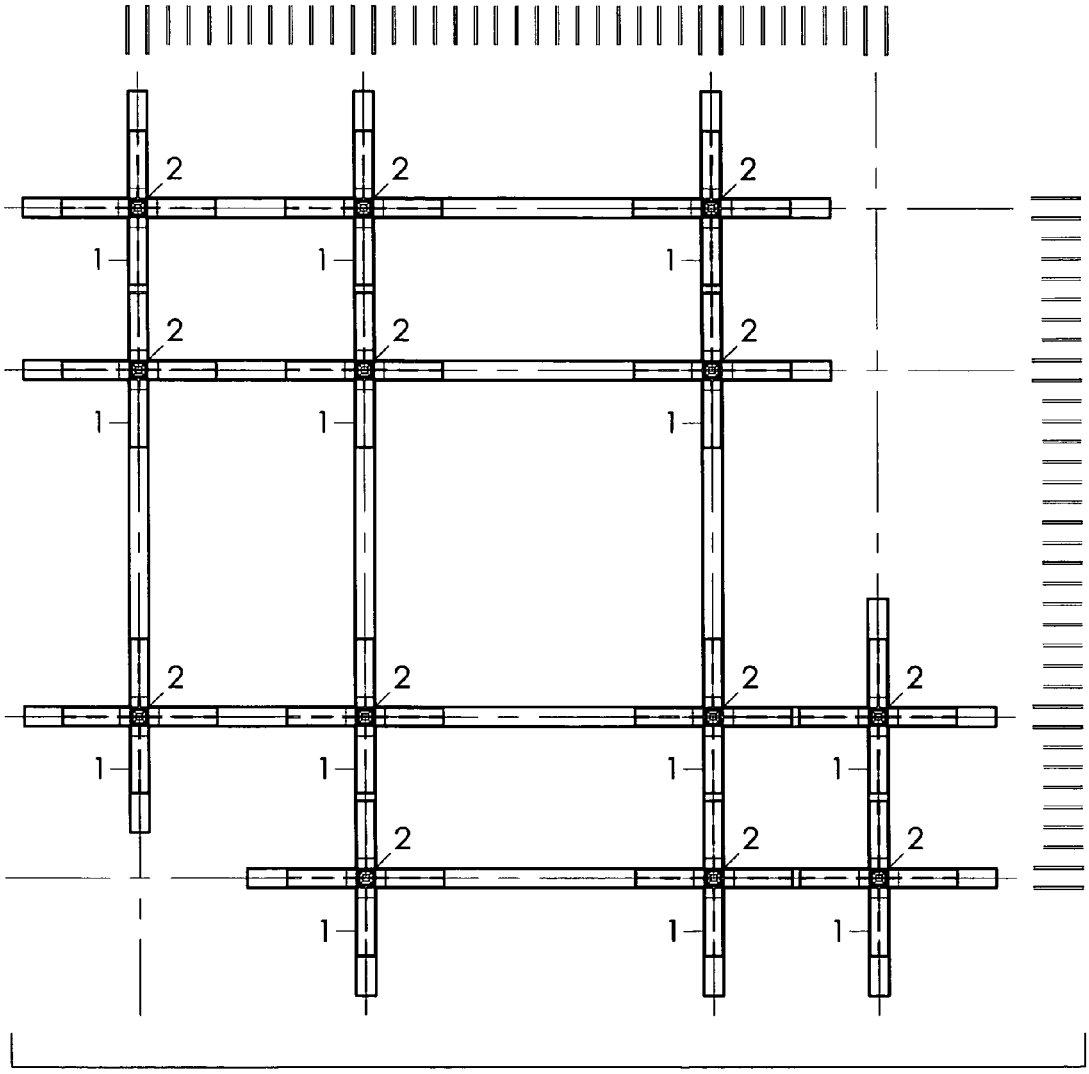

FIG. 21 Plan-view diagram showing trench layout, with trench footings and columns, for the example embodiment.

Figure 22:
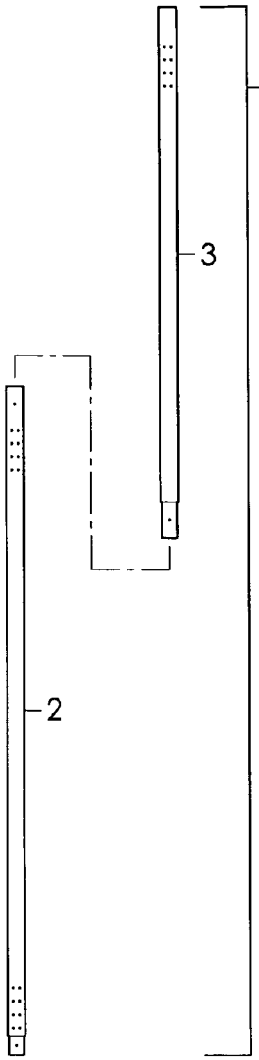

FIG. 22 Elevation-view of a typical Loq·kit lower and upper column, illustrating their stacking ability.

Figure 23A:
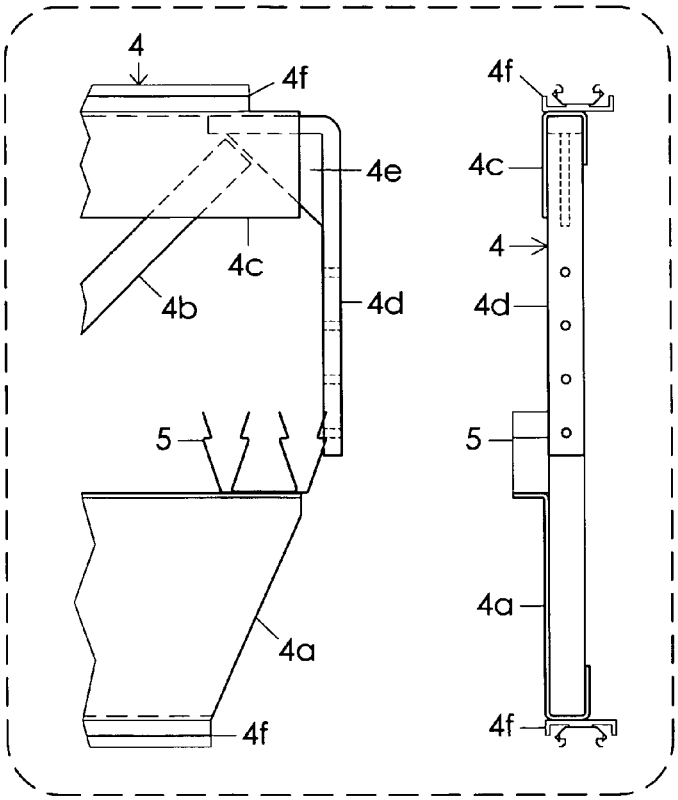
Figure 23:
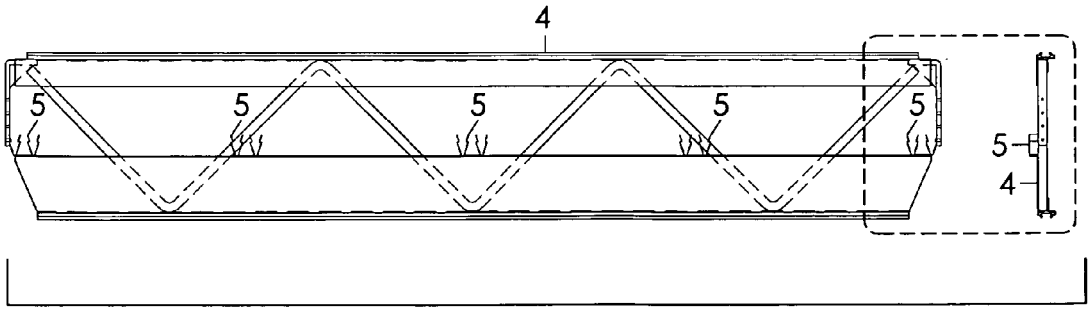

FIG. 23 Shows a side elevation-view and a front elevation-view of a Loq·kit floor frame.

FIG. 23A Shows the enlarged floor frame end front view and enlarged side view of the floor frame elevated in FIG. 23.

Figure 24:
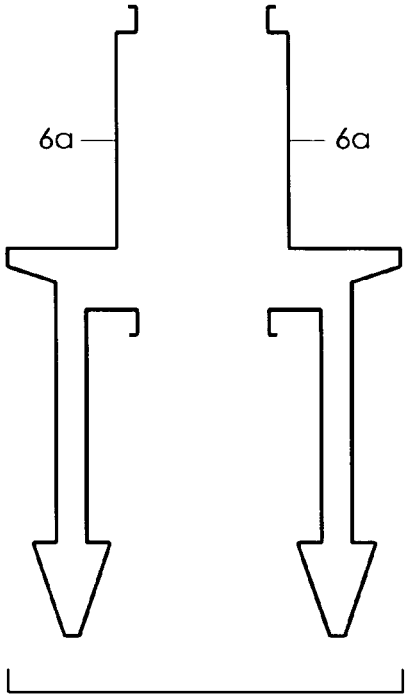

FIG. 24 Shows an exploded cross-section of a typical Loq·kit floor joist as two mirror-image halves.

Figure 24A:
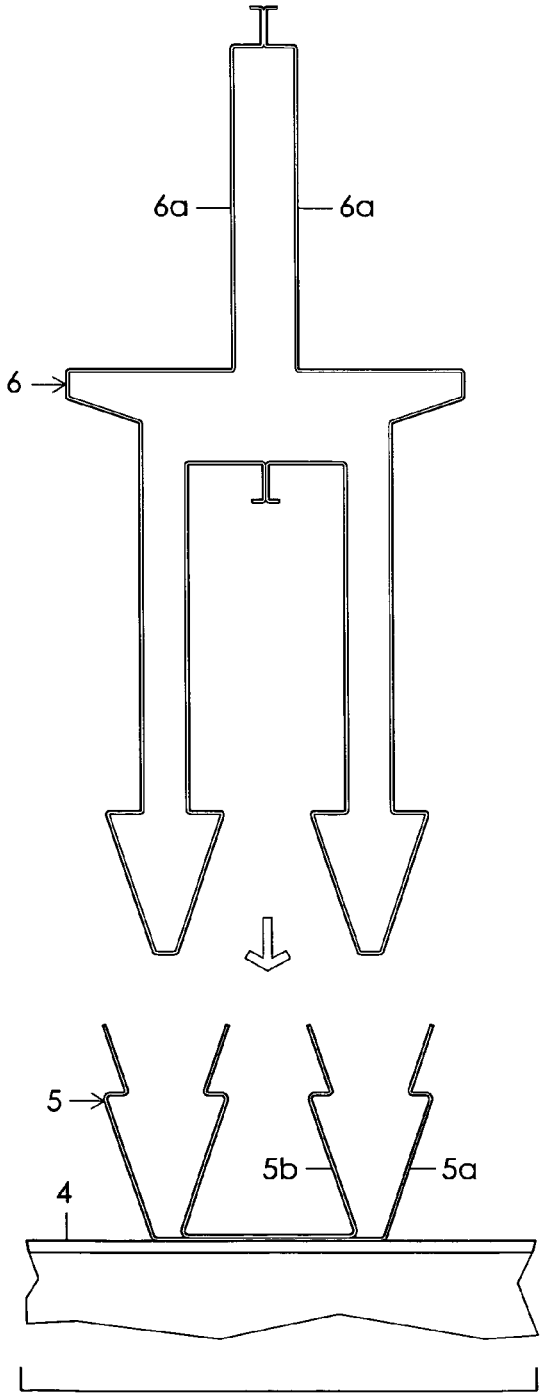

FIG. 24A Shows an exploded cross-section of a typical Loq·kit floor joist-to joist clip connection.

Figure 24B:
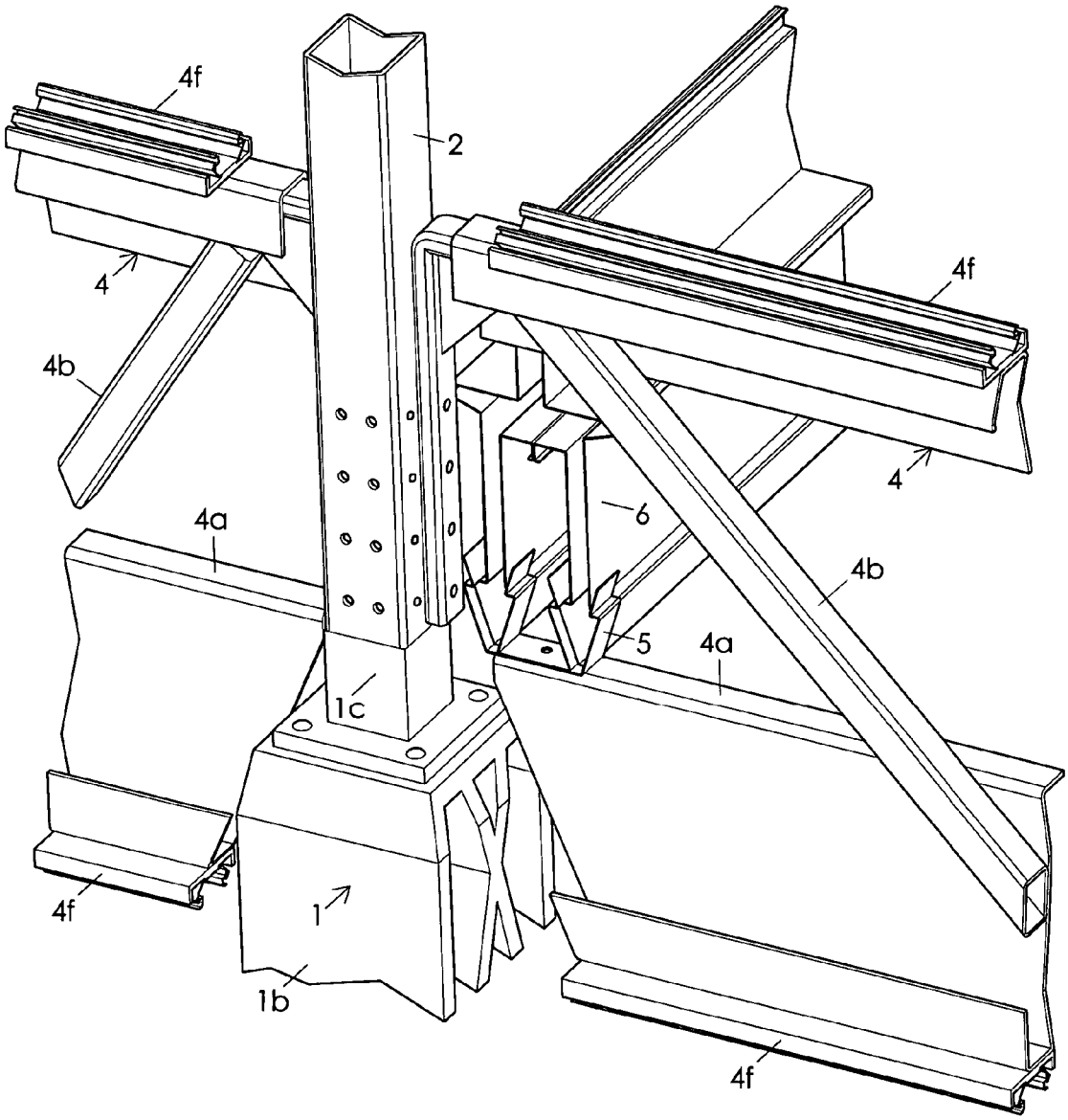

FIG. 24B Shows a three-dimensional view of an assembled Loq·kit structural system—illustrating the floor joist, and its connection with the a floor frame by means of a floor joist clip.

Figure 25:
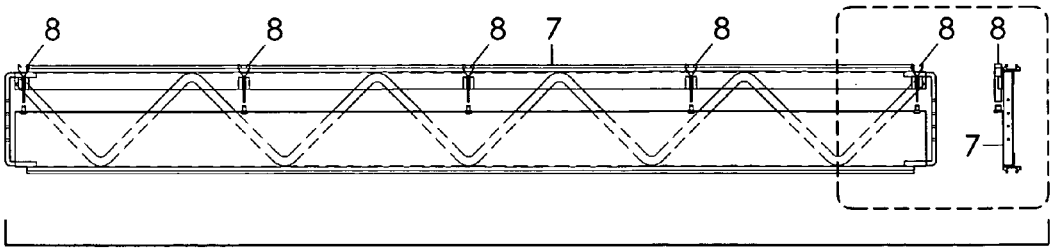

FIG. 25 Shows a side elevation-view and a front elevation-view of a Loq·kit roof frame.

Figure 25A:
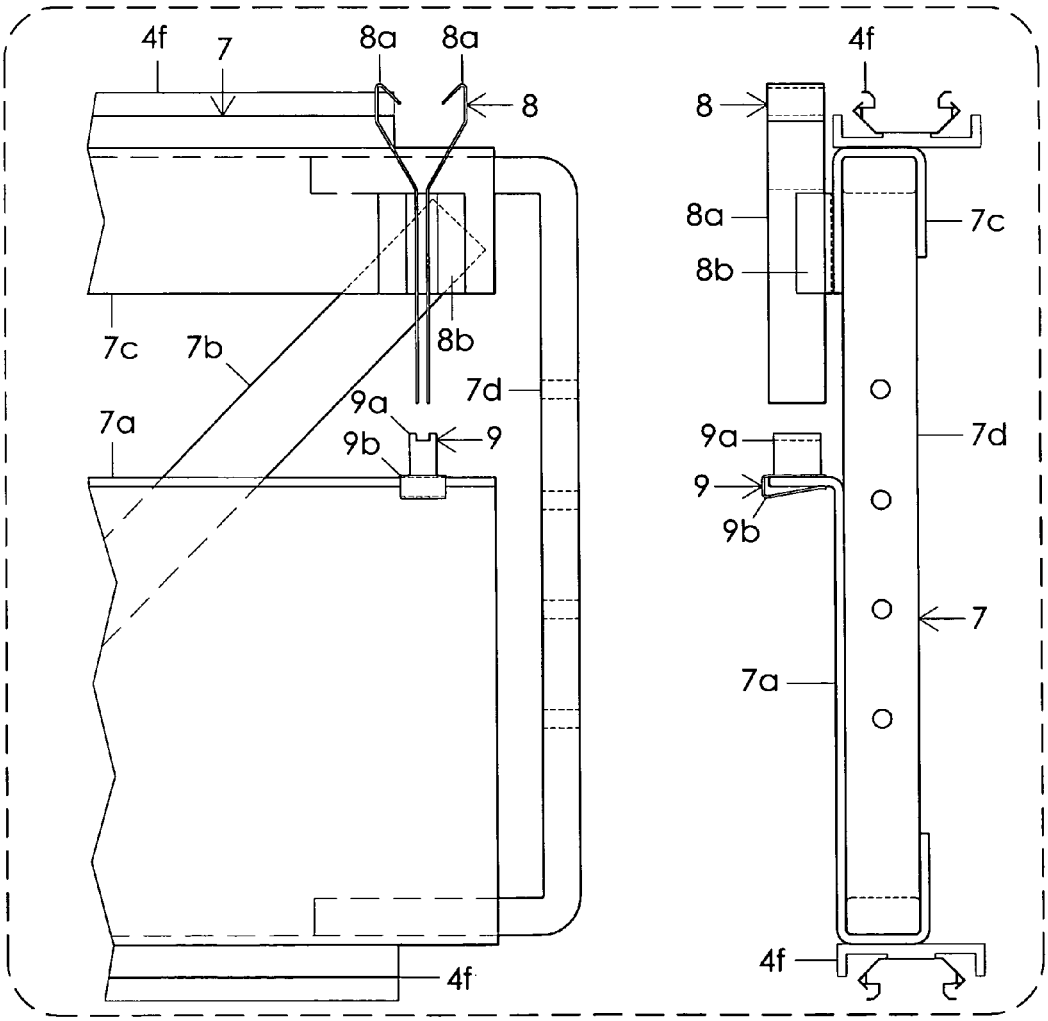

FIG. 25A Shows the enlarged roof frame end front view and enlarged side view of the roof frame elevated in FIG. 25. In the drawings, the front and side view of a rooftruss guide and seat are visible.

Figure 25B:
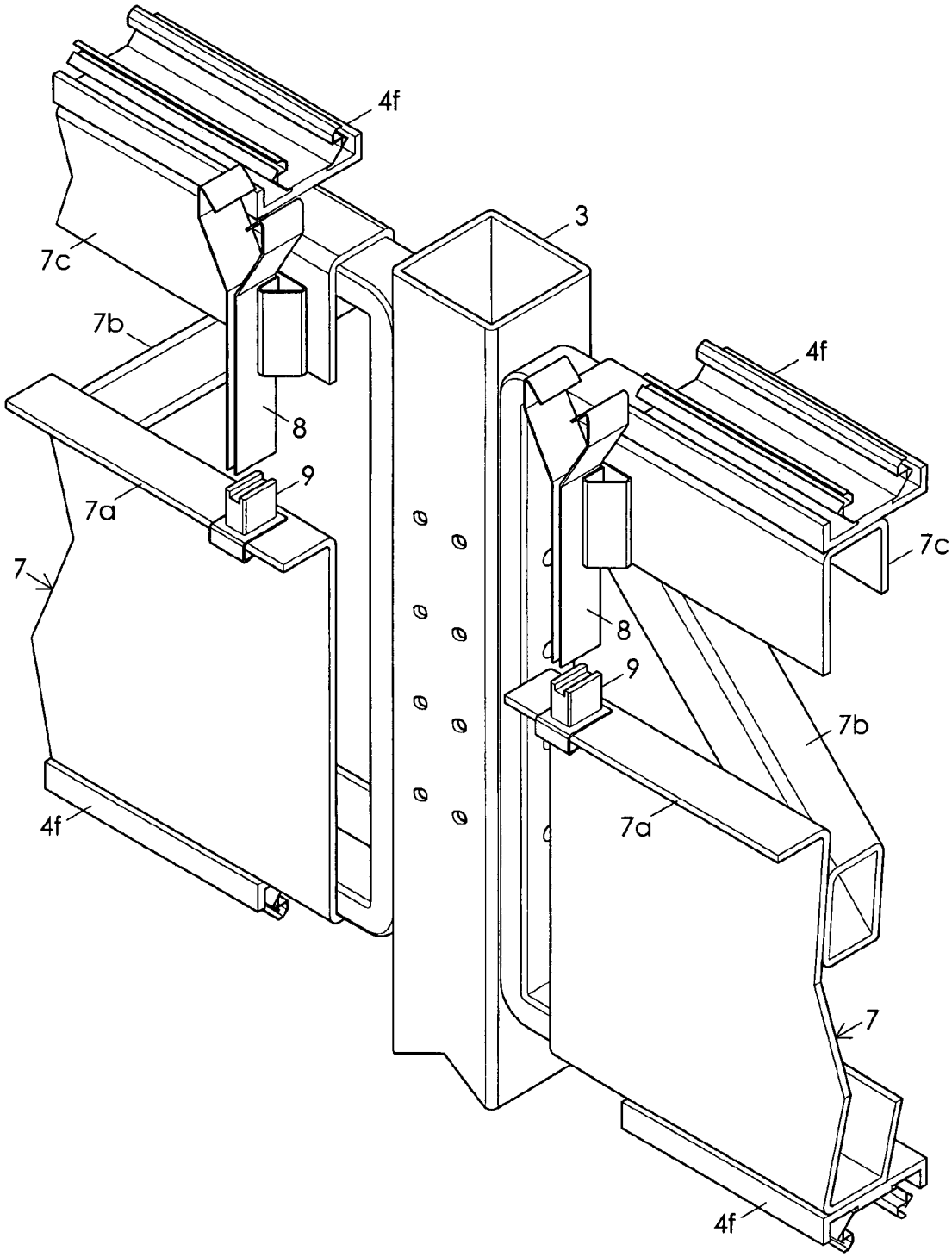

FIG. 25B Shows a three-dimensional view of a roof frame end with attached roof truss guide and roof truss seat.

Figure 26:
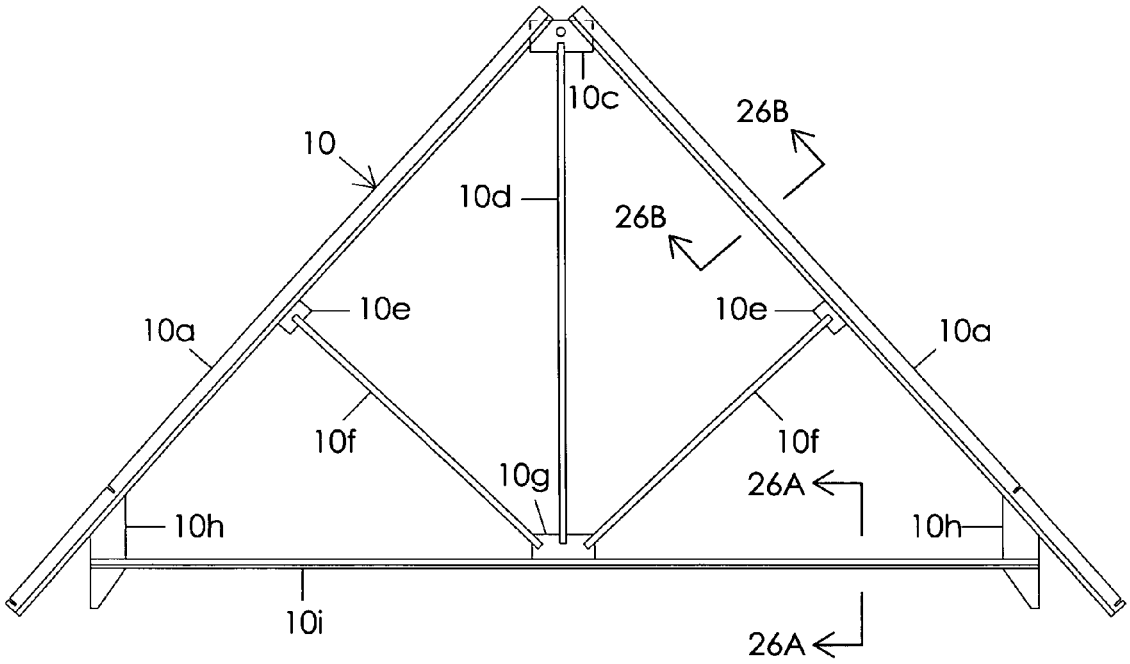

FIG. 26 Elevation drawing of a roof truss showing the location of two section-cuts.

Figure 26A:
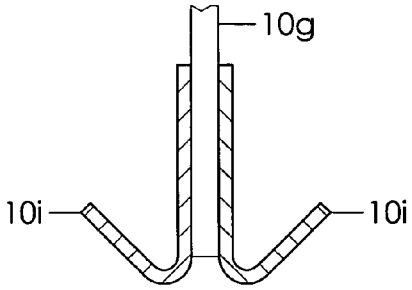

FIG. 26A Shows a cross-section of a roof truss' bottom chord members.

Figure 26B:
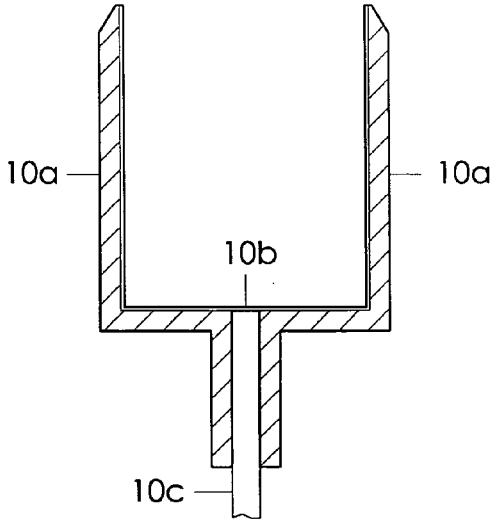

FIG. 26B Shows a cross-section of a roof truss' top chord members.

Figure 27A:
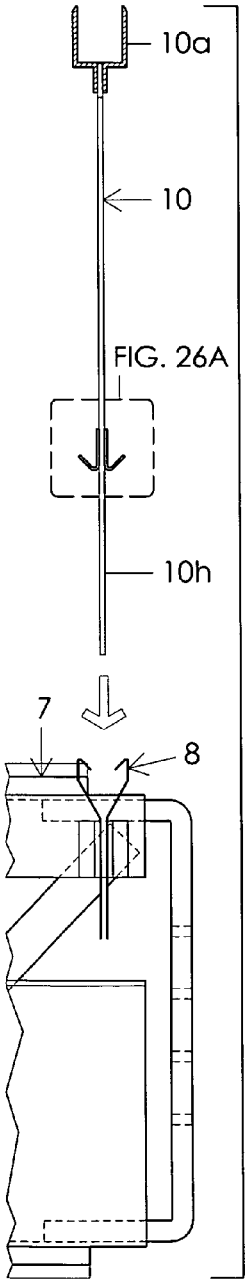

FIG. 27A Shows a roof truss cross-section positioned above a roof truss frame end shown in elevation.

Figure 27B:
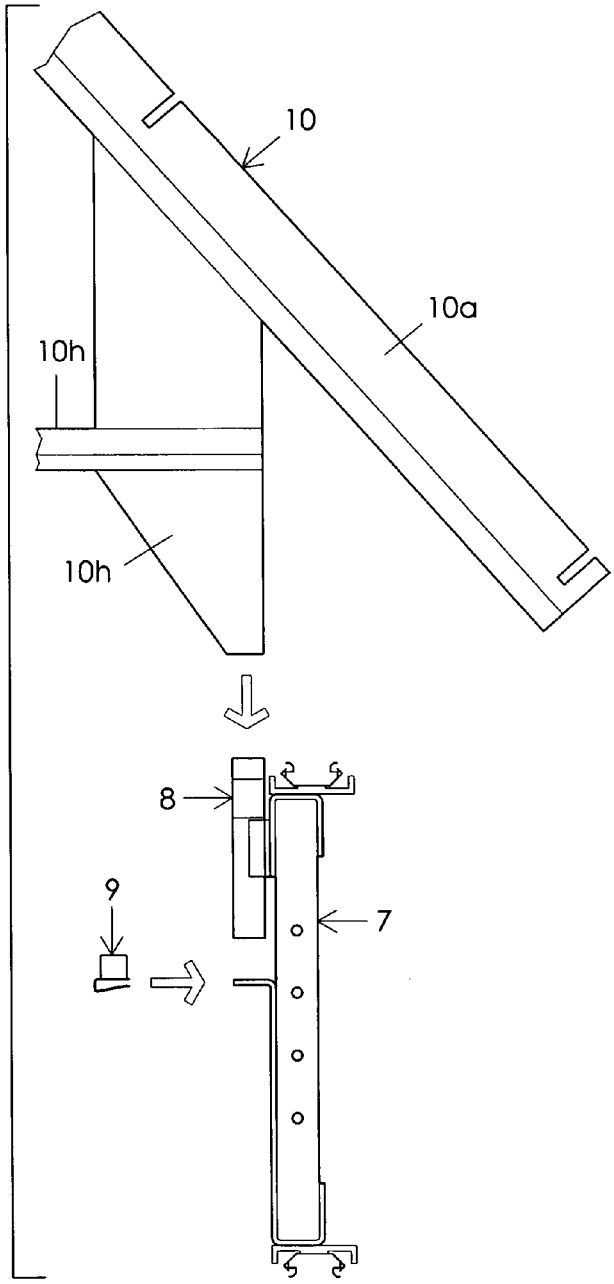

FIG. 27B Shows the same two components that are illustrated in FIG. 27A. Here, the components shown are the roof truss shown in elevation, positioned above a roof truss frame end shown as a side elevation.

FIG. 28A Shows components illustrated in FIGS. 27A and 27B. Here, the cross-section of the roof truss is shown mated with the assembly hardware (truss guide and seat) installed on the roof frame end—shown in elevation.

FIG. 28B Shows the side view of the connection illustrated in FIG. 28A. The roof truss end is shown in elevation, while the roof frame is seen from the end as an elevation view.

FIG. 28C Shows the enlarged cross-section of the roof truss' bottom chord connection to roof frame that is shown in FIG. 28A.

Figure 28D:
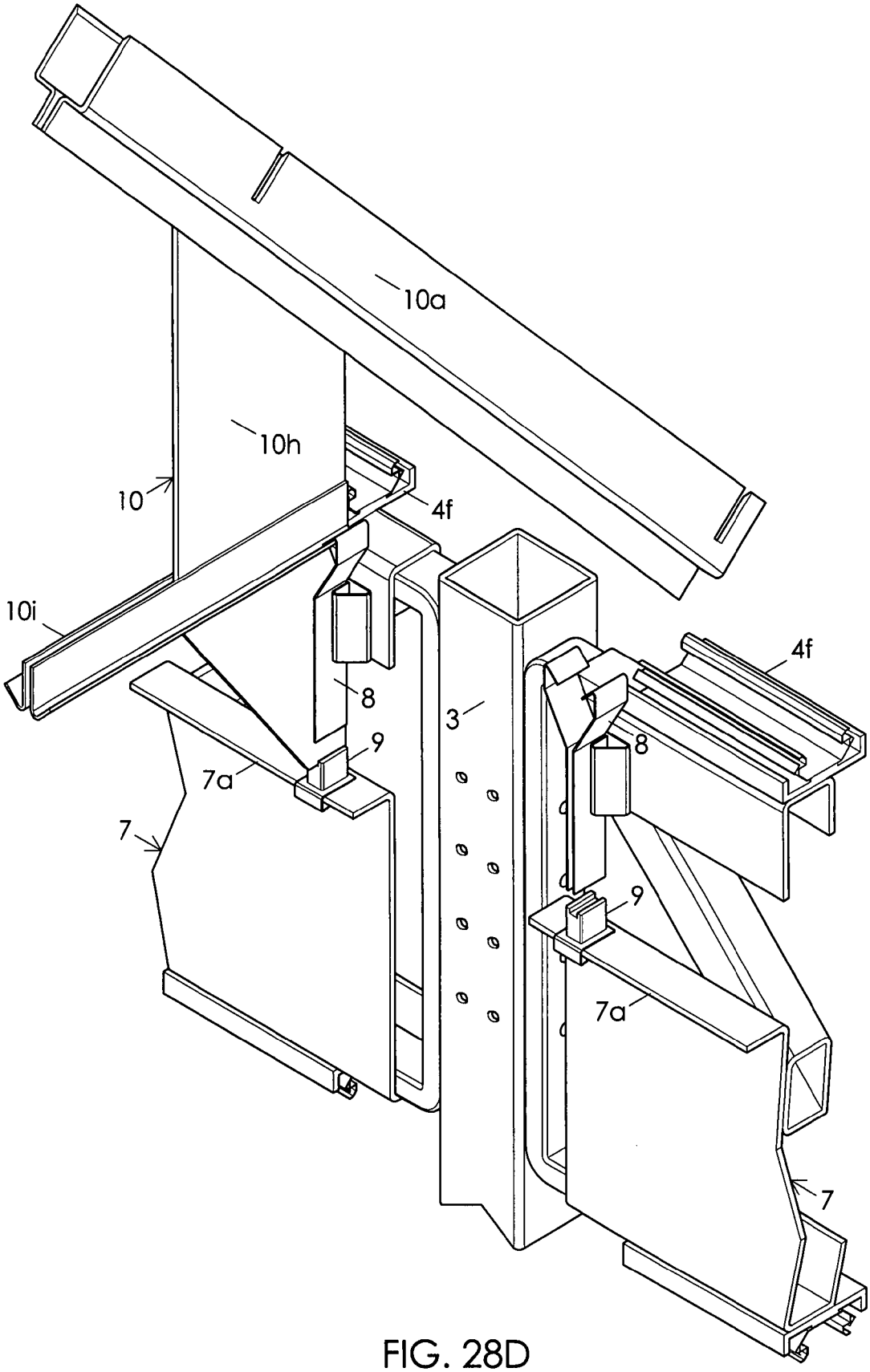

FIG. 28D Shows a three-dimensional view of thereof truss connection to roof frame illustrated in FIGS. 28A and 28B.

FIG. 29 Not Used

Figure 30:
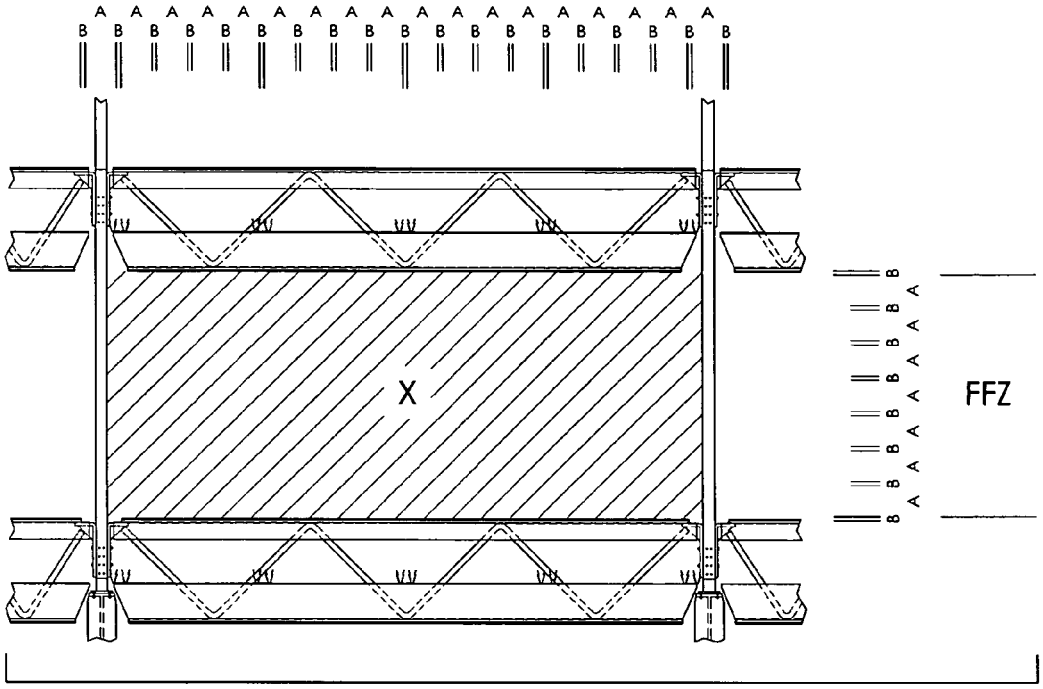

FIG. 30 Shows an elevation view of a free-facade zone and its relationship to the alternating sequence.

Figure 31:
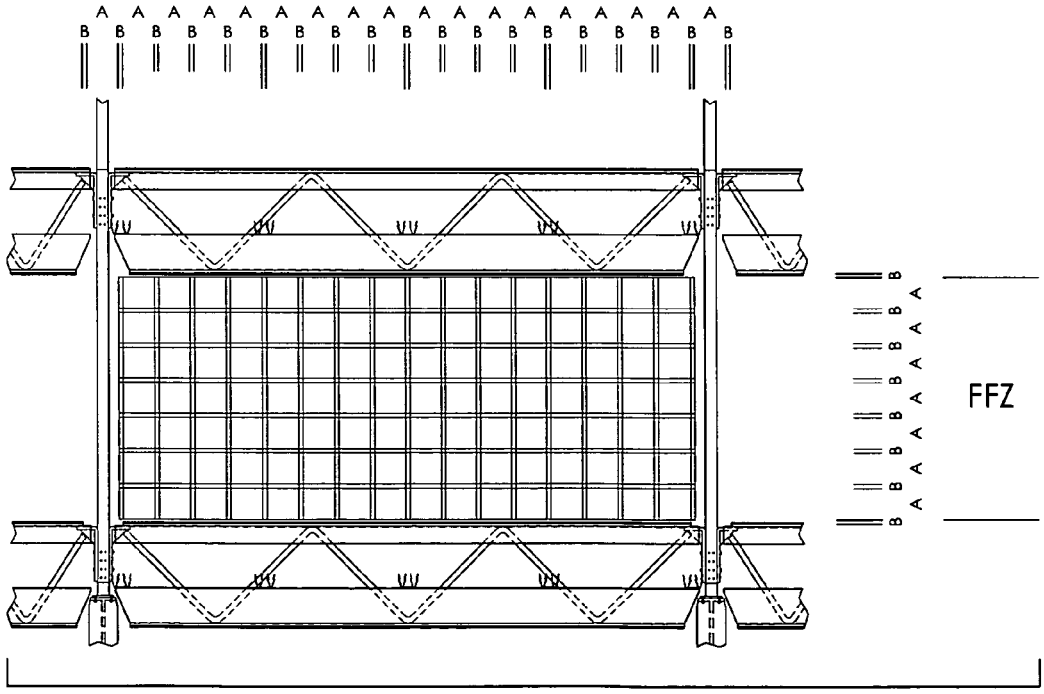

FIG. 31 Shows the free-facade zone illustrated in FIG. 30, with the alternating sequence superimposed over the in-fill area, or void, between structure.

Figure 31A:
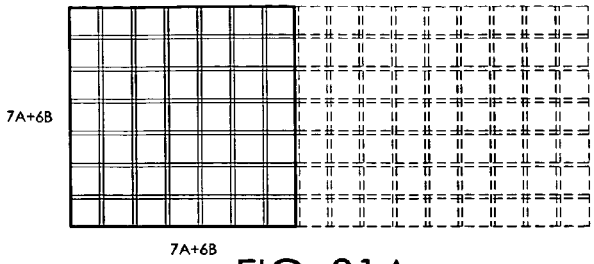

FIG. 31A Elevation diagram of the free-facade zone and alternating sequence shown in FIG. 31. The drawing shows the structure removed, representing the in-fill area, or void, as a function of wall panel sizes.

Figure 32:
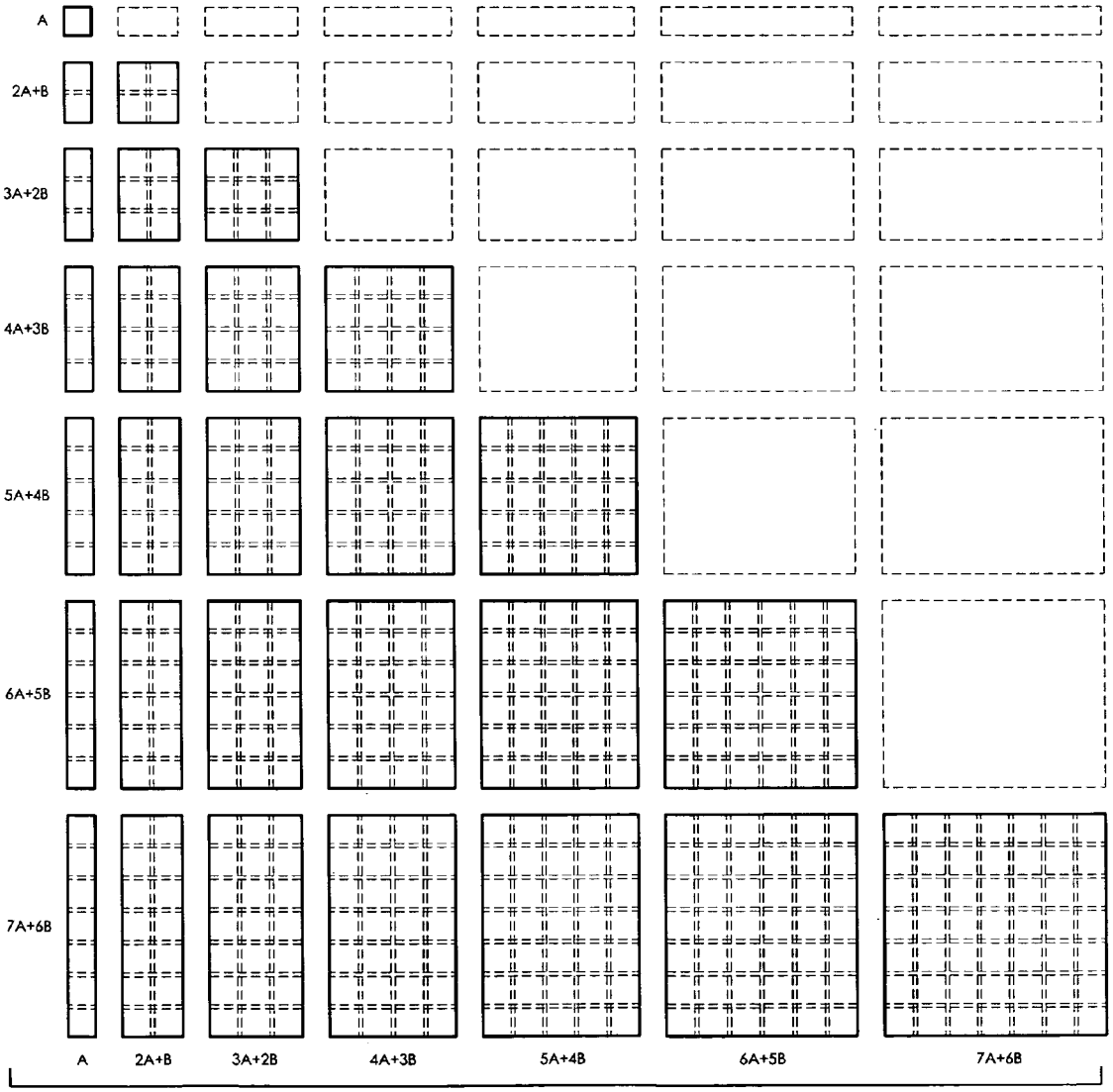

FIG. 32 Diagram showing Loq·kit standard wall panel sizes for any free-facade zone—determined as a function of the alternating sequence.

Figure 33:
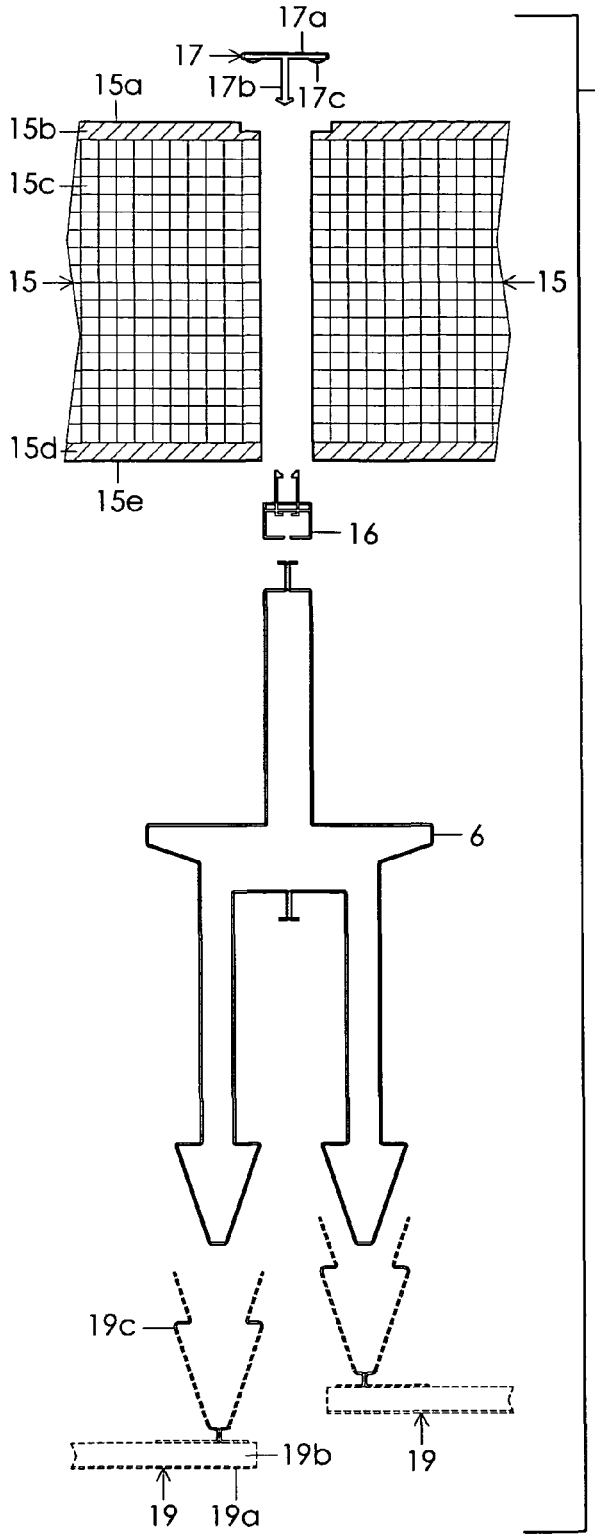

FIG. 33 Shows an exploded cross-section of a typical floor panel-to-floor joist connection—with finish ceiling shown dashed.

Figure 33A:
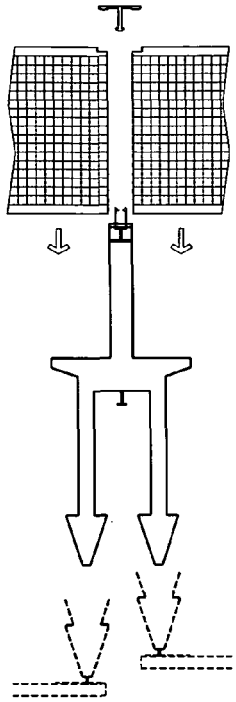

FIG. 33A Shows the exploded cross-section of FIG. 33 with floor panel clip (part 16) attached to a floor joist—while two floor panels positioned above, a wait connection.

Figure 33B:
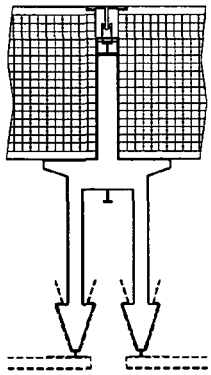

FIG. 33B Shows the assembled cross-section of the components shown in FIGS. 33 and 33A.

FIG. 34 Not Used

Figure 35:
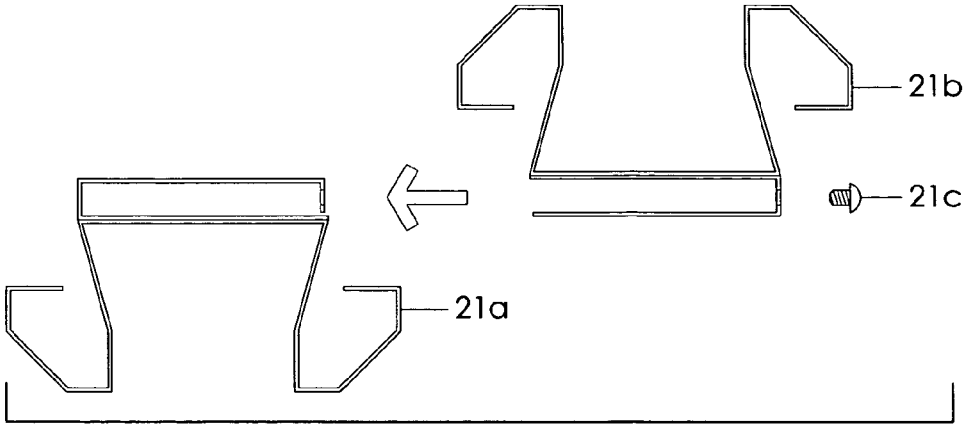

FIG. 35 Shows an exploded cross-section of a 6-way connector.

Figure 35A:
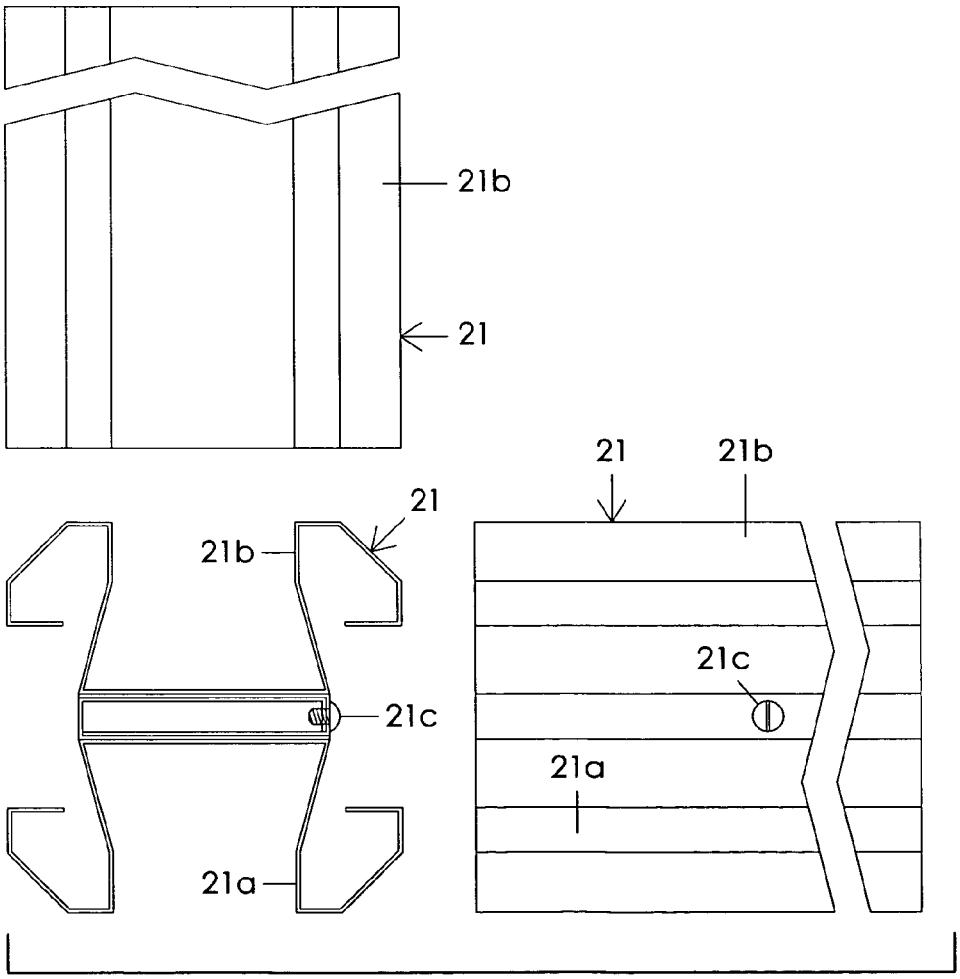

FIG. 35A Shows an assembled 6-way connector by means of three standard views of orthographic projection.

Figure 36:
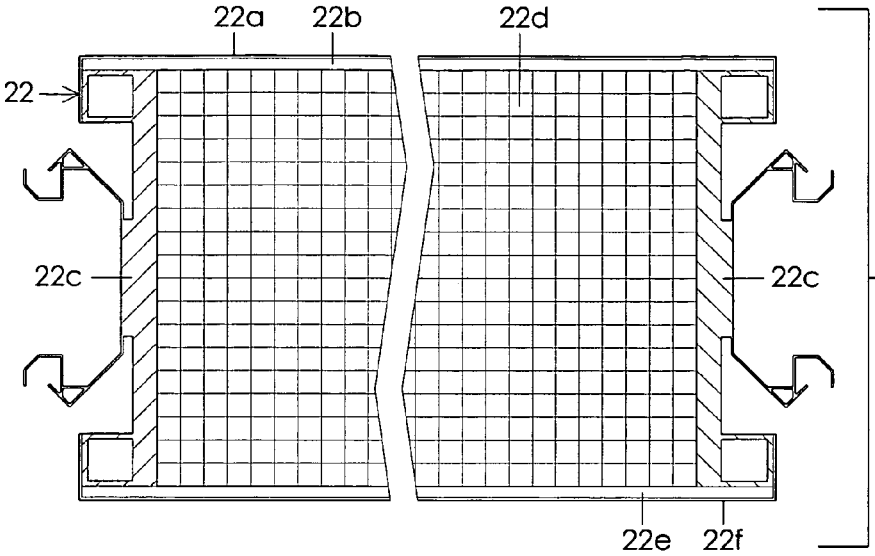

FIG. 36 Shows a cross-section of typical exterior wall panel.

Figure 37:
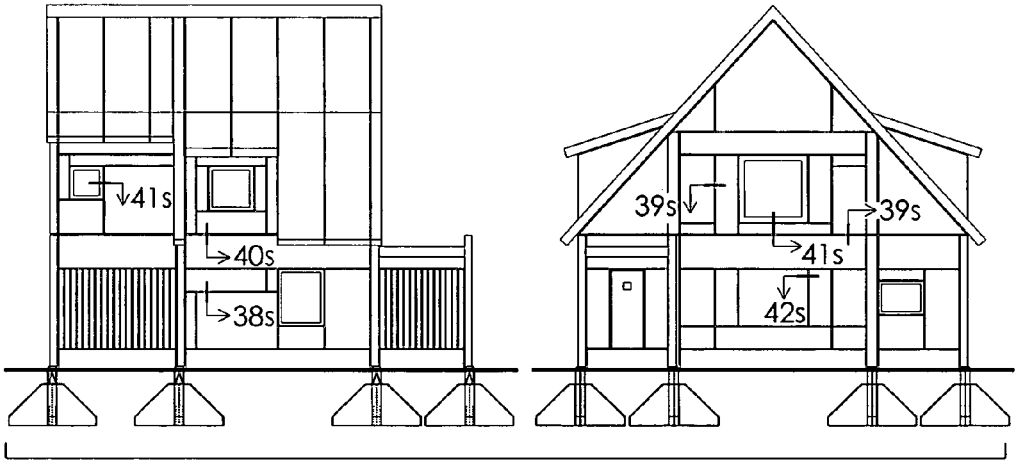

FIG. 37 Shows two elevation drawings of the example embodiment—with free-facade zone cross-section markers indicating the section locations of the detail figs to come.

Figure 38:
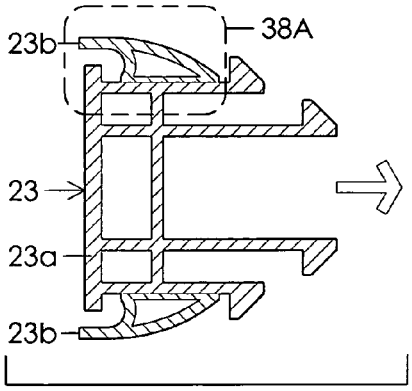

FIG. 38 Shows a cross-section of weather strip with compression seals at either side.

Figure 38A:
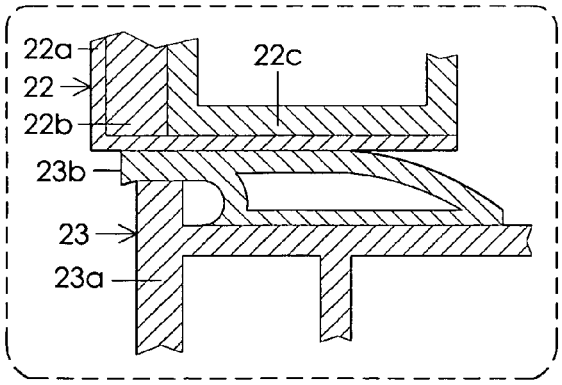

FIG. 38A Shows an enlarged cross-section of an installed compression seal.

Figure 39:
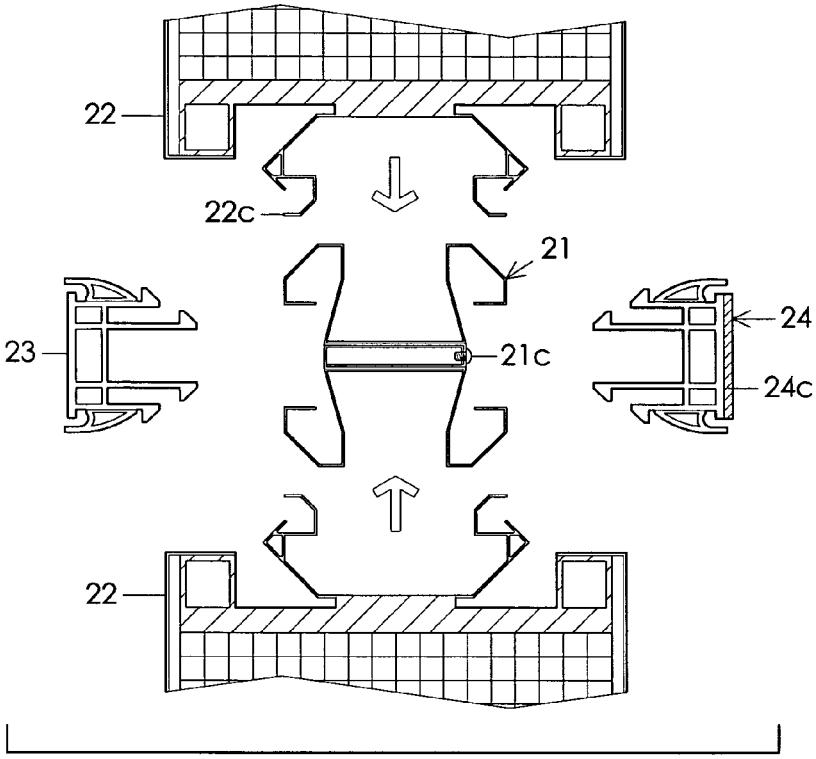

FIG. 39 Exploded cross-section of a standard Loq·kit exterior wall panel-to-exterior wall panel connection.

Figure 39A:
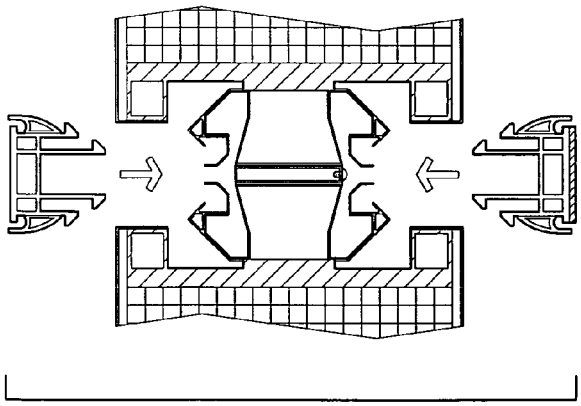

FIG. 39A Shows the cross-section of FIG. 39, with both panel ends connected via a 6-way connector.

Figure 39B:
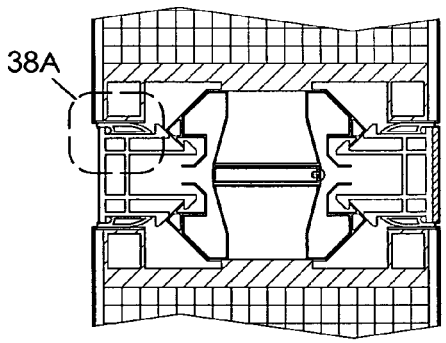

FIG. 39B Shows the assembled connection condition of FIGS. 39 and 39A components.

Figure 40:
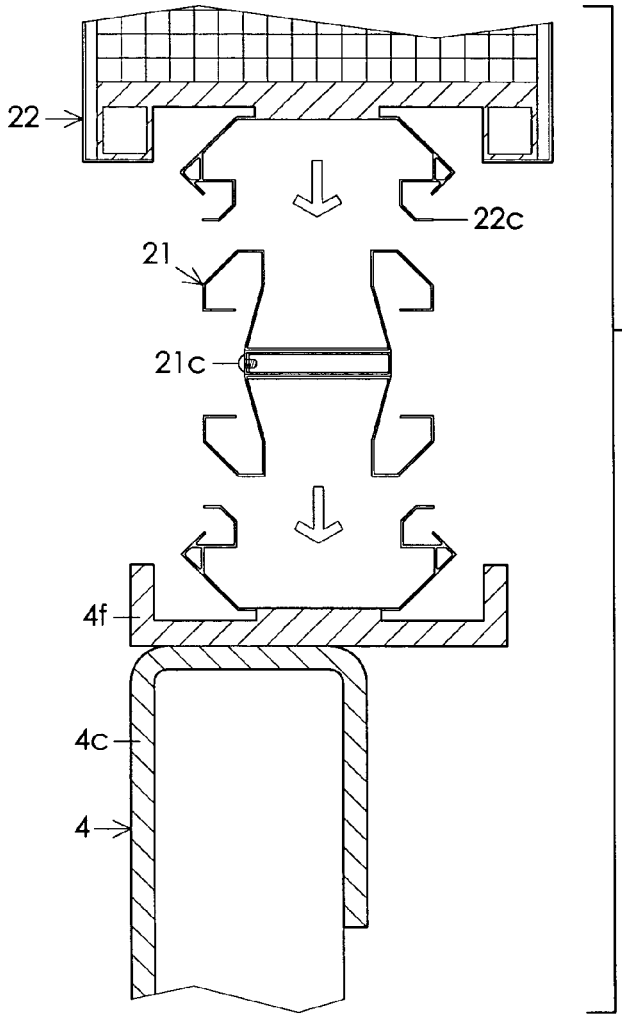

FIG. 40 Shows an exploded cross-section of a Loq·kit exterior wall panel-to-floor frame connection.

Figure 40A:
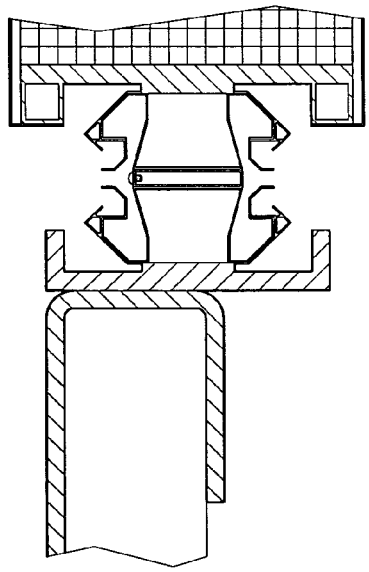

FIG. 40A Shows the assembled connection condition of FIG. 40 components.

Figure 41:
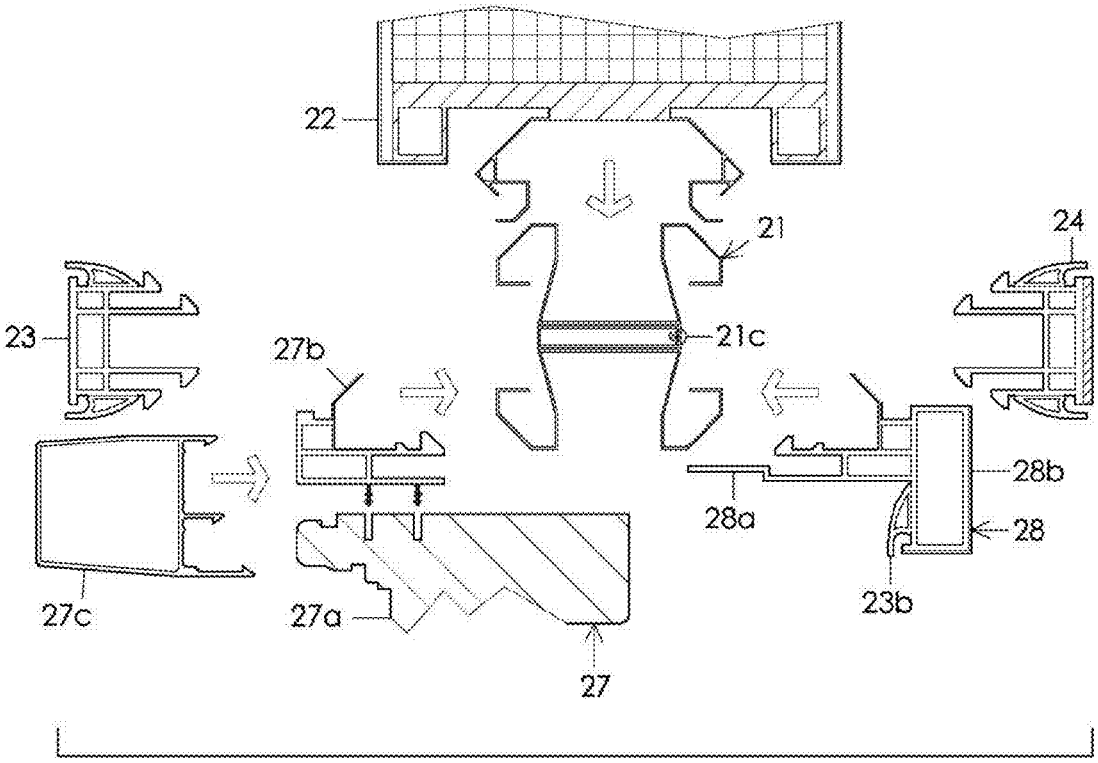

FIG. 41 Exploded cross-section of a standard Loq·kit exterior wall panel-to-window or door panel connection.

Figure 41A:
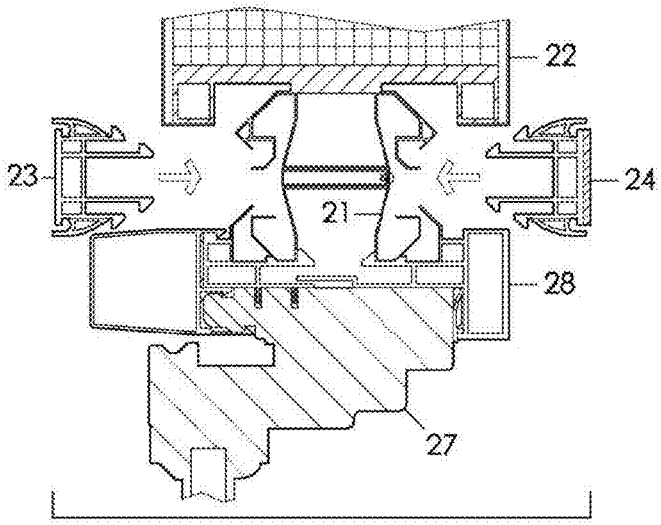

FIG. 41A Cross-section of a Loq·kit exterior wall panel connected to a window or door unit via a 6-way connector. Exterior and interior weather strips remain uninstalled.

Figure 41B:
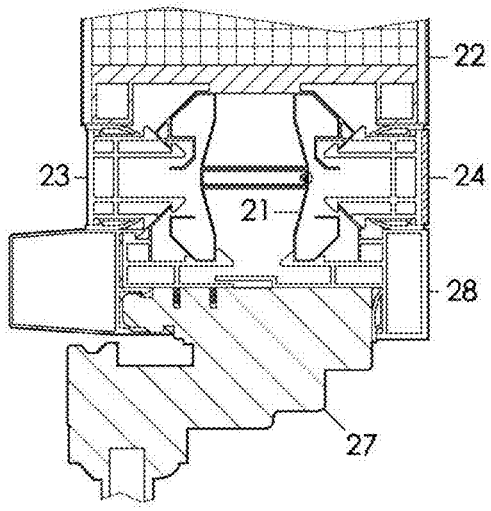

FIG. 41B Shows the assembled cross-section of FIG. 41 components.

Figure 42:
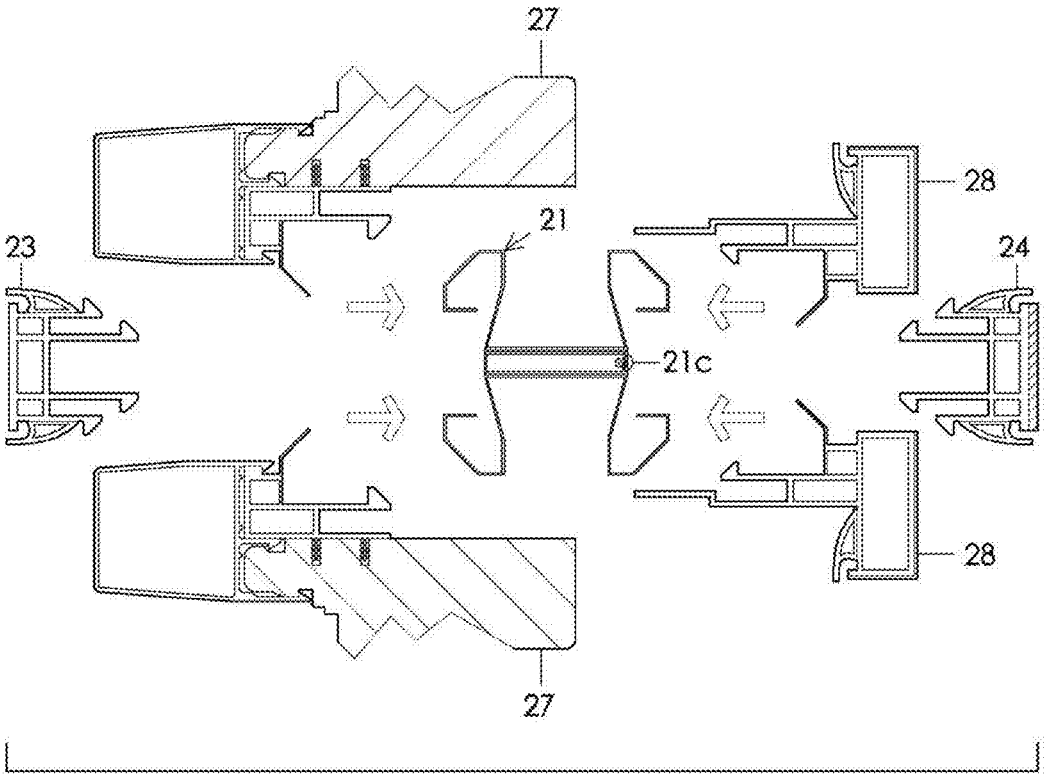

FIG. 42 Exploded cross-section of standard Loq·kit window or door panel-to-window or door panel connection.

Figure 42A:
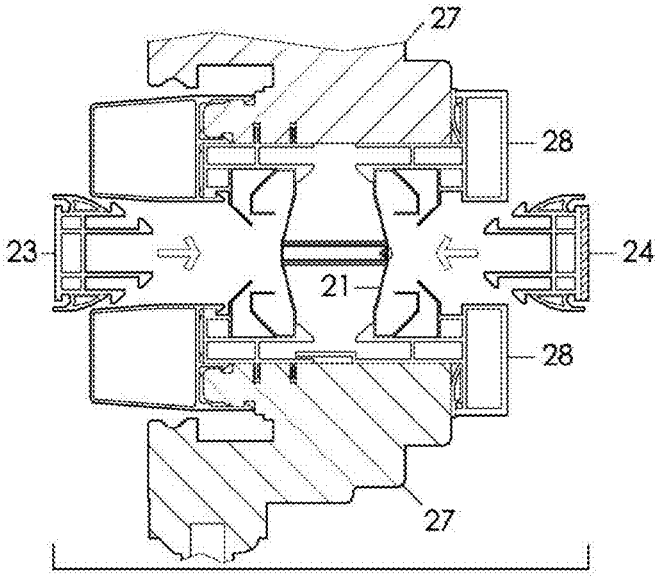

FIG. 42A Cross-section of a Loq·kit window or door panel connected to a window or door panel via a 6-way connector.

Figure 42B:
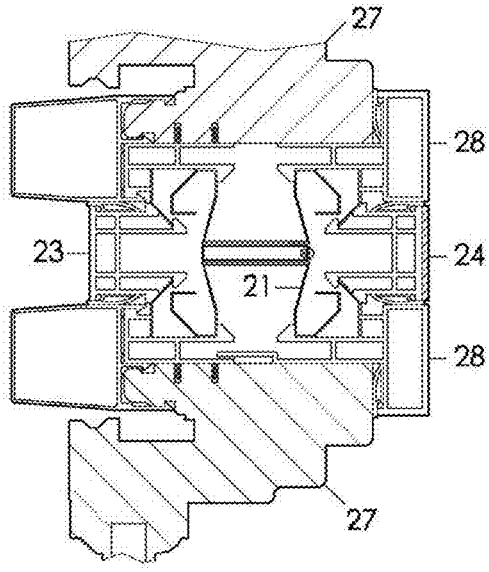

FIG. 42B Shows the assembled cross-section of FIG. 42 components.

Figure 43A:
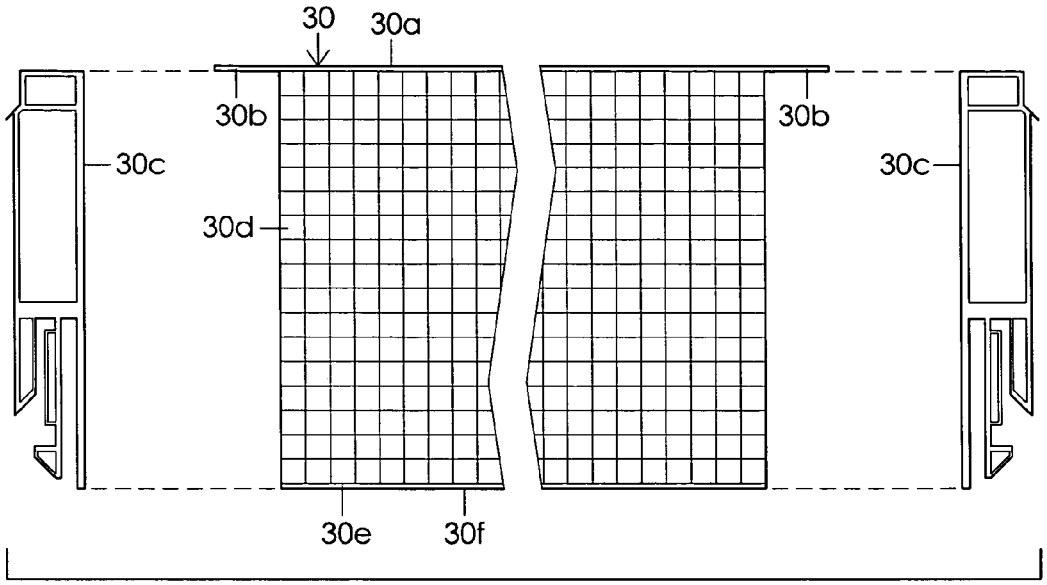

FIG. 43A Exploded cross-section of a typical Loq·kit roof panel, showing profile of side extrusions.

Figure 43B:
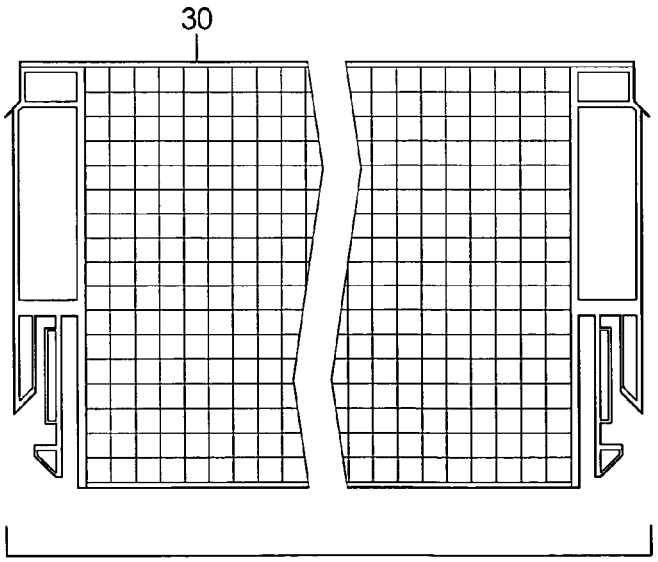

FIG. 43B Cross-section of a standard Loq·kit roof panel cut perpendicular to building structure on which it is installed.

Figure 44:
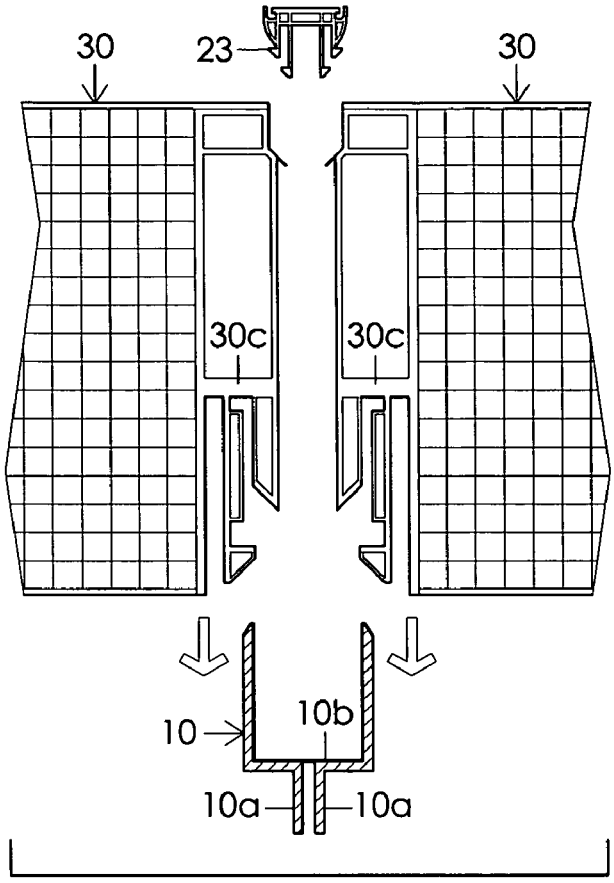

FIG. 44 Exploded cross-section of a Loq·kit roof panel-to-roof truss top chord connection showing two roof panel ends connected to a common roof truss top chord.

Figure 44A:
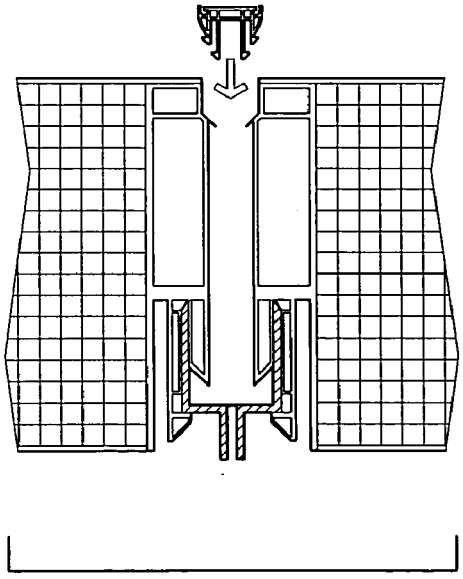

FIG. 44A Shows both roof panel ends of FIG. 44 installed on a truss top chord.

Figure 44B:
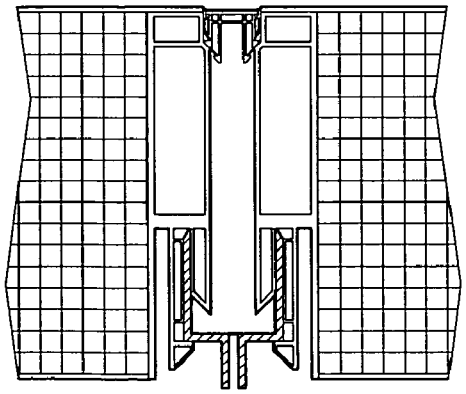

FIG. 44B Shows the assembled connection condition of FIG. 44 components.

Figure 45:
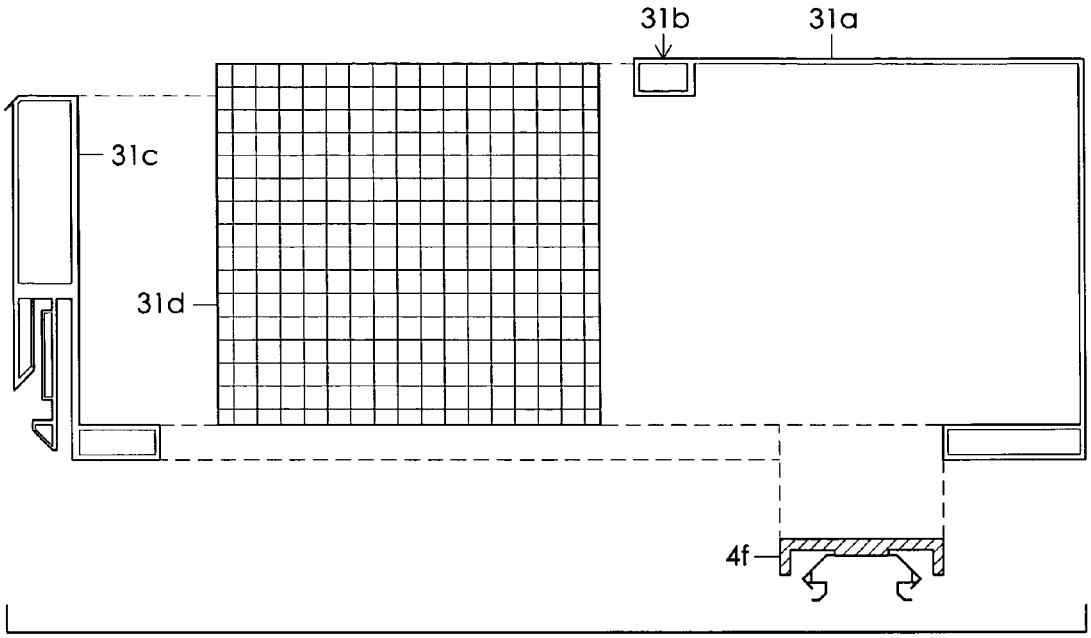

FIG. 45 Shows an exploded cross-section of a Loq·kit roof rake.

Figure 45A:
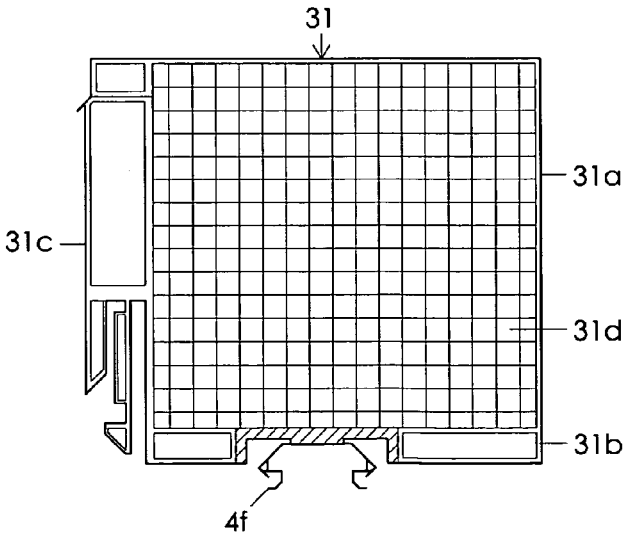

FIG. 45A Shows a cross-section of a factory-assembled roof rake.

Figure 45B:
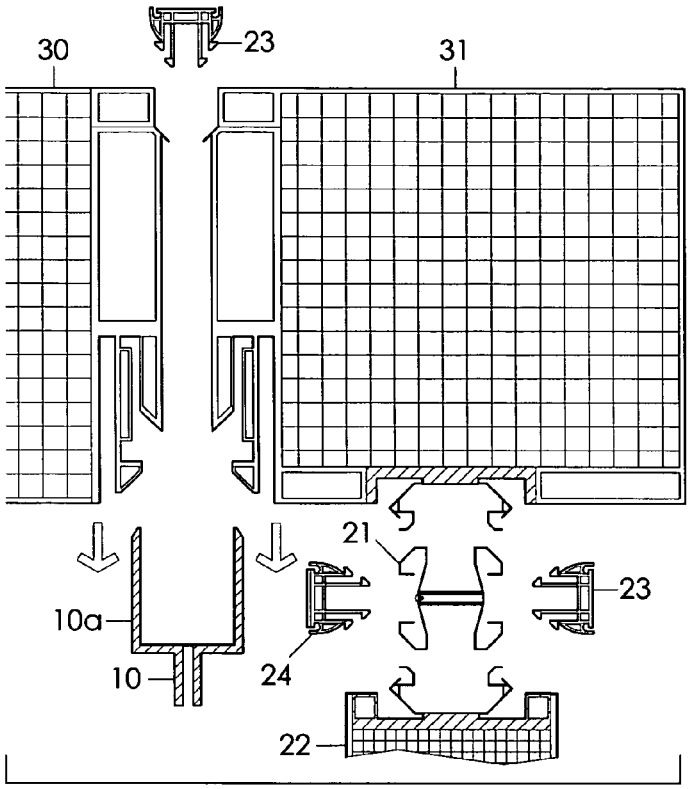

FIG. 45B Exploded cross-section showing the building components associated with a roof rake installation.

Figure 45C:
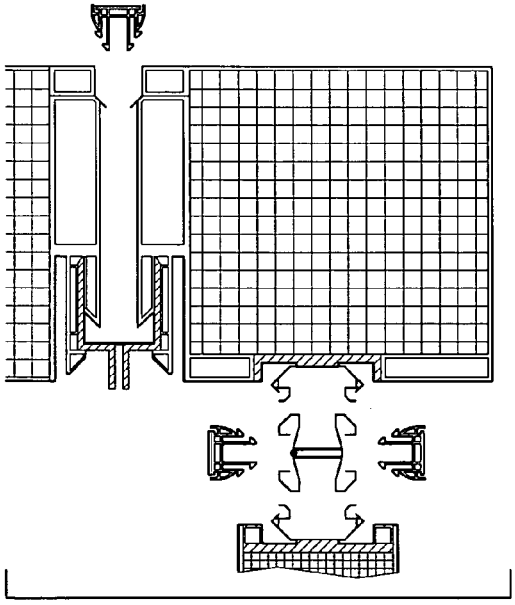

FIG. 45C Exploded cross-section of partly-assembled roof rake connection.

Figure 45D:
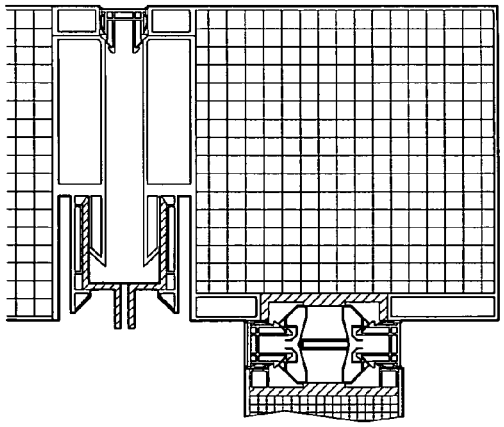

FIG. 45D Shows a cross-section of a finished roof rake assembly.

FIG. 46A Shows an exploded cross-section of a lower valance panel connection with a floor frame. Components also part of this assembly are a floor panel, joist clip, wall panel, and an interior weather strip.

FIG. 46B Shows a cross-section of FIG. 46A components assembled into their correct position relative to a site-excavated trench—also shown as a cross-section.

Figure 47A:
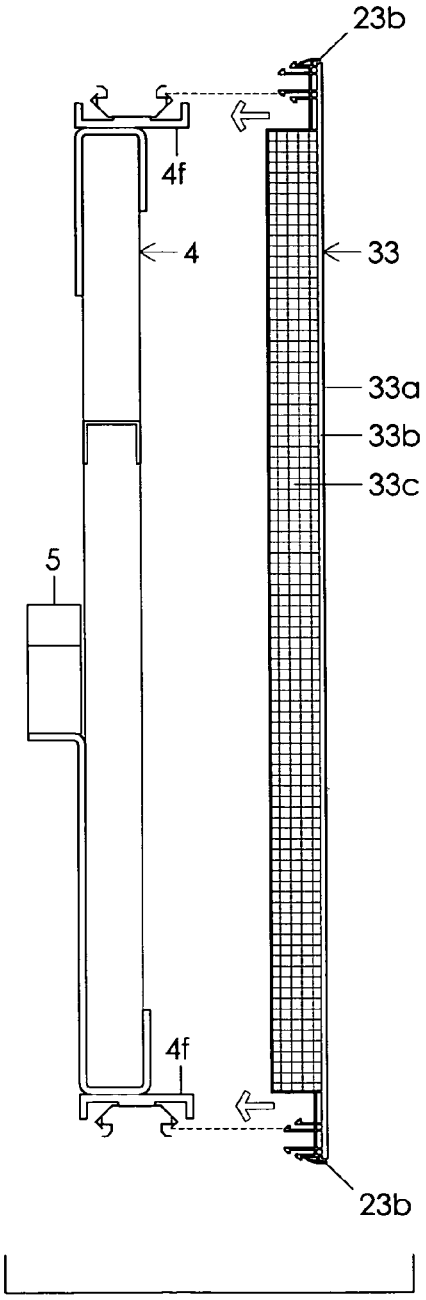

FIG. 47A Exploded cross-section of an upper floor frame valance panel-to-floor frame assembly.

Figure 47B:
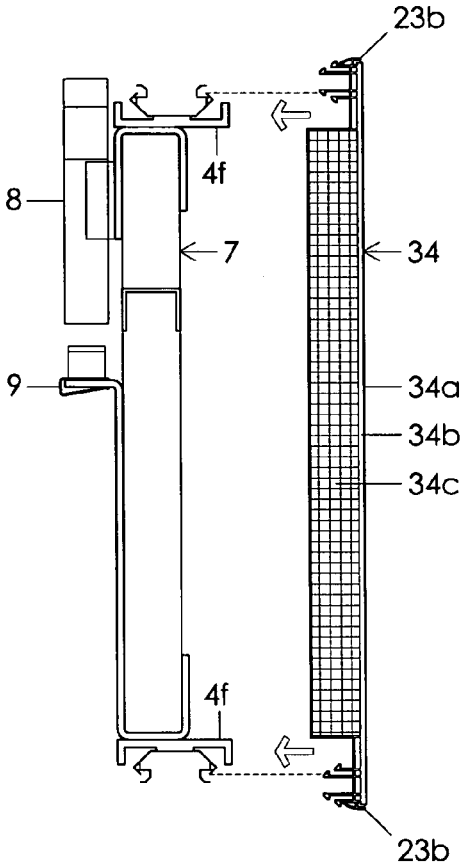

FIG. 47B Exploded cross-section of a roof frame valance panel-to-roof frame assembly.

Figure 48:
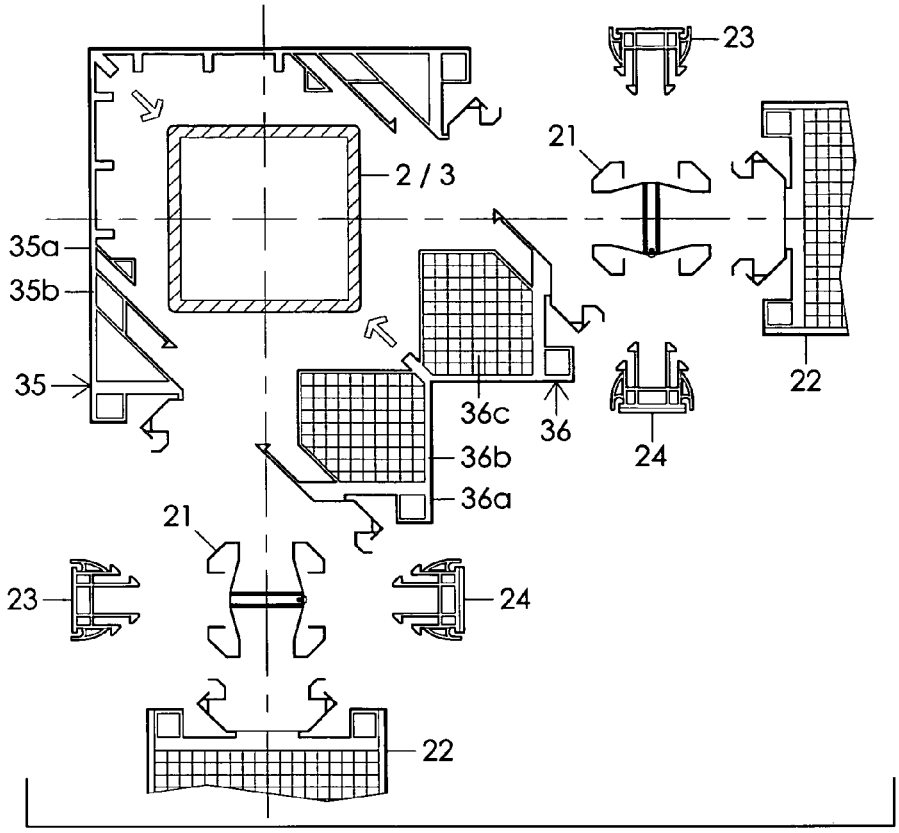

FIG. 48 Exploded plan-view cross-section of a standard Loq·kit structural corner column-to-exterior wall panel connection by means of corner cladding and 6-way connectors.

Figure 48A:
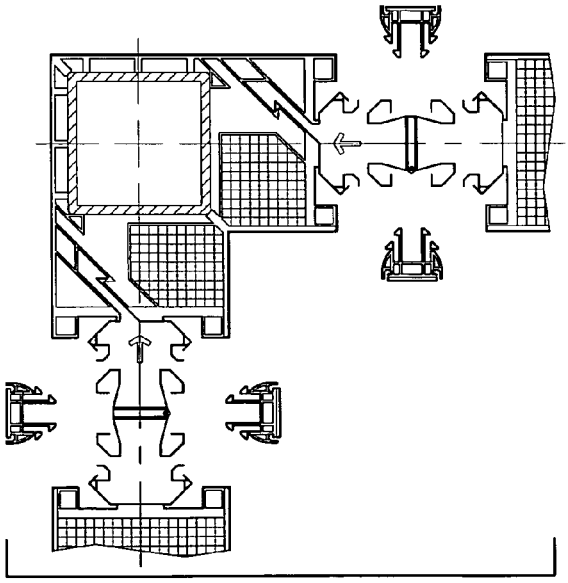

FIG. 48A Shows the components of FIG. 48 with corner cladding attached to the column, while a waiting connection of 6-way connectors, wall panels, and weather strips.

Figure 48B:
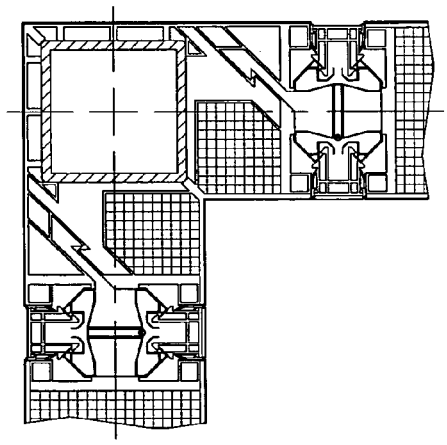

FIG. 48B Shows the assembled plan-view connection condition of FIG. 48 components.

Figure 49:
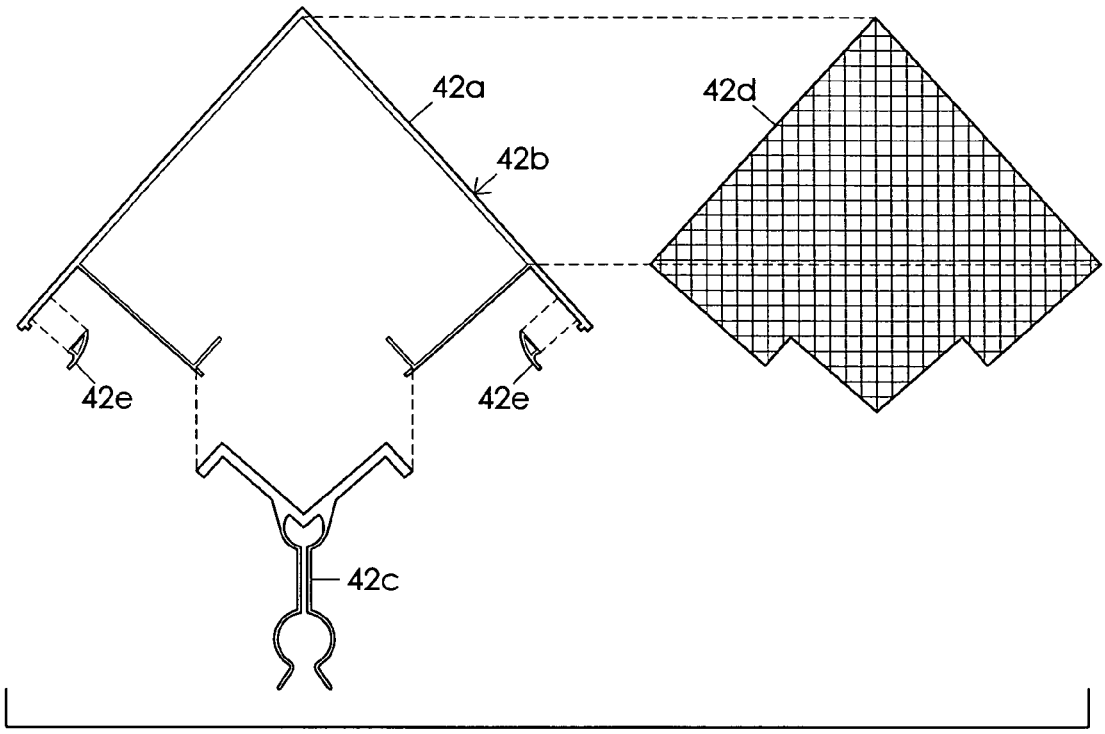

FIG. 49 Exploded cross-section of factory-assembled roof ridge cap.

Figure 49A:
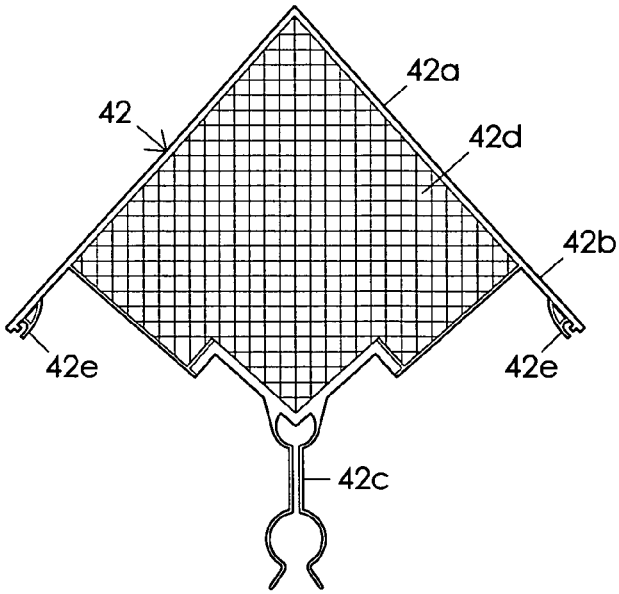

FIG. 49A Shows a cross-section of the factory-assembled roof ridge cap.

FIG. 49B Exploded cross-section of Loq·kit roof ridge cap-to-roof panel connection by means of a roof truss stabilizer bar.

FIG. 49C Shows the assembled connection condition of FIG. 49 components.

DRAWING REFERENCE NUMERALS

| | |
|---|---|
| 1 | Trench Footing |
| 1a | trench footing base |
| 1b | trench footing saddle |
| 1c | trench footing cap |
| 2 | Lower Column |
| 3 | Upper Column |
| 4 | Floor Frame |
| 4a | floor frame bearing flange |
| 4b | floor frame web |
| 4c | floor frame top flange |
| 4d | floor frame support bracket |
| 4e | floor frame support gusset |
| 4f | extrusion |
| 4g | frame bolt (prior art) |
| 5 | Floor Joist Clip |
| 5a | clip bottom |
| 5b | clip top |
| 5c | clip retainer |
| 6 | Floor Joist |
| 6a | joist half |
| 6b | joist floor clip |
| 7 | Roof Frame |
| 7a | roof frame bearing flange |
| 7b | roof frame web |
| 7c | roof frame top flange |
| 7d | roof frame support bracket |
| 4g | frame bolt (prior art) |
| 8 | Roof Truss Guide |
| 8a | truss guide |
| 8b | truss guide bracket |
| 9 | Roof Truss Seat |
| 9a | gusset seat |
| 9b | seat clip |
| 10 | Roof Truss |
| 10a | top chord half |
| 10b | gutter liner |
| 10c | top gusset |
| 10d | center web bar |
| 10e | side gusset |
| 10f | side web bar |
| 10g | bottom gusset |
| 10h | bearing gusset |
| 10i | bottom chord |
| 11 | Roof Truss Stabilizer Bar |
| 12 | Not Used |
| 13 | Not Used |
| 14 | Not Used |
| 15 | Floor Panel |
| 15a | top finish veneer |
| 15b | panel top sheet |
| 15c | panel insulation |
| 15d | panel bottom sheet |
| 15e | bottom finish veneer |
| 16 | Floor Panel Clip |
| 17 | Floor Panel Retainer |
| 17a | retainer top finish |
| 17b | retainer body |
| 17c | retainer compression fitting |
| 18 | Stair Carriage |
| 18a | stair carriage frame |
| 18b | stair stringer |
| 18c | stair tread |
| 19 | Ceiling Panel |
| 19a | finish veneer |
| 19b | panel core |
| 19c | panel clip |
| 20 | Not Used |
| 21 | 6-way Connector |
| 21a | 6-way half "O" |
| 21b | 6-way half "C" |
| 21c | release screw |
| 22 | Wall Panel |

-continued

| | |
|---|---|
| 22a | panel exterior finish |
| 22b | panel outside sheet |
| 22c | panel extrusion |
| 22d | panel insulation |
| 22e | panel inside sheet |
| 22f | panel interior finish |
| 23 | Exterior Weather Strip |
| 23a | body extrusion |
| 23b | compression seal |
| 24 | Interior Weather Strip |
| 23a | body extrusion |
| 23b | compression seal |
| 24c | interior finish |
| 27 | Window Panel |
| 27a | window unit (size regulated prior art) |
| 27b | lock |
| 27c | trim |
| 28 | Window Casing |
| 28a | body extrusion |
| 28b | casing finish |
| 23b | compression seal |
| 29 | Not Used |
| 30 | Roof Panel |
| 30a | panel top finish |
| 30b | panel top sheet |
| 30c | panel extrusion |
| 30d | panel insulation |
| 30e | panel bottom sheet |
| 30f | panel bottom finish |
| 31 | Roof Rake |
| 31a | finish veneer |
| 31b | outer body extrusion |
| 31c | inner body extrusion |
| 31d | body insulation |
| 22c | panel extrusion |
| 32 | Lower Floor Frame Valance Panel |
| 32a | finish veneer |
| 32b | body extrusion |
| 32c | body insulation |
| 23b | compression seal |
| 33 | Upper Floor Frame Valance Panel |
| 33a | finish veneer |
| 33b | body extrusion |
| 33c | body insulation |
| 23b | compression seal |
| 34 | Roof Frame Valance Panel |
| 34a | finish veneer |
| 34b | body extrusion |
| 34c | body insulation |
| 23b | compression seal |
| 35 | Outside Corner Cladding |
| 35a | finish veneer |
| 35b | body extrusion |
| 36 | Inside Corner Cladding |
| 36a | finish veneer |
| 36b | body extrusion |
| 36c | body insulation |
| 38s | Location of Cross-Section Shown in FIG. 38 |
| 39s | Location of Cross-Section Shown in FIG. 39 |
| 40s | Location of Cross-Section Shown in FIG. 40 |
| 41s | Location of Cross-Section Shown in FIG. 41 |
| 42s | Location of Cross-Section Shown in FIG. 42 |
| 42 | Roof Ridge Cap |
| 42a | finish veneer |
| 42b | top extrusion |
| 42c | bottom extrusion |
| 42d | body insulation |
| 42e | compression seal |

DETAILED DESCRIPTION OF INVENTION

The following outline highlights Loq·kit innovation and organizes the detailed information that follows:

Outline of Invention

Section 1. A New Kind of Modular—Loq·kit Conceptual Framework

Figure 7A:
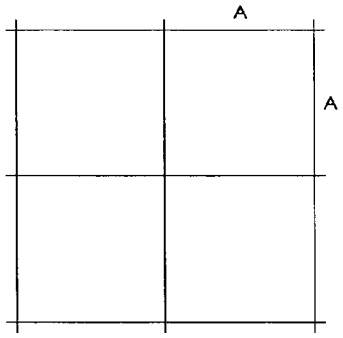
FIG. 7A PRIOR ART
FIG. 7A Shows a conventional modular grid layout in two dimensions, representing prior art.
Figure 7B:
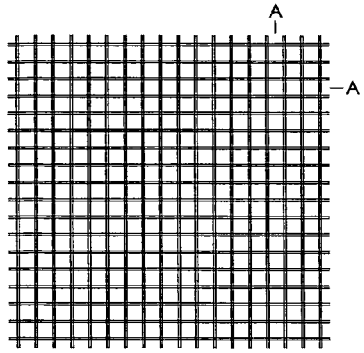
FIG. 7B Shows the Loq·kit modular grid in two dimensions.
Figure 8A:
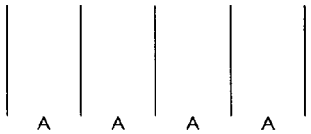
FIG. 8A PRIOR ART
FIG. 8A Shows a diagram of a conventional modular grid's layout sequence. The drawing indicates the way a prior art grid establishes building component lengths as a function of same lengths, or modules A.

- A. FIG. 7A—Large Dimension (prior art) vs. FIG. 7B—Small Dimension (Loq·kit)
- B. FIG. 8A—Repetitive Module (prior art) vs. FIG. 8B—Alternating Sequence (Loq·kit)
- C. FIG. 8A—Panel Dimension (prior art) vs. FIG. 8B—Connection Location (Loq·kit)
- D. FIGS. 9A and 9B—Application of the above three concepts Section 2. Sequence-defined Structure

- A. Sequence-defined Structure Part One—House Column Locations
  - 1. FIGS. 12A and 12B—In-Line Column Connections
  - 2. FIGS. 13A and 13B—Corner Column Connections—Rotating the Module 90 Degrees
- B. Sequence-defined Structure Part Two—Structural Frame
  - 1. Structural Zone (with Integrated Header)
- C. Interchangeable Structural Components
  - A. Trench Footing
  - B. Column, Lower and Upper
  - C. Floor Frame
  - D. Floor Joist Clip (floor joist connection)
  - E. Floor Joist
  - F. Roof Truss Frame
  - G. Roof Truss Clip
  - H. Roof Truss Seat
  - I. Roof Truss Section 3. Sequence-defined In-fill

- A. Free-Facade Zone
  - 1. Modular Panels
  - 2. Personalized Facade
- B. Other In-fill Components
- C. Interchangeable In-fill Components
  - 1. Floor Panel, Floor Panel-to-Joist Connection
  - 2. Ceiling Panel
  - 3. Stair Carriage
  - 4. Free-Facade Zone Components
    - A. 6-way Connector
    - B. Wall Panel
    - C. Weather Strip
    - D. Making Connections
      - d1. Wall Panel-to-Wall Panel Connection
      - d2. Wall Panel-to-Floor or Roof Frame Connection
      - d3. Wall Panel-to-Window or Door Connection
      - d4. Window or Door-to-Window or Door Connection
  - 5. Roof Panel, Roof Panel-to-Truss Connection
  - 6. Roof Rake, Roof Rake-to-Truss Connection Section 4. Sequence-defined Snap Cladding

- A. Snap-Clad Structure
- B. Interchangeable Snap-Clad Components
  - 1. Frame Valance Panels
    - A. Lower Floor Frame Valance Panel with Frost Edge
    - B. Upper Floor Frame and Roof Frame Valance Panels
  - 2. Column Cladding
    - A. Outside and Inside Corner Cladding
  - 3. Roof Ridge Cap The Following is a Detailed Description of Loq·kit Invention:

Section 1. A New Kind of Modular—Loq·kit Conceptual Framework

The word "modular", as it applies to the built environment, describes a strategy for bringing order and uniformity to a construction assembly. A modular construction assembly is regulated in a way that permits repetition in fabrication and assembly, and is therefore an efficient and economical construction methodology. However, because such a system is based on the recurring use of regular components, sameness in final configuration is often the result. For example, when applied to housing, modular systems often produce houses that are nearly identical in layout and appearance. The Loq·kit component system is a modular building system—yet introduces new conventions for regulating structure in order to provide flexibility. The new Loq·kit concepts enable a limited number of components to take on a near limitless variety of final configurations. The three concepts that follow explain how the Loq·kit modular framework departs from conventional grid-based design thinking in order to achieve unprecedented system flexibility.

A. FIG. 7A—Large Dimension (prior art) vs. FIG. 7B—Small Dimension (Loq·kit)

FIG. 7A represents a conceptual layout grid typical of current thinking regarding modular housing applications. FIG. 7B shows the Loq·kit grid. The drawings together, demonstrate the difference in scale between the two approaches. The Loq·kit grid establishes system dimensions that are much smaller than those typically considered in modular applications for architecture. In general, the relative scale of the Loq·kit grid is about one-tenth that of other modular housing applications. Commonly, modular dimensions share a similarity in size with raw building materials in order to limit the modification of materials during construction. For example, a typical system may employ modular wall panels that are based on repetitive 8'-0", 10'-0", or 12'-0" bays. These large modular dimensions easily accommodate typical wood stud lengths and common sheet-good sizes—which are typically 8'-0" or 10'-0" in length. The large modular sizes, represented by module A in FIG. 7A, are generally many feet wide, and share a scale relative to wood construction materials. For this reason, a small modular dimension may appear counterintuitive due to an implied increase in fabrication time and cost. While conventional modular dimensions nearly always take on distances of many feet, the largest Loq·kit module is only 11". It is represented as module A in FIG. 7B. As will be described later, this distinction is very important to note because conventional modular layouts (or grids) dictate exterior wall lengths, or wall panel dimensions—whereas the Loq·kit grid identifies possible component connection locations, without explicit reference to wall dimensions at all. In essence, it is the small-dimension grid that creates the Loq·kit component system's versatility because many more connections are possible over a given area—each one capable of changing the end result—while maintaining the efficiency of the overall system.

B. FIG. 8A—Repetitive Module (prior art) vs. FIG. 8B—Alternating Sequence (Loq·kit)

Figure 8B:
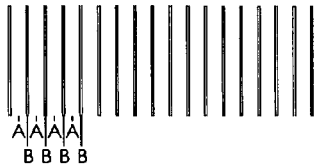
FIG. 8B Shows a diagram of the Loq·kit grid with its alternating A,B,A,B sequence of lengths used to regulate building component dimensions.
Figure 9A:
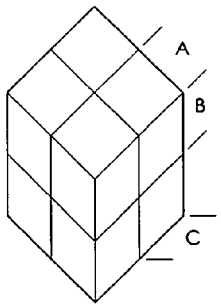
FIG. 9A PRIOR ART
FIG. 9A Shows a diagram of a conventional modular grid applied to three dimensions (prior art).
Figure 9B:
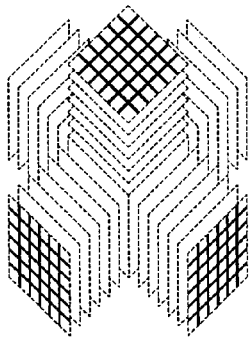
FIG. 9B Shows a diagram of the Loq·kit grid, and its alternating sequence, applied to three dimensions.

FIG. 8A shows the spatial sequencing of conventional modular technologies compared to that of Loq·kit, shown in FIG. 8B. Current modular construction techniques employ a conceptual grid that is defined by same and repetitive modules, shown as "A". However, the Loq·kit grid is characterized by an alternating modular sequence. With the conventional grid, the line between modules marks the location where a structural efficiency in planning may be realized. When the structure is erected, the line may designate the location of a column, or beam, for example. Hence, the line between modules represents a unique condition—one where building materials are connected to each other. For example, during the building's construction, the grid line may mark a wall panel-to-wall panel connection, or a column-to-beam connection. What is important to note is that the grid lines of a typical modular grid, mark locations where materials will be connected to each other, in one way or another, to optimize structural efficiencies. Yet, each connection's own space requirements are left undefined and unrepresented by the grid. The result is a system where modular dimensions (determined by multiples of "A") are defined independently of an assembly method. Because various types of connections between building materials are needed to erect a home—each with its own, and often varying spatial needs—modular system dimensions are difficult to maintain with a conventional grid. In most cases (if not all) efficiencies afforded by standardization are limited, and materials remain unrelated, with a conventional modular grid.

The Loq·kit grid as shown in FIG. 8B, by contrast, establishes a regular connection size "B", and therefore incorporates an assembly methodology into the regulation of component sizes. All connection spatial needs are dictated by the grid. The result is a planning grid with modules laid out in an A,B,A,B rhythm—Loq·kit's alternating sequence.

C. FIG. 8A—System Dimension (prior art) vs. FIG. 8B—Connection Location (Loq·kit)

As mentioned above, conventional modular technologies, as shown in FIG. 8A, employ a grid where the module A represents, rather explicitly, a defined and regular system dimension—and overall building dimensions are determined as a multiple of module A. For example, structural column locations may be assigned to the intersection of every other module, whereby exterior wall lengths are made regular at a length of 2A. With the Loq·kit sequence, shown in FIG. 8B, a standard connection size "B" is defined, and possible connection locations are separated by a common distance "A". The result is a conceptual grid that establishes a series of possible connection locations along its length in each direction. Because a wall panel, or the distance between structural columns for a typical house is much larger than the Loq·kit A module, the module doesn't serve to inform the size, shape, or location of the building's footprint. In other words, overall system dimensions are not clearly defined by the Loq·kit grid—as the A module establishes only the distance between a series of connection locations along lines in space. With a conventional grid, system dimensions are directly informed by the grid. There is a subtle, yet very important distinction here, that produces an unprecedented amount of flexibility within the Loq·kit modular system.

D. Application of the Above Three Concepts

Based on the descriptions above, a conventional modular grid-based system for establishing uniformity and efficiency in design can be characterized by a large scale (relative to Loq·kit), repetitive grid that establishes overall system dimensions. In turn, the Loq·kit grid is a small-dimension, sequentially-alternating grid that establishes connection sizes and possible connection locations. FIGS. 9A and 9B illustrate the above three qualifiers as they are applied in a third dimension to reflect applications in the built environment. Conventional modular construction technologies are represented in FIG. 9A. The drawing shows a 3-dimensional grid that incorporates the module A, as previously described (or may utilize unequal modules), into a framework that identifies critical overall wall, panel, and other system dimensions. With this 3-dimensional grid—size, shape, and volume are controlled by establishing "building modules" that are based on multiples of the original module A.

Consider now FIG. 9B—an illustration of the above concepts applied to Loq·kit construction in the third dimension. The result is a framework of possible connection locations along lines in space. At this point, all panel, wall, or building dimensions are undefined, yet regulated, by the system. "Building modules" that establish overall size or volume are unassigned within this grid based only on connection location. Consequently, within the 3-dimensional Loq·kit grid, a variety of modular components can be placed and organized into a near limitless number of configurations—while the grid itself places relatively little constraint on the building shape, size, or volume. This is contrary to the limited possibilities obtainable by a conventional modular grid.

Section 2. Sequence-defined Structure

Previously, Section 1 described three important distinctions between a conventional modular grid and the Loq·kit grid. The grids are the conceptual framework on which the construction technology is applied. The Loq·kit building component system, taken as a whole, is a vastly different construction technology than preceding modular home construction technologies—and is far more flexible. As pointed out earlier, a modular construction system introduces uniformity and efficiency in assembly, and is therefore a desirable strategy for offering lower cost to the marketplace. While a conventional modular system's strength lies in its structural efficiencies, it is generally a technology that produces sameness in layout and appearance, and in that respect is less desirable to consumers than more custom-assembled construction technologies. The Loq·kit component system is a flexible, modular system that can offer cost savings and custom layouts and appearance. The flexibility of the Loq·kit system is based on the small-dimension, sequentially alternating grid—as previously described—as well as the interaction of building structure with the 3-dimensional grid. Two important concepts follow, and reveal how Loq·kit building structure interfaces with the grid to produce tremendous flexibility.

A. Sequence-defined Structure Part One—House Column Locations

Figure 6:
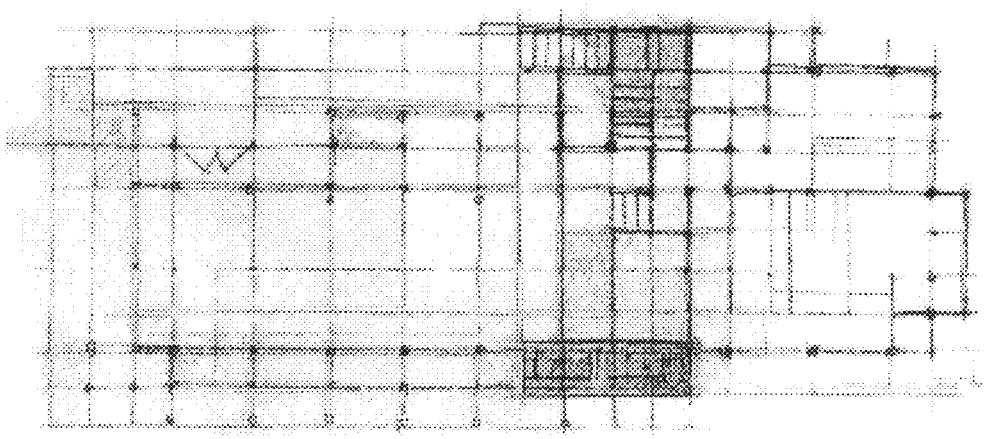
FIG. 6 PRIOR ART
FIG. 6 Shows an example of a regulating grid used to create and identify structural efficiencies in the layout of a building's structure. It is presented as a reference image of prior art.

The planning and erection of a Loq·kit home begins by locating the building's structural columns. The column locations establish and inform the limits of the building's perimeter. The Loq·kit component system incorporates new ideas regarding building column locations within a modular, or grid layout. Consider FIGS. 10A and 10B. A modular system that is based on the conventional use of a grid is one that establishes the location of structural columns at the intersection of gridlines—see FIG. 10A, or refer back to FIG. 6 for a practical application of this approach. When structural columns are placed at the perimeter of a building, the space between columns represents the limits of an exterior wall. As described earlier, with a conventional column-on-gridline layout, system dimensions are defined without incorporating a methodology for material connections. Connections between materials are indirectly implied, but are not regulated by the layout—resulting in a system where the placement of building structure is modular within the layout, yet other system components, such as walls, doors, or windows, are not expressly governed by the grid. The Loq·kit component system however, is based on a grid layout where structural columns are located at the midpoint between gridlines, refer to FIG. 10B. In this location, the distance from column centerline to a connection location (module B) is equal in each of four directions. With this approach, a column can be located at any midpoint between gridlines, where a connection to an exterior wall can occur in each of four directions without adversely affecting the modular dimensions of adjacent system components. FIG. 11 shows the four standardized ways in which a structural column can be enclosed within an exterior wall. Each of the columns illustrated in FIG. 11 occupy a unique position within the wall—either at a building corner, a T-intersection, a four-way intersection, or in-line. In each case, the connection to an adjacent wall (simplified connections are shown hatched) occurs at the same distance from the column, and by way of the same connection size—without interrupting the A module on the opposite side of the connection. In each case, the module A is unaffected. The result is a system where the placement of columns into the assembly does not interrupt other modular system dimensions.

To sum up the distinction made above, it can be stated that with a conventional column-on-gridline layout, the placement of a structural column produces a unique condition at its connection with the wall. By accommodating the column, the system loses uniformity. Yet, Loq·kit columns—located at the midpoint between gridlines—are able to be inserted at any point while maintaining overall system uniformity and efficiency. To illustrate this, the effect of in-line column (columns engaged with a wall on opposite sides) placement is considered, followed by building corner column placement.

1. FIGS. 12A and 12B—In-Line Column Connections

FIGS. 12A and 12B demonstrate how the placement of an in-line column within a wall assembly can affect system modularity. FIG. 12A describes a conventional column-on-gridline modular layout. When a column to wall connection is accounted for in this arrangement, the wall dimension must be reduced by half of the column width, as well as the specific connection dimension required to secure the column to the wall. In effect, the portion of wall that is connected to the column becomes a typical within its layout. For example, the conventional column-on-gridline layout shown in FIG. 12A highlights these particular connection conditions—where the modular dimensions of a wall segment are disturbed by connections at either side. In the drawing, wall panel 1 is reduced by half of the column width (dimension x), a column to wall connection (dimension y), and a wall panel to wall panel connection (dimension z). In this layout, the distance between column centerlines is modular—at a dimension of 4A, yet wall panel 1 and wall panel 2 are no longer uniformly modular within the structural system, or with each other.

Consider now the Loq·kit alternating/small-dimension modular grid with off-gridline column location shown in FIG. 12B. In this system, connection dimensions and locations are assigned by the grid. Columns can be placed at any point between gridlines in the A module and wall panels will remain a multiple of module A plus any incorporated connection modules B. In other words, the insertion of columns into the layout does not interfere with the modular dimensions of adjacent system components—and walls will retain their modular dimensions. For example, the Loq·kit exterior wall shown in FIG. 12B is made of two modular wall panels placed between columns, similar to the arrangement shown in FIG. 12A. The overall length of wall panel 1 consists of three A modules and two connection modules, B, while the length of wall panel 2 is eight A modules and seven B modules. Because the connection dimension (module B) is assigned by the layout, wall panel lengths can be standardized as a function of the distance between connections at each side of the panel. Standard panel sizes are therefore determined as follows—where A=11 inches and B=1½ inches:

| Modular Length | Equivalent Unit Length | Standard Dimension |
|---|---|---|
| A | 11" | 11" |
| 2A + B | 2(11") + 1½" | 23½" |
| 3A + 2B | 3(11") + 2(1½") | 36" |
| 4A + 3B | 4(11") + 3(1½") | 48½" |
| 5A + 4B | 5(11") + 4(1½") | 61" |
| 6A + 5B | 6(11") + 5(1½") | 73½" |
| 7A + 6B | 7(11") + 6(1½") | 86" |
| 8A + 7B | 8(11") + 7(1½") | 98½" |

In this table, the relationship between dimensions remains modular, while the exact panel dimensions vary. Returning back to the example shown in FIG. 12B, wall panel 1 is a standard 36" in length, and wall panel 2 is a standard 98½" in length. Furthermore, because the columns are separated by a modular series of possible connections, the distance between their centerlines is modular within the same system as the wall panels.

2. FIGS. 13A and 13B—Corner Column Connections—Rotating the Module 90 Degrees FIGS. 12A and 12B illustrated how the insertion of an in-line column can affect the modular dimensions of wall panels connected to the column. With the conventional grid the column's placement interrupts the modularity of in-line-column-connected walls. With the Loq·kit grid, in-line columns are incorporated into the system's modular layout.

Just as the placement of in-line columns will disrupt a system based on a conventional modular grid, the placement of building corner columns create similar problems for the conventional grid layout. As shown in FIG. 12A, the column width and connection space requirements effectively reduce the wall panel width of panels adjacent to the column—producing an a typical panel dimension—one that is not modular within its own system. This condition is produced on either side of the column centerline. In the same way, an a typical wall panel width is created at each panel that is connected to a corner column—See FIG. 13A. With the Loq·kit grid, as illustrated in FIG. 13B, building corner columns are incorporated into the layout in a way that enables adjacent wall panels to remain modular within the system. In the drawing, the wall panels adjacent to the column are each comprised of full A and B modules, and are accordingly modular—as described in FIG. 12B.

B. Sequence-Defined Structure Part Two—Structural Frame

FIGS. 12A and 12B showed that the Loq·kit alternating modular grid and off-gridline column location results in a modular system of wall panels that are regulated in the x and y-axis (length and width) by a typical module A and incorporated connection distances, module B. Again, the result is a modular sequence of A, 2A+B, 3A+2B, 4A+3B, 5A+4B, and so on.

Figure 1:
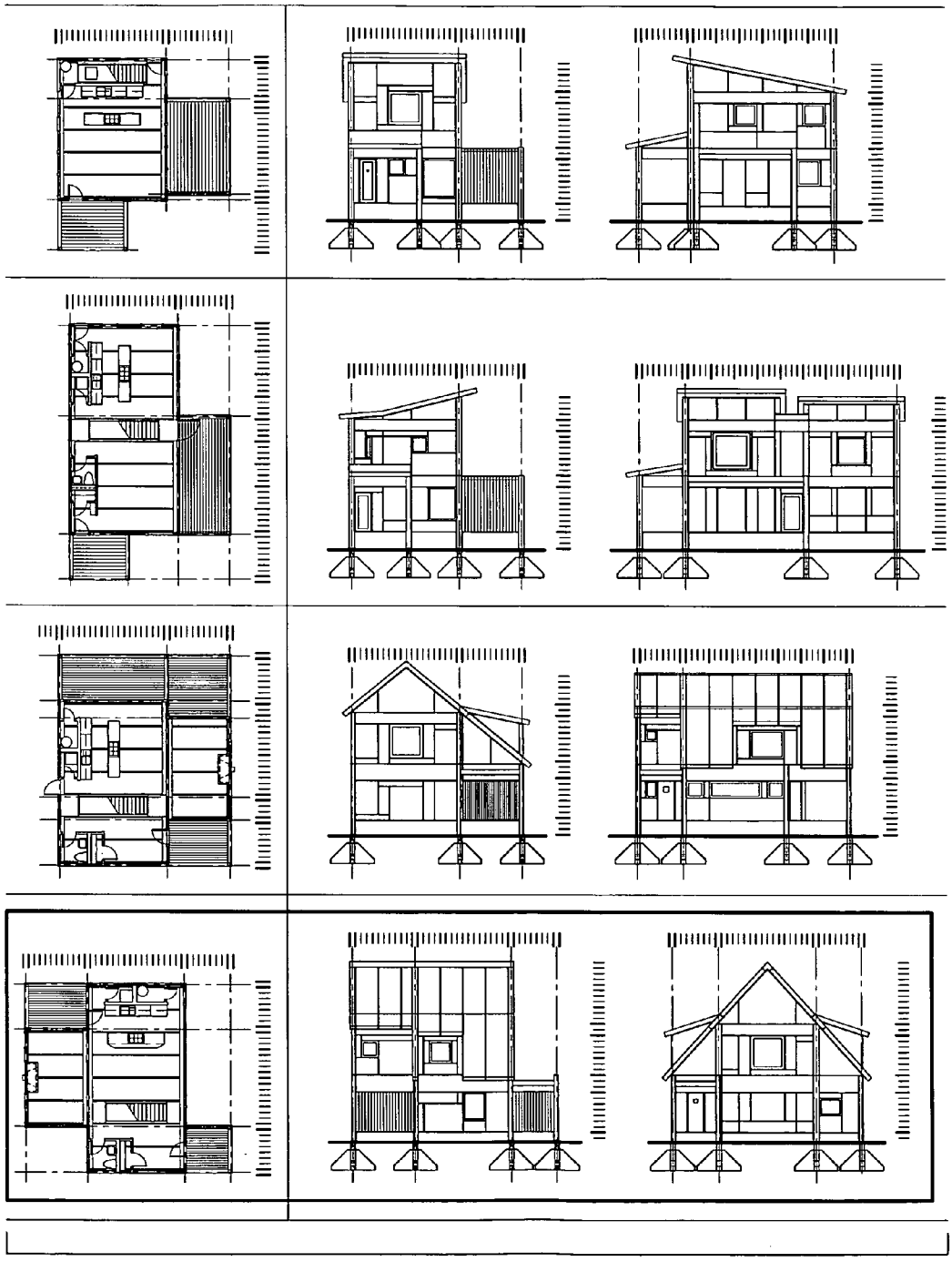
Figure 2A:
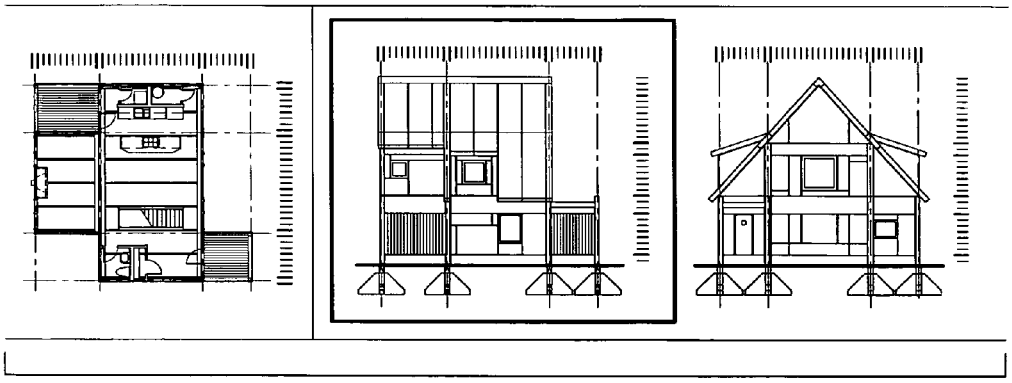
Figure 2B:
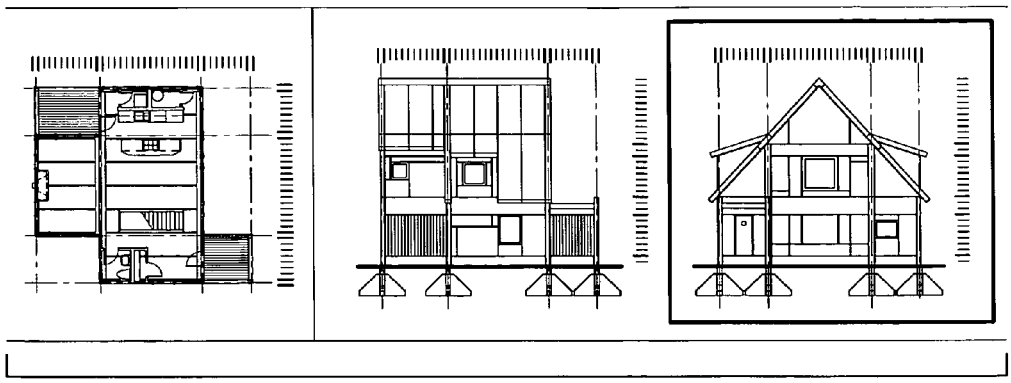

This modular sequence is also employed in the z-axis (vertical dimensions, refer to FIG. 9B) of a Loq·kit home's structural steel frame and wall/roof panel system. The modular steel frame provides the support for the floor panels, wall panels, and roof panels that enclose the structure. By applying the modular sequence in the third dimension (vertically), system relationships are made uniform throughout the structure. To maintain system uniformity, modular vertical and horizontal dimensions are shared between the structural frame and the in-fill areas that enclose a Loq·kit structure. In this way, a Loq·kit home has a modular frame and modular wall/roof panel system that is integrated with each other and allows many final configurations—as well as component sharing between structures. To maintain system dimensional relationships between structure and in-fill areas, a Loq·kit structural frame is represented in the z-axis by two zones—the free-facade zone and the structural zone. FIG. 14 shows an elevation drawing of a Loq·kit structural frame. The drawing illustrates the frame assembly for the house shown earlier in FIGS. 3 and 4. FIG. 2B is shown above the frame, and again a box enclosing the side elevation describes the orientation by which FIG. 14 is viewed. Those parts of the frame assembly that are shown dashed are provided in order to clarify how the structural frame members and columns are arranged within a complete building system—one resembling the final arrangement shown in FIG. 2B—yet, it is only the frame members and columns that will be described at this point. The frame drawing shows the alternating modular sequence along the horizontal and vertical axis, and shows the vertical axis further divided into either a structural zone SZ, or a free-facade zone FFZ. Each of the two zones is regulated dimensionally by the alternating grid sequence. Representing the area, or space, between structure on the bottom, top, and sides of an in-fill exterior wall is the free-facade zone (marked by FFZ in the drawing). This wall area does not carry significant structural load and can accommodate many arrangements of modular exterior wall, window, and door panels. The structural zone SZ is representative of the depth of the structural frame at each floor level, and dimensions are set to correspond with appropriate locations along the alternating vertical grid. Therefore, building structure, as well as in-fill exterior walls, can be regulated to share dimensions within any final configuration. In the drawing, R designates roof structure, and F, foundation.

1. Structural Zone (with Integrated Header)

The structural zone consists of the area occupied by the structural steel frame members that provide floor support and a structural header for windows below. FIG. 14 illustrates the relationship of the two-story steel frame with the alternating module in regulating z-axis dimensions (system vertical dimensions). In the drawing the structural frame members that support the lower and upper level floors are identical, and the depth of each component is a function of the A and B modules assigned by the alternating grid. To simplify and standardize structural system needs, the window opening header for a floor below is incorporated dimensionally within each floor frame. With the structural-integrated header, floor frames can be assembled rapidly—thus enabling floors to be installed—while all structural needs for any unique arrangement of exterior doors and windows is met as well. The height of a typical floor frame is always a function of the alternating-sequence, at 3A+2B. In the preceding table, this can be seen to be a modular system dimension of 36". By regulating the height of all exterior openings in this way, structure and in-fill become modular in the same system.

In turn, FIG. 14 also shows that the distance from the top of the frame member below to the bottom of the frame member above is also as modular dimension dictated by the alternating sequence (7A+6B, or 7'-2"). This distance represents the height of a typical free-facade zone—from the bottom of a door sill to the top of the highest window frame. FIG. 14 demonstrates the continuous relationship between structure and void along the z-axis alternating module.

C. Interchangeable Structural Components

A Loq·kit structural frame consists of a variety of components. The house presented earlier in FIGS. 1, 2A, 2B, 3 and 4, will serve as the example embodiment into which the frame components will be assembled in the following detail drawings. For purposes of describing the components and their interaction with each other, this will be the only configuration (embodiment) of the Loq·kit structural frame that will be exemplified in this specification. However, it is the spirit of this invention that other embodiments will be assembled from the standardized components by arranging them in agreement with the conceptual framework presented earlier in Section 1.

Loq·kit Structural Components

Figure 3:
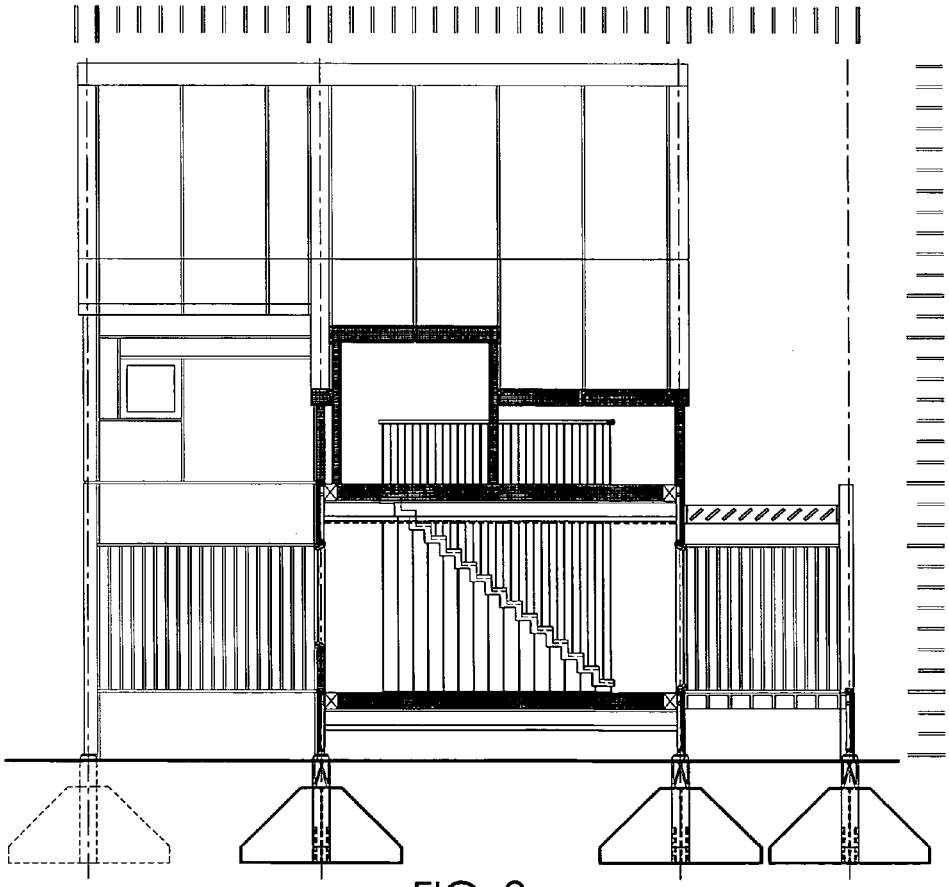
Figure 4:
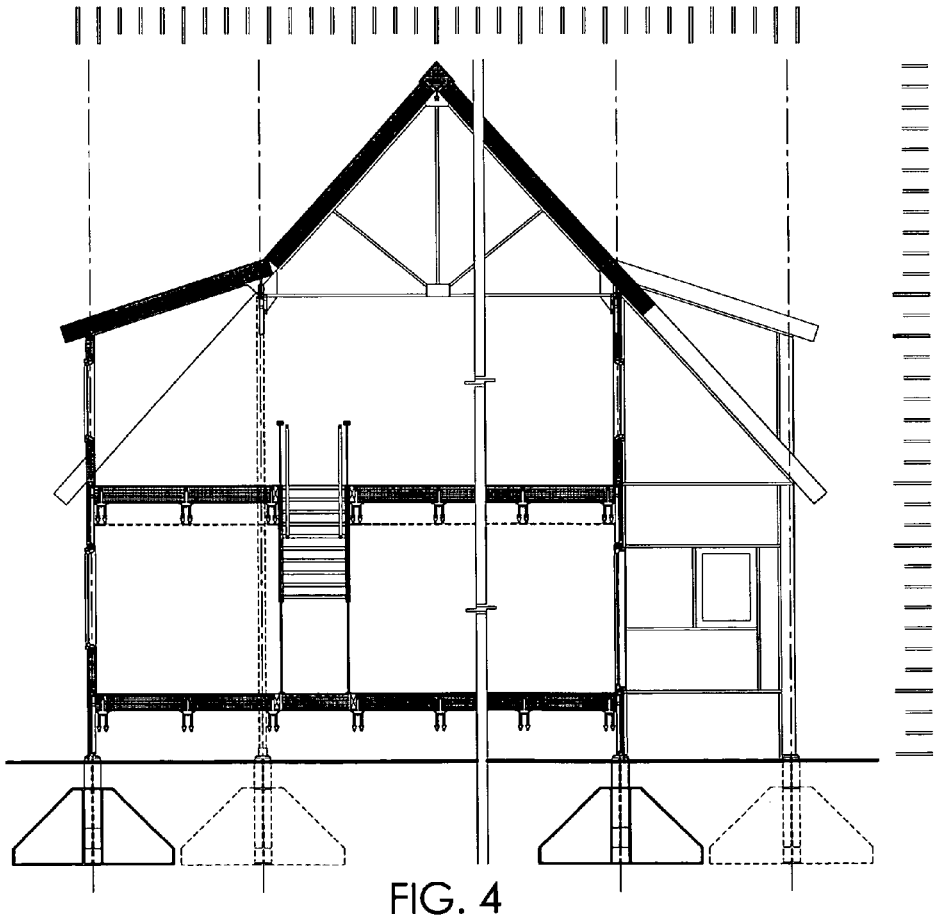
Figure 5:
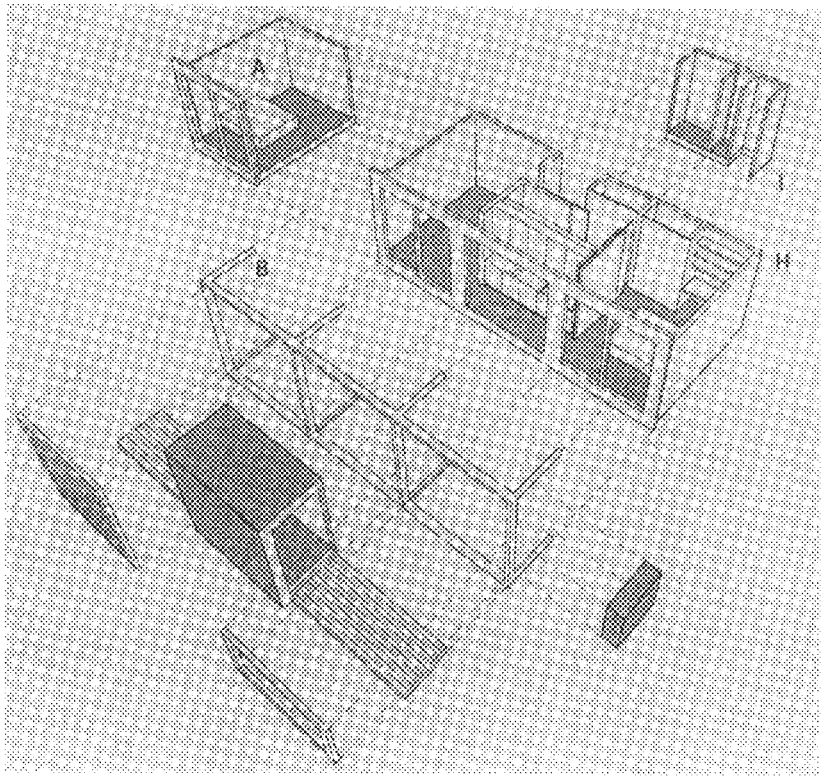
FIG. 5 PRIOR ART
FIG. 5 Shows an exploded view of an example of current modular construction technology. It is presented as a reference image of prior art.

FIG. 15 shows the structural system for the house presented earlier in FIGS. 3, 4, and 14. All structural components are clearly shown in the drawing, except for the roof rafters, and panel purlins, which will not be considered part of this invention, as they did not appear in the provisional application. Below, each of the structural components appearing in FIG. 15 are described in detail.

A. Trench Footing

A typical Loq·kit house rests on an arrangement of trench footings. An individual trench footing 1 is the structural component that transfers load from a column to the ground. Together, the trench footing arrangement supports the weight of the building structure and all materials/furnishings placed in it. Each trench footing is made up of three parts—a base 1*a*, a saddle 1*b*, and a cap 1*c*. These parts are illustrated together in FIG. 16. The cap 1*c* is fastened to the saddle with four bolt/washer/nut assemblies that are considered to be prior art. The footing works by distributing the column load through the base 1*a* and saddle 1*b*. These two components are illustrated in FIGS. 17 and 18 with typical top, front, and right side views. FIG. 17 shows a trench footing base 1*a*. This molded, fiber-reinforced plastic component is placed upright on the bearing soil, and saddle 1*b* is placed over it. The saddle is also a molded plastic component and arrives at the building site with cap 1*c* installed. The cap is a metal component. The trench footing assembly 1 is placed at the bottom of two intersecting, perpendicular trenches at the building site.

The method for determining trench footing 1 placement starts by locating the house's structural columns. FIG. 19 shows the locations of the structural columns (for the house illustrated in FIGS. 3 and 4) with respect to the Loq·kit grid. The column locations are determined based on space needs for the individual house design, and standardization with the modular grid. The column locations suggest the building's perimeter shape and control structural spans. The pattern of structural columns can vary widely, and is always influenced by aesthetic concerns with the house's exterior form and character—it is not simply a structural matter. To initiate construction, a pattern of cross-cut trenches is excavated. FIG. 20 illustrates the trench pattern that will accommodate the column layout shown in FIG. 19. In turn, FIG. 21 illustrates the final layout of trench footings and columns placed within the trenches.

The trench footing foundation concept is an affordable housing strategy. The trenches minimize site excavation while establishing protection against frost-heaving. The backfilled soil placed over the footings also provides resistance to uplift produced by high winds. The plastic material is a low-cost alternative to metal or concrete, and is light and easy for a laborer to manipulate at the building site.

B. Lower and Upper Structural Column

Loq·kit structural columns are of two varieties—a lower column 2, and an upper column 3. FIG. 22 shows each of the two column types. The columns support floor frames and roof frames. A Loq·kit structural frame is assembled by placing lower columns into the trench footings. The square-shaped lower column 2 fits into the square-shaped sleeve in the trench footing base cap 1*c*. A male connector can be seen at the bottom of column 2 in FIG. 22. Once inserted into the base cap 1*c*, a lower column is pinned to withstand uplift forces by a frame bolt assembly 4*h* placed through the common hole in the base cap and column. Each column arrives on-site with all required holes pre-drilled, enabling the correct assembly height of the floor or roof frame members. By pre-drilling at the factory, the site-installed height of the frame members will align with their required location along the alternating modular sequence. Lower columns are installed first. They will serve the structural needs for all one-story buildings. With a one-story configuration, the lower columns will provide the correct installed height for the floor frame members and the roof frame members. Should a two-story configuration be desired, upper columns are placed into the top of the lower columns. Each upper column 3 has a male connector (similar to the lower column male connector) that can be inserted into the top of a lower column. This connection is also pinned against uplift by placing a frame bolt assembly 4*h* through the common hole in both columns. The stacked columns will assure the correct installation height of the lower floor frames, upper floor frames, and roof frames. All Loq·kit structures are composed of the two-part (upper and lower) column arrangement. Based on this system, one-story structures can be converted into two-story structures by moving the roof frame members up, and purchasing upper level floor framing members. Likewise, two-story structures can be converted into one-story structures by eliminating the upper level framing and the upper columns.

C. Floor Frame

The Loq·kit floor framing members transfer the weight of the floor from the floor joists to the columns. Floor frames vary in length, and are standardized incrementally according to the Loq·kit grid. Their height is also standardized with the alternating-sequence at 3A+2B, or 36". A typical floor frame 4 is illustrated in FIG. 23. In the drawing, the frame can be seen from the front (slowing the entire span, or length, of the frame) as well as the side. The side view of the frame is shown in the dashed box, and to the right in FIG. 23. The end of the floor frame and its side view are shown again, enlarged, in FIG. 23A. The front of the frame end is on the left, with the frame's side view to the right. The drawing shows the components that make up a typical floor frame 4 assembly. These components are: bearing flange 4*a*, frame web 4*b*, top flange 4*c*, support bracket 4*d*, bracket gusset, 4*e*, bottom extrusion 4*f*, and top extrusion 4*f*.

The metal components of a floor frame 4 distribute the floor load to the columns. The metal components are the bearing flange 4*a*, on which the floor joists rest, the frame web 4*b*, top flange 4*c*, and support brackets on each end, composed of support bracket 4*d* and bracket gusset 4*e*. The bottom extrusion 4*f* and top extrusion 4*f* are plastic components attached to the metal flanges by plastic retainers. The retainers snap into holes common to the flange and extrusion, and are not part of this invention. As their name reveals, bottom extrusion 4*f* and top extrusion 4*f* are extruded plastic components. They serve to attach both in-fill components and snap-cladding. Their function will be described in detail further on in this specification.

D. Floor Joist Clip

FIGS. 23 and 23A also show a part that has been unmentioned at this point—joist clip 5. It is also shown enlarged in FIG. 24A. This component serves to attach a floor joist to the floor frame. The extruded plastic joist clip 5 is attached to the floor frame 4 with a metal clip. The metal clip is snapped over a common hole in the joist clip 5 and floor frame bearing flange 4*a*. The hole is visible in FIG. 24B. The clip that retains the joist clip is not a component of this invention. The joist clips 5 are factory installed on the bearing flange 4*a* and are made of a heavy-gauge plastic. Each joist clip has a bottom 5*a* and a top 5*b*. These two parts can be seen together in FIG. 24A. The joist clip bottom 5*a* and top 5*b* are factory-hot-welded together. The joist clip is 2" deep front-to-back—this dimension matches the bearing flange 4*a* depth. This can be seen in FIG. 23A.

E. Floor Joist

A Loq·kit floor joist 5 has an unusual shape. It is composed of two folded metal sheets of the same profile that are factory welded together. The folded metal components that make up a floor joist can be seen in FIG. 24. This drawing shows the end view of two same joist halves 6*a*. Each joist half 6*a* is the same length, and one is simply rotated 180 degrees to produce a mirror image. The joist halves 6*a* are then welded together. FIG. 24 does not show the length of each half—it only shows the end view. To see a joist presented in three dimensions, refer back to FIG. 15.

A section-cut of a typical floor joist 6 is shown in FIG. 24A. It appears above a joist clip 5 that is attached to a floor frame bearing flange 4*a*. FIG. 24A illustrates the connective interface between floor joist 6 and floor frame 4. It is a snap-lock connection. To install a floor joist into a Loq·kit assembly, the joist 6 is pressed into the factory-installed joist clip 5. The joist clip 5 provides a controlled, sequence-specific location to install the joist 6. It also provides protection against uplift forces, as well as a releasable connection with the joist. To remove the joist 6 from the joist clip 5, the ears of the clip are spread and the joist is pulled up and out of the assembly.

The unusual shape of the floor joist 5 serves several purposes. As described, it provides for a snap-lock interface at its connection to the floor frame. The dual-pronged shape also works to resist torsional forces on the joist. Not only is the joist cross-section wide (compared to conventional floor joists or floor trusses) in relation to its height, but the prongs provide a secured condition at each end. When force is applied to one side of the joist, the prong on the opposite side provides resistance to uplift. It is anticipated that this concept will eliminate the need for structural bridging between the floor joists. Additionally, the dual-pronged shape enables ceiling panels of standardized width to be snapped tightly into place. This will be described in the in-fill portion of this specification. Lastly, when a ceiling is installed (ceiling installation is optional with this system), the void between the prongs is open to the floor below. Therefore, it is able to perform as the conduit for lighting installation and attachment.

FIG. 24B shows a floor joist 6 secured in its position at the end of a floor frame 4. The floor frame is attached to column 2 (although frame bolts 4*h* are not shown). The column sits in a trench footing base cap this drawing is presented in order to provide further representation of the components and their interface conditions.

The floor joist's 5 unique shape provides a working example of multifunctional form—a concept written about in previous Loq·kit documents, and included in the provisional application. Multifunctional form is a term that describes the design and production of components that have physical characteristics allowing many different interfaces simultaneously. It is a strategy for increasing flexibility, while limiting the number of components in an assembly. Ideally, it is the pursuit of component shapes that do not rely on external fasteners, and are designed to work in varying interface environments. The in-fill and snap-cladding systems that will be described later also illustrate the use of this strategy.

F. Roof Truss Frame

A Loq·kit roof truss frame, or truss frame 7, is similar in appearance and function to a floor frame 4. FIG. 25 shows a typical truss frame 7. The drawing positions a truss frame 7 front view to the left of a side view (right)—similar to FIG. 23 presented earlier. The information located in the dashed box at the right of FIG. 25 is shown enlarged in FIG. 25A.

The height of a truss frame 7 is the chief characteristic that distinguishes it from a floor frame. Whereas a floor frame 4 is 3A+2B, or 36", in height—a truss frame 7 is 2A+1B, or 23½" tall. The truss frame 4 is shorter, while both are standardized as a function of the alternating sequence. As with a floor frame 4, truss frame 7 lengths vary, and are also standardized according to the alternating sequence.

FIG. 25A identifies the components that make up a typical truss frame 7: bearing flange 7*a*, truss web 7*b*, top flange 7*c*, support bracket 7*d*, bottom extrusion 4*f*, and top extrusion 4*f*. Similar to a floor frame 4, the metal components are the bearing flange 7*a*, truss web 7*b*, top flange 7*c*, and support bracket 7*d*. The bottom extrusion 4*f* and top extrusion 4*f* are extruded plastic components that are held to the top flange 7*c* by plastic retainers. The retainers are not part of this invention. The bottom and top extrusion is installed on the truss frame 7 at the factory. They will work to correctly position in-fill and snap-cladding, as well as provide the joinery necessary for making snap-lock connections to these components. The function of the extrusions will be detailed further on in this specification.

G. Roof Truss Clip

FIG. 25A shows a Loq·kit roof truss clip 8 positioned at the end of a truss frame 7. The roof truss clip 8 works to strap-down a roof truss end to the truss frame top flange 7*c*. A roof truss clip 8 is made up of three components: two folded light-gauge metal truss guides 8*a*, and a folded heavy-gauge metal guide bracket 8*b*. The truss guides are the same physical shape, yet one is flipped to face the other. Both are factory-welded to the guide bracket 8*b*. The guide bracket 8*b* (with attached truss guides 8*a*) is pressed onto the truss frame top flange 7*c*, in the correct location by factory workers. This enables the truss frame 7 to be dropped off at the building site with all roof truss locations correctly identified for the house's unique design and layout.

H. Roof Truss Seat

The connection of a roof truss to a truss frame 7 is produced by two Loq·kit components—a roof truss clip 8, described previously, and a roof truss seat 9. FIG. 25A shows a roof truss seat 9 installed on the truss frame bearing flange 7*a*. It is illustrated as a front view and a side view in the drawing. The roof truss seat is site-installed by an assembler just below the roof truss clip 8 at all roof truss locations. The installation of a roof truss will be described under the following Roof Truss heading.

A roof truss seat 9 is made of two parts: a steel gusset seat 9*a* and a metal seat clip 9*b*. The two pieces are factory-welded together. The roof truss seat 9 provides the bearing surface on which a roof truss sits. It transfers the roof load to the structural frame. Each truss seat 9 is pushed over the lip of the truss bearing flange 7*a* during assembly. The bearing flange 7*a* is pre-drilled at the factory with ½" diameter holes along its lip. The holes are sequenced for the correct placement of roof trusses and roof panels—whose positions are informed by the alternating sequence. A roof truss seat 9 is pushed over the lip and onto a hole—and a tab in the seat clip 9*b* catches the hole's perimeter edge to ensure correct placement of the seat. This method of clip attachment is common in the automotive industry and its functionality is not part of this invention. Its description serves to identify the incorporation of a simple attachment methodology that enables a very high level of accuracy in component placement, while allowing for slight amounts of adjustment during assembly. It is also a releasable connection. Lastly, truss clips 9 are placed into a building assembly after a roof truss has been inserted though the truss guides 8*a*. They are shown in FIG. 25A as part of a typical assembly, yet would not be placed in practice along the truss bearing flange 7*a* until a roof truss has been installed in the corresponding truss guides 8*a*.

I. Roof Truss

A Loq·kit roof truss 10 may be of many varieties and sequence-defined lengths. Roof trusses play a large role in creating the exterior character of a house, and variety is important when offering consumers the ability to customize a unique look. Consequently, the roof truss illustrated in FIG. 26 represents a common dual-pitch Loq·kit roof truss. Its use creates a familiar gable roof form, as illustrated in FIGS. 2A and 2B—while other roof forms can be achieved with alternate truss configurations.

The roof truss 10 configuration illustrated in FIG. 26 is made up of the following components: top chord half 10*a*, gutter liner 10*b*, top gusset 10*c*, center web bar 10*d*, side gusset 10*e*, side web bar 10*f*, bottom gusset 10*g*, bearing gusset 10*h*, and bottom chord 10*i*.

Because roof truss configurations vary to accommodate unique roof forms, the layout of individual truss components is unimportant for purposes of describing Loq·kit invention. Of importance to this specification is the shape of top chord half 10*a*, bearing gusset 10*h*, and bottom chord 10*i*. The introduction of gutter liner 10*b* is also new. These four component shapes, as will be described, highlight Loq·kit roof truss invention.

FIG. 26A shows a cross section of the roof truss bottom chord 10*i* members illustrated in FIG. 26. This is a typical Loq·kit roof truss bottom chord cross section. The drawing shows two hooked, or J-shaped, metal bars spaced apart from each other by a gusset thickness—in this case bottom gusset 10*g*. The bottom chord 10*i* members are welded in the middle and at each end to a gusset of common thickness. The upturned edge of bottom chord 10*i* provides two hooks at each end of roof truss 10 for securing it tightly to a roof truss frame 7. To illustrate this connection, FIGS. 27A, 27B, 28A, 28B, and 28C are provided.

FIG. 27A shows a cross section of roof truss 10 positioned above the front of a typical truss frame 7. FIG. 27B illustrates the side view of this arrangement of parts. For purposes of this example, it will be assumed that truss frame 7 has been secured to a column, as part of a typical Loq·kit structural assembly. A detailed description of the installation of a typical roof truss 10 follows.

A roof truss 10 is installed by lifting it above its connection location on a truss frame 7 as shown in FIG. 27A (from the front), and FIG. 27B (from the side). The truss is then lowered by the assembler, ensuring that the bearing gusset 10*h*, at each end of the truss, moves slowly through roof truss clip 8. The arrow in each drawing illustrates this downward movement. As the truss is lowered, the elongated truss guides 8*a*, will help to direct the truss bearing gusset 10*h* toward its intended position on the truss bearing flange 7*a*. The truss will be lowered until the bearing gusset 10*h* sits directly on the bearing flange 7*a*. At this point during the assembly, the truss J-shaped truss bottom chord members 10*i* will have passed through joist clip 8, by briefly spreading apart the downward-turned top edge of each truss guide 8*a*. The roof truss seat 9 is then installed at each truss end to complete the assembly. To place the seat, the roof truss 10 ends are raised until the J-shaped bottom chord 10*i* members have made contact with the down-ward turned truss guides 8*a*. The roof truss seat is then pushed into place by placing the gusset seat 9*a* directly under the truss bearing gusset 10*h*, and pressing the seat clip 9*b* over the lip of the bearing flange 7*a* until the clip catches the hole in the bearing flange. The downward-turned truss guides 8*a* will stretch, or give, slightly in creating a very snug fit for the placement of the seat clip 9. FIGS. 28A and 28B illustrate the completed truss connection. FIG. 28C shows the strapped connection of the truss bottom chord. Once the seat clip 9 has been installed, the truss is secured against uplift forces, yet is laterally unstable. The roof truss stabilizer bar 11 must then be installed to complete the assembly of a rigid roof structural frame. In order to remove the roof truss from the structural assembly, the installation process is reversed.

The above example describes Loq·kit innovation regarding the shape of roof truss bottom chord 10*i* members and bearing gusset 10*h*. The shape of a Loq·kit roof truss top chord is also novel. An enlarged cross section of a typical Loq·kit top chord is illustrated in FIG. 26B. The top chord is composed of two metal top chord halves 10*a* separated by a gusset thickness. In FIG. 26B, the cross section is cut (refer to FIG. 26) so that top gusset 10*c* is visible beyond. The top chord halves 10*a* are factory-welded to each gusset—top gusset 10*c*, side gusset 10*e*, and bearing gusset 10*h*—and the space between them is open between them. Together, the gusset halves 10*a* create a fork-shaped, or U-shaped profile. The top edge of each "fork prong" is eased to enable plastic in-fill components to slip easily past this top edge. This will be described in detail further on in this specification. The U-shaped space between top chord halves 10*a* is lined with a thin plastic channel along the length of the top chord. This component is gutter liner 10*b*. It functions to divert water, should it penetrate roof seals, away from the house's interior. This also will be described in further detail in a later part of this specification.

Section 3. Sequence-Defined In-Fill

The Loq·kit component system utilizes sequence-defined structure to obtain a high degree of flexibility and variety in the layout of each home. This flexibility has been shown to produce many unique final configurations—each accommodating floor plan layout needs as well as exterior character development. To add a further level of design flexibility, all in-fill components are regulated by the same alternating-sequence. The result is a system of in-fill "panels" that may be placed in various configurations, and in harmony with all possible structural configurations. In this system, structure and in-fill accommodate each other with a same dimensional relationship. Each in-fill component is labeled a "panel" because each shares the same connection interface with like "panels" in the home. For example, a typical upper level floor panel may be substituted with a stair carriage at any location along a typical 207½", 220", or 231½" joist length—or a door or window of any size (dictated by the alternating-sequence) may be substituted for a wall panel arrangement that duplicates the window's size.

A. Free-Facade Zone

As illustrated previously in FIG. 14, a free-facade zone FFZ represents the distance along the z-axis (vertically) between the top of floor structure (door sill location) and the top of the highest window frame for each floor level of a home. This distance is regulated by the alternating module and is typically 7A+6B, or 7'-2". A free-facade zone is also represented in the x and y-axis by any distance along the plane of an exterior wall between two structural columns—which is also defined by the alternating module. As a result, a free-facade zone establishes a modular void into which an arrangement of wall, door, and window panels may be placed along a structure's exterior. The hatched area X, shown in FIG. 14 is an example of one possible configuration of a free-facade zone. Again, a free-facade zone is typically regulated in height to 7A+6B, or 7'-2", while its length is regulated by the distance between columns located along the modular sequence. For example, the free-facade zone represented by the hatched area X in FIG. 14, is presented again in FIG. 30. This drawing shows the height of the free-facade zone to be 7A modules plus 6B modules (7'-2"), and its length to be 16A modules plus 15B modules (16'-6½")—both of which are Loq·kit modular dimensions.

Having defined the spatial limits of a typical Loq·kit free facade zone, the in-fill area within this zone will now be described.

1. Modular Panels

FIG. 31 shows the gridlines of the Loq·kit alternating sequence superimposed over the free-facade zone illustrated in FIG. 30. This free-facade zone is composed of the typical 7A+6B height, with a length of 16A+15B. The length of a free-facade zone varies, yet is regulated by the modular placement of building structural columns, as discussed previously in Sequence Defined Structure Part One—House Column Locations. In turn, FIG. 31A is presented next to illustrate the way in which a free-facade zone can be divided into a unique arrangement of standardized in-fill components. The drawing shows the modular free-facade zone illustrated in FIG. 31. Essentially, the free-facade zone is the large area of an exterior wall that can be fitted with a variety of panel arrangements to enclose the structure. Dimensionally, Loq·kit wall, door, and window panels share a modular relationship with each other. The modular dimensions of the in-fill panels are also shared with the overall dimensions of any void created by the structural system that defines a free-facade zone. As mentioned previously, the maximum height of a panel located within the free-facade zone is 7A+6B, or 7'-2". Based on this limitation (the typical distance between metal floor frames), and the alternating module, standard panel dimensions can be determined. FIG. 32 shows the standard modular sizes for Loq·kit wall, door, and window panels. Beginning with the smallest distance between connection locations at each side, the smallest modular Loq·kit panel is 1A×1A, or 11" wide× 11" high. The next largest modular in-fill dimension is then 1A×2A+1B, or 11"×23½"—followed by the module of 2A+1B×2A+1B, or 23½"×23½". As the standard panel dimensions are progressively increased, each by one Module A in height, and in width, to create the square panel, the incorporated connection Modules B are included in the standard panel sizes. Consider the standard panel sizes shown in FIG. 32—each increase in overall panel size represents the addition of one Module A and one Module B to the overall height of the preceding smaller panel located in a vertical row. Each horizontal row of standard panels is ended with a square panel that results from adding one Module A and one Module B in width to the panel size preceding it in the horizontal row. All sequential increases in panel size include the incorporated connection dimensions. The result is a system of standardized panels that can be arranged upright or rotated (rotated panels are shown dashed) within a free-facade zone in order to place a panel edge along any desired line of connection within that free-facade zone. Additionally, these standardized sizes are applied to all wall, window, and door panels. In effect, by superimposing the alternating grid over the facade of a Loq·kit house (as demonstrated in FIGS. 31 and 31A), a homeowner can select a unique arrangement of wall, window, and door panel sizes and locations—suggested only by their imagination and the network of gridlines. Through the careful placement and rotation of the 28 standard panel sizes shown in FIG. 32, a homeowner can create a unique arrangement of walls, openings, colors, and textures along any length of a Loq·kit home in the pursuit of their unique vision home.

2. Personalized Facade

Personalization and affordability are the key values represented in each Loq·kit home. The modular panel dimensions make it possible to obtain a custom house design while utilizing mass-produced components. This modular-based strategy was employed throughout the design of the Loq·kit building components—yet is most visible on a home's facade. While wall, window, and door panels can vary in size and location, there are additional ways to personalize a home's facade. Through the action of shape and color, a facade can be personalized by including a choice of standard or custom panel colors. Also, the gradation of opacity to transparency can be employed to create a unique space or look by selecting from a variety of window screen-wall or translucent wall (or roof) panels. In these three ways—the interplay of solid and void (size and location of panels), the action of shape and color, and the gradation of opacity to transparency—a Loq·kit facade can be made visually interesting, expressive; and unique—and highly personal.

B. Other In-fill Components

C. Interchangeable In-fill Components

Loq·kit in-fill components enclose the space between structure. They may be roof, wall, floor, stair, door, or window. Again, each of these "panels" is regulated dimensionally by the Loq·kit grid's alternating-sequence. Because a common dimensionality is shared with building structure, in-fill components can be placed in a near-limitless variety of arrangements. Due to their snap-lock interfaces, in-fill components are easily detached from their assembly and can be placed into new or different configurations.

1. Floor Panel

A Loq·kit floor panel 15 is an in-fill component that provides the finish floor of a home. The floor panel also acts as the structure required for transferring floor loads to floor joists. A Loq·kit floor panel 15 is similar in cross-section to a common Structural Insulated Panel (SIP). SIPs construction is a "new" home building technology at use within the house-building industry. SIPs technology utilizes the stressed-skin principle—whereby a lightweight, yet load bearing structure results by transferring loads through a rigid core to an outer skin. Because of their efficiency in transferring building loads vertically through a structure, SIPs are most commonly used as an exterior wall system. Yet, due to the continuous bond between core and skin, SIPs are also effective when used as roof and floor structure. A SIP panel is made of a rigid insulating foam core, sandwiched between two continuous sheets of plywood or oriented strand board. As floor structure, SIP systems distribute loads efficiently with relatively few intermediate supporting members or joists, while allowing minimal deflection. The Loqkit floor panel 15 is based on this technology.

FIG. 33 shows a common Loq·kit floor joist 6 flanked by two floor panels 15. The assembly is presented in section. The side profile of each floor panels is represented. Although an entire panel cross section is not shown, the physical shape of a typical panel can be understood as having four edges that share the profile shown. Floor panels vary in width and length—yet, their lengths are always determined as a function of floor joist span, and their width is commonly 4A+3B, or 48½.

The Loq·kit floor panel 15 is made up of the following parts: top finish veneer 15*a*, panel top sheet 15*b*, panel insulation 15*c*, panel bottom sheet 15*d*, and bottom finish veneer 15*e*. Again, a typical floor panel can be most easily understood as a "SIP" panel that's size is regulated by the alternating-sequence. Yet is different from conventional SIP technology in the following ways: Loq·kit top 15*b* and bottom 15*d* sheets are not wood, but are plastic. Each sheet is laminated on its outside face with a thin plastic or laminate veneer. These veneers are top finish 15*a*, and bottom finish 15*e*. The finishes are selected by the homeowner prior to ordering the panel, and are the floor and ceiling finishes, respectively. This contrasts with current SIP technology, in that panels are shipped to the job site with interior and exterior finishes applied—while conventional SIPs are covered with field-applied interior and exterior finishes. Lastly the Loq·kit floor panel is unique in that a perimeter channel is cut into top sheet 15*a*. This panel allows for a snap-lock connection between floor panel and joist.

The attachment of Loq·kit floor panels 15 to a floor joist 6 is shown in FIGS. 33, 33A, and 33B. The drawings illustrate the snap-lock installation of the Loq·kit floor system. FIG. 33 shows a floor panel clip 16 just above the floor joist 6. The floor panel clip 16 is a plastic extrusion. It is slipped over the T-shaped extension at the top of the joist by factory installers, and each joist 6 arrives at the building site with clip 16 attached. After joist installation, the floor panels are laid between joists. To complete the assembly, a floor panel retainer 17 is pressed into the gap between the floor panels. The panel retainer 17 is made of three individual parts: a retainer top finish 17*a*, retainer body 17*b*, and retainer compression fitting 17*c*. The panel retainer body 17*b* is a plastic extrusion with an arrow-shaped extension at the bottom. When the panel retainer 17 is pressed into the gap between floor panels 15, the arrow-shaped extension engages the projecting arms of the panel clip 16. The compression fittings 17*c* on each side of the panel retainer 17 provide a snug fit by pulling the arrow-shaped extension upward—therefore, firmly engaging the arms of the panel clip 16. The floor panels at each side of the joist are firmly connected to the structural assembly once the panel retainer 17 is pressed into place. The assembly sequence just described is illustrated in FIGS. 33A and 33B.

4. Ceiling Panel

A Loq·kit ceiling panel is an optional interior finish component. Their installation hides the exposed undersides of the galvanized steel floor joists. Because floor panels 15 are manufactured with a bottom finish veneer 15*e*, ceiling panels are somewhat superfluous within a Loq·kit assembly. However, they do offer consumers with another degree of design flexibility. FIG. 33 shows the side ends of two ceiling panels 19. The ceiling panels are shown dashed because they are optional. A ceiling panel is made up of: a finish veneer 19*a*, a panel core 19*b*, and a panel clip 19*c*. Ceiling panel 19 sizes are regulated by the alternating-sequence, and match the dimensions (width and length) of the floor panel that rests above them in an assembly.

Ceiling panel 19 component materials are: plastic finish veneer (19*a*), plastic core (19*b*), and extruded plastic clip (19*c*). The installation of a ceiling panel 19 is accomplished by aligning the panel clip 19*c* (at each side of the panel) with its corresponding floor joist prong, and then pressing the ceiling panel onto the joist.

3. Stair Carriage

In a Loq·kit assembly, the stairway to an upper level is an in-fill component. Its placement within an assembly can occur at any location between standard 4A+3B spaced floor joists—as long as joist span and stair carriage 18 length are coordinated by the home designer. The smallest floor joist 15 length that will accommodate a stair carriage 18 is 207½". This joist span corresponds with a column spacing that produces an in-fill length of 16A+15B, or 198½". It is the smallest joist span that will provide the length required by a US-building-code-complying stairway—that conforms to a rise of 10A+9B, or 123½". There are two other floor joist 15 and accompanying stair carriage 18 lengths. These lengths are identified by adding 1A+1B, and 2A+2B to the stated joist and column spacing requirements.

A Loq·kit stair carriage 18 is made up of a metal frame that hangs between floor joists. Although include in the provisional application, at the time of this writing, the stair carriage 18 connection details remain unresolved, and will not be included as part of this application.

4. Free-Facade Zone

FIG. 35 through FIG. 41B illustrate free-facade zone in-fill components. The drawings show how a great degree of versatility can be achieved within a Loq·kit free-facade zone (in-fill exterior wall between structure).

A. 6-way Connector

In-fill exterior wall components are held together with a Loq·kit 6-way Connector 21. The connector 21 enables free-facade zone components to snap together, and to be released. By its placement within vertical and horizontal joints between in-fill components, the connector's 21 unique shape can receive interfaces from six directions: up, down, left, right, front, or back. Each connection can also be released—so that free-facade components can be rearranged by the homeowner.

A 6-way Connector 21 is comprised of three parts: a 6-way half "O" 21*a*, a 6-way half "C" 21*b*, and a release screw 21*c*. These components are illustrated individually in FIG. 35. The now shown in the drawing represents the direction in which plastic extrusion "C" 21*b* is pushed in order to engage it with plastic extrusion "O" 21*a*. Once engaged, the parts are held together by release screw 21*c*. An assembled 6-way Connector 21 is illustrated in FIG. 35A. The drawing shows a front, top, and right-side view of the 4½" long connector. Once fitted together, the shape of "O" 21*a* clasps with "C" 21*b* to create a strong connection. The clasp can be separated by removing release screw 21*c*, allowing extrusions "O" 21*a* and "C" 21*b* to be pushed apart. The physical shape of the connector components 21*a* and 21*b* enable free-facade zone assemblies to be taken apart.

B. Wall Panel

A cross-section of a typical Loq·kit wall panel 22 is shown in FIG. 36. For modular panel dimensions (width and height), as a function of the alternating-sequence, refer back to FIG. 32. FIG. 36 shows the wall panel's 22 assemblage. It is similar to floor panel 15, in that it is inspired by existing SIPs technology. A wall panel 22 has a rigid foam core—wall panel insulation 22*d*—sandwiched between two plastic sheets—wall panel outside sheet 22*b* and wall panel inside sheet 22*e*. The sheets are laminated with a thin plastic veneer—either wall panel exterior finish 22*a*, or wall panel interior finish 22*f*. The finish veneers are selected by the homeowner and are factory-applied. They provide both the interior and exterior wall finish of the home. While the cross-section of the Loq·kit wall panel 22 resembles common SIPs technology, it is different in that building structural loads are carried by the panel sheets with the SIPs system—and Loq·kit structural loads are carried by the building's metal frame. Only the weight of the wall panel itself, and any panel above it in a free-facade zone is carried by the outside 22*b* and inside 22*e* sheets of a Loq·kit wall panel 22.

The greatest novelty of a Loq·kit wall panel 22 is its perimeter face treatment. Each of the four perimeter faces of a wall panel incorporates a plastic wall panel extrusion 22*c*. This extrusion is laminated to the insulation 22*d*, and hot-seamed to outside sheet 22*b* and inside sheet 22*e*. It is applied at the factory and incorporated to provide a water-tight seal at all edges. A typical wall panel (or window panel, or door panel) utilizes extrusion 22*c* along the length of its perimeter faces.

C. Weather Strip

A cross-section of a Loq·kit weather strip is illustrated in FIG. 38. It is an exterior weather strip 23. An interior weather strip 24 is similar—and differs only by the inclusion of an interior finish veneer—it will be introduced in a later section of this specification.

An exterior weather strip 23 is a plastic extrusion with a rubber seal at opposite sides along its length. Weather strips vary in length. Their correct length is determined by an installer in the field, based on the length of the joint to be covered. A weather strip 23, or 24 is the only on-site-modified component of a Loq·kit assembly. In order to illustrate where a weather strip 23 appears in a typical facade, FIG. 37 is used. The drawing shows the final configuration presented earlier in FIGS. 2A, 2B, 3, and 4. A bold line segment and arrow 38*s* mark a typical panel joint and describe a section-cut where FIG. 38 would be found in the assembly. It is one of many locations where a weather strip 23 is visible on the facade. The cross-section reference markers 39*s*, 40*s*, 41*s* and 42*s* for FIGS. 39, 40, 41, and 42, respectively, also shown in FIG. 37, each mark other exterior weather strip 23 locations. Together, the section markers identify five unique free-facade zone interface conditions—each of which employs the weather strip 23.

A weather strip 23 is made up of three parts: a body extrusion 23*a*, flanked by two compression seals 23*b*. The body extrusion 23*a* is plastic. Compression seals 23*b* are extruded rubber, and are adhered to the body extrusion 23*a* by the weather strip manufacturer. FIG. 38 shows an uninstalled weather strip 23. The arrow in the drawing shows the direction that pressure is applied to the weather strip 23 when engaging it into an assembly. The strip's top compression seal 23*b* is enlarged in FIG. 38A. The enlarged cross-section of the compression seal 23*b* shows its deformation when correctly installed. As pressure is applied to weather strip 23, and it is squeezed into a common panel joint, the mating surface of panel extrusion 22*c* compresses the rubber seal. The extended "ear" of compression seal 23*b* will project beyond the face of body extrusion 23*a* when the weather strip snaps into place. The undeformed portion of rubber seal 23 will bend slightly over the mating edge of body extrusion 23*a*, producing a snug and weather-tight assembly.

D. Making Connections

The assembly of free-facade zone components is detailed below in FIGS. 39, 40, 41, and 42. Free-facade connections are made by combining the technology of the 6-way Connector 21, the wall panel extrusion 21*c*, and the weather strip 23, and 24.

d1. Wall Panel-to-Wall Panel Connection

FIG. 39 illustrates a typical connection between two wall panels 22. It represents both a vertical (jamb) and a horizontal (head or sill) connection. Either oriented vertically or horizontally, the 6-way connector 21 is positioned between the panels 22, while ensuring that panel release screw 21*c* is facing the interior of the house. In-line pressure is then applied to engage the connector 21 with the panel extrusion 22*c*. It is a snap-lock assembly. Upon contact with each other, the projecting flanges of connector 21 are pushed inward, while the projecting flanges of extrusion 22*c* are pushed outward. The in-line pressure temporarily deforms the ductile plastic components until they snap-lock together. The adjacent wall panel is attached by repeating the process with pressure applied in the opposite direction. FIG. 39A shows two wall panels 22 joined together by a 6-way connector 21. All wall panels can be connected to each other by applying pressure in an upward, downward, or sideways direction. Should the panels need to be released from one another, release screw 21*c* can be removed. The connector 21 components, "O" 21*a*, and "C" 21*b*, will slide apart laterally (the wall panel to be removed will slid toward the interior)—enabling wall panels (or door or window panels) to be easily removed from an assembly.

To complete the wall panel 22-to-wall panel 22 connection, the weather strips 23 and 24 are applied. FIG. 39A illustrates the connection of two wall panels and a 6-way connector. The arrows show the direction of applied pressure which will lock each weather strip into the assembly. FIG. 39B shows the completed panel-to-panel connection. In the drawing, weather strips 23 and 24 are locked into the wall panel extrusions 22*c*. The assembled panel extrusions 22*c* create a continuous channel along the length of the joint. As a weather strip 23 or 24 is pressed into a joint between panels, its primary teeth are pushed inward (toward each other), until they pass the projecting ridge of both panel extrusions 22*c*. Once beyond the ridge at either side, the primary teeth regain their original shape—just as the secondary teeth make contact with the inwardly-bent panel extrusion ends. With the primary teeth locking the weather strip to the panel extrusions, and the secondary teeth pushing evenly against the panel extrusions, the plastic components take on a firm and snug fit. A weather strip 23 or 24 can be removed by pulling at either end with slightly more force than was required for its installation. The panel extrusion ridge will deform temporarily to enable the weather strip's removal.

d2. Wall Panel-to-Floor or Roof Frame Connection

FIG. 40 illustrates a wall panel's 22 connection to a house's structural frame. The connection is common to a floor frame's 4 top (shown), or bottom, or a roof frame's 7 top or bottom. The make-up of the Loq·kit floor and roof frame has been described. Each frame has a top and bottom extrusion. In each case, the extrusion is the same. FIG. 40 shows a cross-section of a floor frame 4, with top extrusion 4*f*. The extrusion is attached at the factory with plastic retainers (the retainers are not part of this application). The common frame extrusion 4*f*, is similar to wall panel extrusion 22*c*. Yet, its profile is slightly narrower to accommodate snap-cladding. This will be described in a later section of this specification. With a panel-to-frame connection, the weather strips 23 and 24 can not be installed until the snap-cladding is in place. Therefore, FIG. 40 does not show the exterior or interior weather strip, as their installation will be detailed later.

A wall panel-to-frame connection is realized by pushing the required 6-way connectors 21 into the frame top extrusion 4*f* (or bottom extrusion 4*f*). The wall panel can then be installed by pushing its panel extrusion 22*c* down (or up for bottom installations) and over the exposed teeth of the 6-way connectors. FIG. 40A shows a cross-section of a completed wall panel-to-frame connection.

d3. Wall Panel-to-Window or Door Panel Connection

A Loq·kit exterior door or window unit is treated as a standardized "panel" within a free-facade zone. Just as wall panels are dimensionally regulated by the Loq·kit grid (refer back to FIG. 32 for standard wall panel sizes), so are exterior doors and windows. Door sizes are limited to a few standard sizes, while window size variation matches the standard panel sizes shown in FIG. 32.

An exterior door or window panel 27 is also treated as a standardized "panel" by way of its attachment within an assembly. All free-facade zone panels are attached to each other—and the structural frame members—with 6-way connectors 21, including door and window panels.

A typical window 27 to wall panel 22 connection is illustrated in FIG. 41. This Fig is interchangeable with an exterior door connection by substituting the window frame with a door frame. In either case, the installation is identical. In order to best represent this interchangeability, a single drawing cross-section is used for both cases.

A window unit 27*a* consists of a frame and sash and is size-regulated, or standardized, by the Loq·kit grid. Each window or door frame has two channels cut into the outside perimeter of the frame. Other than its regulated size, and perimeter channels—a window 27*a* is prior art. However, these size-regulated prior art components are fitted with two unique Loq·kit claddings that enable their connection to the 6-way connector 21, and other system components.

FIG. 41 shows the make up of a window panel 27. It consists of a window unit 27*a*, a lock 27*b*, and a trim 27*c*. A door unit is fitted similarly—with a door unit, lock 27*b*, and trim 27*c*. The claddings, 27*b* and 27*c* enable the adaptation of prior art to Loq·kit's snap-lock interface technology. This is done prior to delivery at the building site. For a typical window panel 27, lock 27*b* is pressed into the window unit's 27*a* perimeter channels. The technology for making this male-to-female connection is common to the window manufacturing industry. Trim 27*c* is then snapped over both; sealing the connection between unit 27*a* and lock 27*b*. This is also common window manufacturing/cladding technology. A door panel is fitted with lock 27*b* and trim 27*c* in the same manner prior to its delivery at the building site.

Once clad, a window panel 27, or door panel, can be attached within a Loq·kit assembly. This is accomplished on-site by aligning the window or door panel along an appropriately sized void between adjacent panels, that is fitted with 6-way connectors 21, and pushing. By its contact with the 6-way connectors 21, the window or door panel will snap into place. With pressure applied on the exterior of a window panel 27, for example, and directed toward the interior, the tooth of lock 27*b* will engage with the connectors 21. This connection is illustrated in FIG. 41, with an arrow showing the directed pressure on window panel 27, and thus on lock 27*b*. FIG. 41A shows the engaged window panel 27 and 6-way connector 21. The wall panel 22 is also connected to connector 21 as previously described. Accordingly, the connection of a door panel is the same.

FIG. 41 also shows a casing 28. It is made up of body extrusion 28*a*, finish veneer 28*b*, and compression seal 23*b*. Casing 28 must be installed on the interior side of the window-to-wall panel joint in order for the assembly to be secure. Because a window 27 or door panel is snapped into place from the outside, the potential exists that it may, with force delivered by a pry-bar for example, be unsnapped from the outside. The installation of casing 28 prevents this. Its body extrusion 28*a* is shaped to include a projection along its joint-side length. When casing 28 is pressed into the assembly, the projection (shown in FIG. 41 at the point where 28*a* is marked) slides into the U-shaped space along the interior side of lock 27*b*. In this location, the projection occupies the space required by lock 27*b* to move clear of its engaged position on connector 21. Only by first removing casing 28 from the interior of a home, can a window 27 (or door 25) panel be removed. This is the secure method by which Loq·kit window 27 and door panels are installed.

FIG. 41A shows a window panel connected to a wall panel by the 6-way connector. The exterior and interior weather strips are uninstalled. FIG. 41B shows the completed and weather-tight connection.

d4. Window or Door Panel-to-Window or Door Panel Connection

A Loq·kit door or window 27 panel may be placed alongside other door and window panels. Allowing for this, an entire free-facade zone may be composed of an arrangement of door and window panels—or may contain none at all. With Loq·kit's free-facade zone technology, exterior walls can be assembled into an unlimited variety of wall 22, door, and window 27 panel configurations. Furthermore, due to their standardized sizes and snap-lock interfaces, they are interchangeable with each other. For example, a wall panel 22 may be removed, and a door or window 27 panel may be put in its place. As long as a panel's size is coordinated within an assembly, it may function as wall, door, or window—and can be installed temporarily, or permanently.

FIG. 42 illustrates the connection of two adjacent window 27 panels. The connection of two adjacent door panels or the connection of a door panel and a window 27 panel is similar to that described below regarding the connection of two adjacent window 27 panels. The hardware for the frame's (door or window) installation is the same in either case and is shown installed on the frame in FIG. 42. The installation is similar to that described in FIG. 41, except that pressure is applied from the outside toward the inside for each panel's attachment to connector 21. As described previously, casing 28 is then installed to secure the panel within the assembly. While lastly, weather strips 23 and 24 are installed between the frames—producing a weather-tight connection.

5. Roof Panel, Roof Panel-to-Truss Connection

The make up of a Loq·kit roof panel 30 is similar to a wall panel 22. They are both inspired by SIPs (Structural Insulated Panels) technology, yet their inside and outside sheets do not support building structural loads. FIG. 43A shows the cross-section of a typical Loq·kit roof panel 30. The wall panel is made up of panel top finish 30*a*, panel top sheet 30*b*, panel extrusion 30*c*, panel insulation 30*d*, panel bottom sheet 30*e*, and panel bottom finish 30*f*. In the drawing, the flanking panel extrusions 30*c* are shown set apart, or exploded, from the panel assembly. The panel extrusions 30*c* at each side of a roof panel 30, are the components that provide the interface mechanics between in-fill and structure. They are extruded plastic pieces, and are hot-seamed to the panel assembly by factory workers. FIG. 43B shows the roof panel 30 cross-section with integrated panel extrusions 30*c* at each side. Like other in-fill components, roof panel 30 lengths and widths are standardized with respect to the alternating sequence.

Again, the width of a roof panel 30 is a function of the alternating sequence. While the location of Loq·kit structural frame members is also standardized with the sequence. Therefore, it is possible to establish a relationship between roof truss 10 spacing and standard roof panel 30 width. By coordinating roof truss spacing with roof panel width, a roof can be enclosed easily with an array of snap-lock in-fill panels.

A snap-lock roof panel-to-roof truss connection is illustrated in FIG. 44. The drawing shows an exploded cross-section of a typical joint between assembled roof panels. In the drawing, two adjacent roof panel 30 ends are positioned above a roof truss 10 top chord. The top chord has been described previously, and is made up of two opposing, but same top chord halves 10*a*, and a gutter liner 10*b*. The top chord halves are metal, while the gutter liner is plastic. Also shown in the drawing, above the roof panels, is a typical exterior weather strip 23. A roof panel 30 is snapped into a Loq·kit assembly by lifting it above a width-coordinated opening between roof trusses 10, and applying firm downward pressure along the length of its sides. The arrows in FIG. 44 show the direction of this pressure relative to the truss top chord. With pressure applied along its edge, the roof panel extrusion 30*c* will lock into the top chord. This happens when the flexible plastic tooth of the panel extrusion 30*c* bends temporarily around the leading edge of the rigid top chord half's 10*a* prong—and then snaps back into its original shape as it is pressed downward and clear of the prong. It is in this position that the panel extrusion 30*c* is fully engaged with the top chord half 10*a* by contact of the extrusion's tooth with half 10*a*, and half's 10*a* contact with the bearing surface of extrusion 30*c*. Both panels are shown snap-locked into place in FIG. 44A. With the installation of exterior weather strip 23—by downward pressure setting it into the void between panels—the connection is finished and made weather-tight. A completed connection is illustrated in FIG. 44B.

Because the weather strip 23 is installed horizontally (its face and compression seal ends facing upward—to some degree, based on roof pitch) in roof applications, it is more prone to failure than it is when installed in vertical applications (exterior walls). Simply because gravity pulls rainwater downward, and sun rays strike roof surfaces—in general—more intensely than wall surfaces, horizontal seals are more susceptible to deterioration and failure. Accounting for this, all Loq·kit connections between roof panels incorporate a secondary strategy for diverting unwanted water. FIG. 44B shows the completed roof panel 30-to-roof truss 10 connection, with installed weather strip 23. Should water penetrate weather strip's 23 compression seals 23*b*, it will fall onto the surface of the roof truss' top chord gutter liner 10*b*. The gutter liner 10*b* occupies the inside face of the U-shaped top chord. As water falls onto its surface, it runs down the length of the roof truss' top chord, to the eave, and then falls to the ground. Because a gutter lies directly below each joint between Loq·kit roof panels, the possibility for roof leakage is minimized.

6. Roof Rake, Roof Rake-to-Truss Connection

A Loq·kit roof rake 31 is a component used to finish and seal the sloped edge where roof and gable meet. In essence, the roof rake 31 functions similarly to traditional rake trim boards and overhanging roof edge. This condition is commonly referred to as the "roof rake", and is made up of a projecting, or overhanging roof edge that protects the joint between roof and wall from the elements. A traditional roof rake also utilizes a trim board along its projected exterior face in order to create an attractive, finished appearance. Similarly, a Loq·kit roof rake 31 provides an overhanging roof edge that protects the joint between roof and wall, while also providing a broad and attractive finished roof edge.

FIG. 45 illustrates the components that make up a typical roof rake 31 cross-section. The drawing shows four individual components and their assembled relationship to each other (shown by means of the dashed lines), and an applied finish veneer. FIG. 45 shows an outer body extrusion 31*b* with applied finish veneer 31*a*. This component provides the finished top and side face of the roof system. A factory-assembled, and complete roof rake 31 is made up of an outer body extrusion 31*b*, onto which an inner body extrusion 31*c* and rake extrusion 4*f* are hot-welded. The connected components are injected with body insulation 31*d*, and finish veneer 31*a* is applied. A cross-section of a typical factory-assembled Loq·kit roof rake 31 is shown in FIG. 45A with its subcomponents identified.

FIGS. 45B, 45C, and 45D illustrate the way in which a roof rake 31 is placed within a Loq·kit building assembly. FIG. 45B is an exploded cross-section of a sloped roof edge connection with exterior wall—it shows the components that make up a typical Loq·kit roof rake assembly. The drawing shows the U-shaped top chord members 10*a* of a Loq·kit roof truss 10. Positioned above the truss top chord is a roof panel 30 and roof rake 31. To the side of the roof truss top chord is a wall panel 22. Previously in this specification, the connection of a roof panel 30 to a roof truss 10 was described—refer to FIG. 44. In the same snap-lock manner, both the roof panel 30 and roof rake 31, can be installed onto the truss' top chord. The inner body extrusion 31*c* of roof rake 31 is functionally the same as the roof panel extrusion 30*c* at the side of the roof panel 30. The installation process for both components is the same, and the addition of an exterior weather strip 23 is all that is needed to seal their connection with the roof truss 10. FIG. 45C shows roof panel 30 and roof rake 31 installed onto roof truss 10, prior to installation of weather strip 23.

A roof rake 31 seals the connection between roof and gable. It is always located where the roof end meets the top of an exterior wall. Because Loq·kit component sizes and layout locations are regulated by the modular sequence, the outermost roof truss at a building's gable end is always located at a standardized distance from the exterior gable wall. When a Loq·kit roof rake 31 is installed onto a gable truss (a truss located directly to the inside of a gable), exterior wall in-fill components may be stacked under the rake—and their centerlines will be aligned with the rake's 31 rake extrusion 4*f*. Once the appropriate wall height has been reached, the wall panel unit(s) 22 may be connected with rake 31 via Loq·kit 6-way connectors 21 in the typical free-facade zone fashion presented earlier. FIG. 45D shows a cross-section of an finished Loq·kit roof rake assembly.

Section 4. Sequence-Defined Snap Cladding

Like all other Loq·kit components, the physical dimensions of Loq·kit snap cladding parts are controlled by the alternating sequence. With shared modular dimensions, Loq·kit structure, in-fill, and snap cladding interfaces are coordinated to enable quick assembly or disassembly, and the interchangeability of system components.

A. Snap-Clad Structure

Each Loq·kit building consists of a metal frame, in-fill components, and snap cladding. The in-fill components enclose the living areas of the building—creating the separation of interior and exterior space. The snap cladding components protect the metal frame from exposure to the elements while sealing the building envelope. Together, the in-fill and snap cladding create a tight, energy-efficient, and weatherproof enclosure.

The installation of Loq·kit snap cladding occurs after the in-fill "panels" have been snap-locked into their positions within the frame. Once the in-fill is installed, various frame members will yet be exposed to the elements. These parts are chiefly, the upper and lower columns, and the floor and roof frames. To provide cover for these components, snap cladding is snap-locked over them. Loq·kit snap cladding are extruded plastic components that are pressed into place over the frame.

This application will identify three unique types of snap cladding. These are frame valance panels, corner cladding, and roof ridge cap.

B. Interchangeable Snap-Clad Components

1. Frame Valance Panels

The horizontal load-bearing members of a Loq·kit structural frame are the floor 4 and roof 7 frames. These components transfer either the weight of the floor and furnishings, or the weight roof system, to the columns. Loq·kit frame valance panels provide cover for these components.

Each frame valance panel is made of extruded plastic, and is injected with rigid foam insulation at the factory. The unique shape of the extrusion enables a valance panel to engage the frame member with a tight snap-lock fit.

There are three types of Loq·kit valance panels: a Lower Floor Frame Valance Panel 32, an Upper Floor Frame Valance Panel 33, and a Roof Frame Valance Panel 34.

A. Lower Floor Frame Valance Panel with Frost Edge

FIG. 46A is an exploded cross-section view of a typical Loq·kit component assembly at the lower floor frame 4. The various components shown in drawing, and their interface methods have been described in previous sections of this specification. These components are the floor frame 4, floor frame top extrusion 4*f* and bottom extrusion 4*f*, floor joist clip 5, floor joist 6, floor panel 15, 6-way connector 21, wall panel 22, and interior weather strip 24. FIG. 46A also shows the lower floor frame valance panel 32—not previously described. The lower floor frame valance panel 32 is cut to length at the factory. Its length is based on the structural span of the floor frame 4. The structural span of all Loq·kit floor frames is controlled by the alternating sequence. Therefore, the length of all lower floor frame valance panels 32 is a product of the alternating sequence. The height of the floor frame 4 and valance panel 32 are also controlled by the alternating sequence. The valance panel's 32 height, relative to the height of floor frame 4, is visible in FIG. 46A. The drawing shows the frame top 4*f* and bottom 4*f* extrusions in their factory-installed locations on floor frame 4. These two extrusions provide the connection mechanism for attaching the valance panel. The valance panel's 32 modular height enables a correct and tight snap-lock connection to the extrusions.

The floor frame valance panel 32 is made up of three parts: a finish veneer 32*a*, a body extrusion 32*b*, and body insulation 32*c*. The valance panel 32 is manufactured by extruding the body 32*b* into the section profile illustrated in FIG. 46A. The extruded section is then injected with foam insulation 32*c* and sealed at both ends. To complete the manufacturing process, the body extrusion 32*b* is then clad with a thin adhesive-backed plastic veneer 32*a* of the consumer's color or pattern choice.

The body extrusion 32*b* incorporates the valance panel's 32 connection hardware along its top and bottom lengths. The Loq·kit weather strip-like teeth are visible in the drawing at the top edge of the valance panel, and near the bottom edge, at a point in alignment with the floor frame's 4 bottom extrusion 4*f*. The interface of the valance panel's connection teeth with the top and bottom extrusions 4*f* works similar to the application of an exterior 23 or interior 24 weather strip, as previously described. Firm pressure applied directionally along the length of the valance panel will engage the teeth with the frame extrusions to produce a tight snap-lock fit. The weather seal along the top edge of the valance panel functions similar to those described in previous sections of this specification.

Below the valance panel's 32 bottom connection teeth, and along the panel's bottom edge is a long, thin blade that is integral with the body extrusion 32*b*. This blade is the lower valance panel frost edge. FIG. 46B illustrates the function of the frost edge. In the drawing, the components shown in 46A are assembled, and represent a typical finished condition at a lower floor frame 4. With Loq·kit's trench footing building foundation system, expensive site excavation is minimized. Building loads are transferred through the columns to bearing soils by the trench footing foundation. The trench footings are placed in a series of trenches that are cut into the building site—as shown in FIG. 2*l*. The lower floor frames 4 that span between structural columns occupy an assembled vertical position where their bottom edge is below grade. FIG. 46B shows an assembled floor frame 4 with its attached valance panel 32 in relation to a site-cut trench. The heavy dark line in the drawing represents the top, sides, and bottom of a site trench. The cross-section illustrated occurs at any point between columns and clear of the trench footings at each end. The assembled floor frame with valance is shown tucked into the top of the trench. Prior to its installation, the bottom of the trench is backfilled with soil to a depth just above the midpoint of the trench. A lower floor frame 4 can then be fastened to columns at either end, with its bottom edge projecting into the trench. The lower valance panel 32 can then be applied. The remaining void within the trench is then filled with gravel from the exterior side of the valance panel, producing a snug pest-controlled transition to grade along the building's perimeter. FIG. 46A illustrates the finished condition.

Because Loq·kit trench footings 1 are available in one standardized size—based on load spread, rather than footing depth—typical installed footing depths do not vary from one region to another. Therefore, the depth of the site trenches is the same regardless of climate. In turn, the lower floor frame 4 and attached valance panel 32 always project into the trench. In warm climates, ground temperature fluctuations are not significant. Yet in cold climates, ground heaving produced by cool temperatures places upward pressure on building components that are in contact with the ground Unless they extend into the ground, to a depth below that at which ground water freezes, building components will be subject to unwanted and damaging forces. Loq·kit's lower valance panel 32 frost edge mitigates these forces in three ways. First, the frost edge extends well below the bottom of the floor frame to which it is attached. As gravel is placed into the trench from the exterior side of the valance panel, a void is created on the interior side of the panel. This void can be seen in FIG. 46A on the left side of the frost edge. The void ensures that ground material (gravel) will remain sufficiently below the floor frame 4, where it cannot exert upward pressure through contact with the frame's bottom extrusion 4*f*. Resulting in an installed condition where the floor frame extends below grade, yet does not make contact with the ground. The frost edge's unique blade-like shape produces the second and third method for tempering uplift ground forces. The very leading edge of the blade reduces the surface area of the valance panel that is subject to uplift forces, while also diverting the gravel to each side of the frost edge as it presses upward during freeze-thaw cycles.

B. Upper Floor Frame Valance Panel and Roof Frame Valance Panel

Without its frost edge, a lower floor frame valance panel 32 would function the same as an upper floor frame valance panel 33, or a roof frame valance panel 34. Other than the action of the frost edge, each valance panel's purpose is to protect load-bearing structure, while sealing the building shell. Physically, the valance panels are largely the same—with a few exceptions. FIG. 47A shows a floor frame 4 and upper valance panel 33 in cross-section. Valance panel 33 is shown adjacent to the floor frame in order to show its similarities with lower level valance panel 32, as shown in FIG. 46A; Both valance panels attach to a common floor frame 4. The floor frame is the same for lower and upper level conditions. The snap-lock connection hardware integrated with the top edge of each extruded panel is the same. This connection hardware works the same as that of an exterior 23 or interior 24 weather strip—yet, only a single compression seal 23*b*, located along the top edge of the valance panel, is required. The arrow shown near the top edge of the upper level valance panel 33 in FIG. 47A illustrates the approximate location where applied pressure on the exterior side of the panel, will engage it with the floor frame. The lower edge of valance panel 33 is formed with the same connection hardware as the top edge. The bottom edge connection to floor frame 4 is a mirror image of the connection at the top. The height of upper level valance panel 33 is a function of the alternating sequence and is a Loq·kit modular size of 3A+4B.

FIG. 47B shows a cross-section of a roof truss frame 7 adjacent to a roof frame valance panel 34. The top and bottom edge of a roof frame valance panel is identical to the top and bottom edges of an upper level valance panel 33. The points along its edges where applied pressure will result in a snap-lock connection with a frame member are the same. Its section profile is also otherwise the same, yet differs only in that a roof frame valance panel is standardized at a smaller modular height of 2A+3B.

The panels 33 and 34 share a similar make-up as well. An upper level frame valance panel 33 is made up of a finish veneer 33*a*, body extrusion 33*b*, body insulation 33*c*, and a compression seal 23*b* along its top and bottom edge. In turn, a roof frame valance panel 34 is made up of a finish veneer 34*a*, body extrusion 34*b*, body insulation 34*c*, and a compression seal 23*b* along its top and bottom edge.

2. Column Cladding

Similar to Loq·kit structural frame members, which remain exposed to the elements until they are covered with snap cladding, Loq·kit structural columns must also be protected with plastic coverings. All structural column exterior faces are snap-clad in order to achieve a weather-tight building assembly. Additionally, interior column faces are covered with insulated snap cladding to provide an energy-efficient building shell.

Earlier in this specification, FIG. 11 illustrated four standardized ways in which a Loq·kit structural column can be enclosed within an exterior wall assembly. These four structural column-to-exterior wall assembly types are: a corner column, a T-intersection, a four-way intersection, and in-line. This specification will describe a typical assembled corner column condition with snap cladding. The finished T-intersection, four-way intersection, and in-line column assemblies will not be described, as they were not included in the provisional application.

A. Corner Cladding

FIG. 48 shows an exploded cross-section of a typical finished Loq·kit corner column installation. The cross-section is a plan view, and is cut through the assembly at free-facade zone. The cross-section is the same for an upper or lower free-facade zone; therefore, the column shown may be either a lower 2 or upper 3 column. Other previously-described Loq·kit components shown in the drawing include: wall panels 22 oriented at ninety degrees from each other, 6-way connectors 21, and interior 24 and exterior 23 weather strips. The drawing also shows an outside corner cladding 35 and an inside corner cladding 36. Both cladding components are extruded plastic—while the inside corer cladding is thermally insulated with a factory-injected foam. The outside corner cladding 35 is made up of an exterior finish veneer 35*a*, and a body extrusion 35*b*. The consumer-selected finish veneer 35*a* is factory-applied to the body extrusion 35*b* before or after an order has been placed. The veneer allows flexibility in order placement and fabrication. The inside corner cladding 36 is made up of an interior finish veneer 36*a*, a body extrusion 36*b*, and body insulation 36*c*. Similar to other Loq·kit components, the finish veneer enables easy mass-customization of building components. The length of both claddings, 35 and 36, are coordinated with typical alternating sequence dimensions—enabling easy and predetermined component interfaces.

The installation of Loq·kit corner cladding takes place prior to the installation of adjacent free-facade zone wall panels. With the column cladding in place, 6-way connectors 21 can be placed into the channel created by the united claddings, and the wall panels 22 may then snap-lock into position. A typical finished corner column connection is assembled by installing the outside corner cladding 35 first. Cladding 35 is installed by aligning its inside corner with the column's outside corner, and pressing firmly until its extruded teeth engage the column corners perpendicular to the direction of applied force. The force direction is represented in FIG. 48 by the arrow located between cladding 35 and column 2/3. Once installed, the projecting ridge located at the inside corner of cladding 35 will press against the column's corner surface—providing the force needed to pull cladding's 35 gripping teeth tightly against the column faces. The inside corner cladding 36 is then installed by aligning its inside corner with the column's inside corner, and pressing firmly (see arrow for direction) until its extruded tooth at each side engages the extruded tooth at either side of the outside corner cladding 35. In this installed position, the projecting ridge located at the inside corner of cladding 36 will push against the column. The pushing force of the ridge on the column creates a pulling force on the teeth, thus tightening the connection between the outside corner cladding 35 teeth and the inside corner cladding teeth 36. FIG. 48A shows the assembled corner claddings 35 and 36 installed over a corner structural column 2/3. The connection of adjacent exterior wall panels 22 occurs by placing 6-way connectors 21 into the channel created at either edge of the connected claddings. The wall panels 22 are connected to the claddings in the same fashion as all other free-facade zone connections. A plan-view cross-section of a completed corner assembly is shown in FIG. 48B.

3. Roof Ridge Cap

A Loq·kit roof ridge cap 42 is a snap cladding component that seals and insulates the roof ridge of a building. A building's roof ridge is the length along the shared peak of two roof slopes. A Loq·kit roof is installed with roof panels 30 that are snapped into place over an array of roof truss' 10. In order to seal the gap left between installed panels 10 along the roof peak, a roof ridge cap 42 is installed. FIG. 49 shows the component make-up of a Loq·kit roof ridge cap 42. The drawing is an exploded cross-section. It identifies five individual components and a finish veneer. A roof ridge cap 42 is made up of a top extrusion 42*b* onto which a bottom extrusion 42*c* is connected with factory-installed hot-welds. The components are both extruded plastic. Once the two extrusions are joined, the void at their center is filled with an injected foam insulation, or body insulation 42*d*. A compression seal 42*e* is adhered along both edges of extrusion 42*b*. To complete the finished roof ridge cap 42, a plastic film is adhered over the top of extrusion 42*b*. This plastic film is finish veneer 42*a*. A cross-section of a factory-assembled ridge cap 42 is shown in FIG. 49A.

FIG. 49B is a cross-section showing the building components associated with a typical ridge cap installation. The drawing shows a partial elevation of a roof truss 10, where the top chord members 10*a*, top gusset 10*c*, and center web bar 10*d* are identified. The roof truss top gusset 10*c* can be seen with a hole factory-drilled through the plate. The hole appears as the circle located directly above center web bar 10*d*. Into this hole is placed a roof truss stabilizer bar 11. The bar runs the length of the roof ridge and through the hole in all roof truss top gussets 10*c* common to the ridge. The stabilizer bar is fitted at each side of a truss top gusset 10*c*, with a retainer clip. The clip at each side of a truss prevents the truss' lateral movement and braces each truss with the others. FIG. 49B also shows a roof panel 30 top end positioned over each truss top chord 10*a*. The roof panels 30 are snap-locked over the top chords as previously described.

The roof ridge cap 42 is shown directly above the roof panels 30. Once the panels are pushed down over the truss, with stabilizer bar 11 installed, roof ridge cap 42 may be installed. The bottom extrusion of cap 42 is pressed into the gap between roof panels until its locking-teeth expand and contract—gripping the stabilizer bar along the length of the ridge. In this snap-locked position, the compression seal 42*e* at each bottom edge of the ridge cap 42 will be compressed over the top of the roof panel 30 below—providing a water-tight connection. FIG. 49C shows a cross-section of a finished roof ridge assembly.

The invention claimed is:

1. A building system comprising:

a load bearing post-and-beam frame defining a building and formed by horizontal structural members and vertical columns, wherein the vertical columns are located at ends of the horizontal structural members and the horizontal structural members extend along horizontal axes between the vertical columns, the horizontal structural members support building loads and transfer the loads to the vertical columns;

a plurality of modular, non-structural-load-bearing, in-fill components that enclose and form a weather resistant exterior shell of the building, wherein the in-fill components have dimensions that are regulated by an alternating sequence of A and B units of measure, the in-fill components having dimensions based on NA+(N−1)B, where N is an integer greater than zero and A is greater than B, and wherein at least some of the in-fill components have different values of N, and wherein the non-structural-load-bearing in-fill components include wall panels, door panels and window panels wherein each of the in-fill components includes an extrusion that extends continuously along each of four perimeter faces of each of the in-fill components and circumscribes an edge between exterior and interior finish faces of each of the panels and defines four perimeter mating faces, and has a protrusion extending toward one of the adjacent in-fill component mating faces;

a plurality of connectors connecting the adjacent in-fill components, each of the connectors engaging the protrusions extending from the adjacent in-fill components so that opposing parallel perimeter finish face edges of the adjacent in-fill components are separated by a standardized gap distance equal to the B unit of measure; and a mechanical weather strip located in the standardized gap between two of the adjacent in-fill components and covering a portion of the protrusions.

2. The system of claim 1, and further comprising:

snap-cladding components removably covering an exterior surface of the load bearing frame.

3. The system of claim 2, wherein the snap-cladding components are configured to be pressed into place over the load bearing frame to cover the exterior surface of the load bearing frame.

4. The system of claim 3, wherein the snap-cladding components include a frame valance panel that covers an exterior surface of one of the horizontal structural members and corner cladding that covers two exterior surfaces of one of the vertical columns.

5. The system of claim 2, wherein the snap-cladding components have dimensions that are a function of the alternating sequence of A and B units of measure.

6. The system of claim 1, wherein the horizontal structural members include a floor frame and a roof truss frame, and wherein the vertical columns support the floor and roof truss frames.

7. The system of claim 6, and further comprising:

floor joists having a length regulated by the alternating sequence of A and B units of measure; and floor joist clips snap-attaching floor joists to the floor frame.

8. The system of claim 6, and further comprising:

trench footings for supporting the load bearing frame, wherein each of the trench footings connects to one of the vertical columns.

9. The system of claim 8, wherein each of the trench footings comprises:

a base;

a saddle placed over a portion of the base and oriented perpendicular to the base so that the trench footing has a cross-shaped footprint; and a cap attached to the saddle for receiving one of the vertical columns.

10. A building system comprising:

a structural load bearing post-and-beam frame;

a protective non-load bearing weather resistant exterior shell that covers the frame and is made up of adjacent, modular in-fill components joined to one another by connectors and sealed by a mechanical weather strip;

wherein the modular in-fill components include wall panels, window panels, and door panels;

wherein sizes of the modular in-fill components are determined by the application of a regulating grid composed of alternating A and B units of measure, wherein the A unit is a standardized distance between permissible connection locations, and wherein the B unit is a standardized gap distance at the connection locations;

wherein B units within the grid represent permissible connection locations that function to standardize connection size and location directly by assigning a connection size, or gap, between finish face edges of the adjacent in-fill components equal to the B unit of measure and by regulating the placement of connections between in-fill finish faces to the B unit locations of the grid, wherein while informing modular parts size results as a function of the standardized connection gap B and standardized distance between connections A;

wherein each of the in-fill components includes an extrusion that extends along a perimeter edge of the in-fill component and has a protrusion extending away from the in-fill component;

wherein the connectors engage the protrusions extending from opposing edges of the adjacent in-fill components so that the finish face edges of adjacent in-fill components are parallel and separated by a distance equal to the standardized gap distance B;

wherein the weather strip is located in the standardized gap between two of the adjacent in-fill components and covers a portion of the protrusions; and wherein modular co-ordination of in-fill components is based explicitly on the measurements defined by the regulation of connection size and location afforded by the standardized unit B that is separated by a common unit A and results in a system of standardized finish face sizes of the in-fill components described by the following formula: NA+(N−1)B, wherein N is an integer greater than zero, and wherein at least some of the in-fill components have different values of N.

11. The system of claim 10, and further comprising:

snap-cladding components removably covering an exterior surface of the load bearing frame.

12. The system of claim 11, wherein the snap-cladding components are configured to be pressed into place over the load bearing frame to cover the exterior surface of the load bearing frame.

13. The system of claim 12, wherein the snap-cladding components include a frame valance panel that covers an exterior surface of one of the horizontal structural members and corner cladding that covers two exterior surfaces of one of the vertical columns.

* * * * *

UNITED STATES PATENT AND TRADEMARK OFFICE

CERTIFICATE OF CORRECTION

PATENT NO. : 8,353,131 B2
APPLICATION NO. : 11/652312
DATED : January 15, 2013
INVENTOR(S) : Patrick A. Freet It is certified that error appears in the above-identified patent and that said Letters Patent is hereby corrected as shown below:

In the Specification

Col. 1, Line 51
Delete "modem"
Insert --modern--

Col. 9, Line 32
Delete "a wait"
Insert --await--

Col. 10, Line 22
Delete "appealing"
Insert --appearing--

Col. 12, Line 39
Delete "a wait"
Insert --await--

Col. 15, After Line 13
Insert --25 Door Panel
25a door unit (size regulated prior art)
25b door lock
25c door trim
26 Door Casing
26a body extrusion
26b casing finish
23b compression seal--

Signed and Sealed this
Twenty-sixth Day of November, 2013

Margaret A. Focarino

Margaret A. Focarino
*Commissioner for Patents of the United States Patent and Trademark Office*

Col. 13, Line 53
Delete “a waiting”
Insert --awaiting--

Col. 20, Line 37
Delete “a typical”
Insert --atypical--

Col. 21, Line 35
Delete “a typical”
Insert --atypical--

Col. 41, Line 48
Delete “corer”
Insert --corner--